US012281464B2

(12) United States Patent
Loberger et al.

(10) Patent No.: US 12,281,464 B2
(45) **Date of Patent: *Apr. 22, 2025**

(54) LAVATORY SYSTEM MOUNTING BRACKET

(71) Applicant: Bradley Fixtures, LLC, Menomonee Falls, WI (US)

(72) Inventors: John M. Loberger, Germantown, WI (US); Scott M. Kluck, Mequon, WI (US); William L. Haas, Richfield, WI (US); Jason T. Dodge, Waukesha, WI (US); Cassandra A. Schneider, Milwaukee, WI (US); Eric Doubet, Oak Creek, WI (US)

(73) Assignee: Bradley Fixtures, LLC, Menomonee Falls, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/418,910

(22) Filed: Jan. 22, 2024

(65) Prior Publication Data

US 2024/0159029 A1 May 16, 2024

Related U.S. Application Data

(63) Continuation of application No. 18/090,663, filed on Dec. 29, 2022, now Pat. No. 11,879,239, which is a continuation of application No. 17/398,693, filed on Aug. 10, 2021, now Pat. No. 11,542,692, which is a continuation-in-part of application No. 16/245,937, filed on Jan. 11, 2019, now Pat. No. 11,083,340, which is a continuation-in-part of application No. 16/057,220, filed on Aug. 7, 2018, now Pat. No.

(Continued)

(51) Int. Cl.
*E03C 1/046* (2006.01)
*E03C 1/04* (2006.01)

(52) U.S. Cl.
CPC ..... *E03C 1/046* (2013.01); *E03C 1/0401* (2013.01); *E03C 1/0404* (2013.01)

(58) Field of Classification Search
CPC ..... E03C 1/046; E03C 1/0401; E03C 1/0404; E03C 1/02; E03C 1/055; E03C 1/14; E03C 1/18
USPC ..... 4/628, 617; 15/21.3, 14, 159.1; 134/56, 134/58, 29; 206/77.1
See application file for complete search history.

(56) References Cited

U.S. PATENT DOCUMENTS 10,697,160 B2 * 6/2020 Loberger ..... A47K 5/12
11,083,340 B2 * 8/2021 Loberger ..... A47K 1/00
(Continued)

FOREIGN PATENT DOCUMENTS

KR 20220071828 A * 11/2020 ..... A47K 5/12

*Primary Examiner* — Lori L Baker
(74) *Attorney, Agent, or Firm* — Boyle Fredrickson, S.C.

(57) ABSTRACT

A lavatory system mounting bracket for supporting a soap container below a countertop includes a top plate with an opening formed therein and configured to receive at least one of a refill port of the lavatory system and a mounting component of the lavatory system, at least one side plate extending downward from at least one edge of the top plate, and a bottom plate extending horizontally from a bottom edge of the at least one side plate. A cradle is formed by the bottom plate and the at least one side plate to support a soap container of the lavatory soap system.

20 Claims, 39 Drawing Sheets

Related U.S. Application Data

10,697,160, and a continuation-in-part of application No. 29/593,674, filed on Feb. 10, 2017, now Pat. No. Des. 847,305, and a continuation-in-part of application No. 15/176,406, filed on Jun. 8, 2016, now Pat. No. 10,041,236.

(60) Provisional application No. 63/209,260, filed on Jun. 10, 2021.

(56) References Cited

U.S. PATENT DOCUMENTS 11,542,692 B2 * 1/2023 Loberger ..... E03C 1/02
11,879,239 B2 * 1/2024 Loberger ..... E03C 1/046

* cited by examiner

LAVATORY SYSTEM MOUNTING BRACKET

CROSS-REFERENCE TO RELATED APPLICATIONS

This application is a continuation of U.S. application Ser. No. 18/090,663, filed on Dec. 29, 2022, which is a continuation of U.S. Pat. No. 11,542,692, filed on Aug. 10, 2021 and issued on January 3, 2023, which is a continuation-in-part of and claims priority to U.S. Pat. No. 11,083,340, filed on Jan. 11, 2019 and issued on Aug. 10, 2021, which is a continuation in-part of and claims priority to issued U.S. Pat. No. 10,697,160, filed on Aug. 7, 2018 and issued on Jun. 30, 2020, which is a continuation in-part of and claims priority to issued U.S. Pat. No. 10,041,236, filed on Jun. 8, 2016 and issued on Aug. 7, 2018, the entire contents of each of the above are hereby expressly incorporated by reference into the present application.

U.S. Pat. No. 11,083,340, filed on Jan. 11, 2019 and issued on Aug. 10, 2021 is also a continuation-in-part of and claims priority to U.S. Pat. No. D847,305, filed on Feb. 10, 2017 and issued on Apr. 30, 2019, the entire contents of which are hereby expressly incorporated by reference into the present application.

U.S. Pat. No. 11,542,692, filed on Aug. 10, 2021 and issued on Jan. 3, 2023, also claims priority to U.S. Provisional Application No. 63/209,260, filed on Jun. 10, 2021, the entire contents of which are hereby expressly incorporated by reference into the present application.

BACKGROUND OF THE INVENTION

1. Field of the Invention

The present invention relates in general to the field of lavatory systems. More particularly, the present invention relates to a lavatory system having a multi-function fixture. Specifically, a preferred embodiment of the present invention relates to a multi-function fixture for a lavatory system at which a user receives soap and water to wash hands and at which an air flow is provided to dry the hands after washing.

2. Discussion of the Related Art

As is known to those skilled in the art, washrooms have historically included separate soap dispensers, wash basins with faucets, and hand dryers or towel dispensers. Soap dispensers may be located between wash stations or in a location convenient to several wash stations. When a user dispenses soap, excess soap may drip from the dispenser. If a user has previously placed hands under the faucet to first wet hands, then water also drips from the user's hands as soap is applied. If the soap dispenser is not located over the wash basin, the excess soap and/or water drips on the deck of the basin or on the floor depending on the location of the soap dispenser. Further, as a user moves between the wash basin and the hand dryer or towel dispenser, excess water drips from the user's hands to the deck of the basin or to the floor depending on the location of the hand dryer or towel dispenser. The need to move between stations when washing hands results in an undesirable mess in the washroom.

To reduce the amount of mess, it has been known to add a soap dispenser next to the faucet where both are located over the same basin. However, this still requires a user moving to a hand dryer or towel dispenser. Recently, lavatory systems have been developed that further include a drying station also located over the wash basin. Thus, the entire process of washing and drying a user's hands may be completed without moving away from the wash basin.

However, such stations have so far required more space per user than existing lavatory systems. The addition of a drying station may require a larger basin. Further, the soap dispenser, faucet, and hand dryer create three fixtures that must be positioned on the deck of the lavatory system and arranged around the basin. Thus, it would be desirable to provide a fixture for a lavatory system that incorporates each of the dispensing features and that may be realized without requiring additional space per user.

SUMMARY AND OBJECTS OF THE INVENTION

The present invention is directed to a mounting bracket for supporting a soap container of a lavatory soap system underneath a countertop.

In accordance with an embodiment of the invention, a mounting bracket includes a top plate with an opening formed therein and configured to receive a refill port of the lavatory soap system, a bottom plate spaced apart from the top plate and configured to receive the soap container thereon, and a side plate extending between the top and bottom plates.

According to another aspect of the invention, the mounting bracket includes a spacer element disposed between the top plate of the mounting bracket and the countertop. The spacer element may at least partially surround the refill port. The spacer element may also be in the form of at least one extension extending upward from one or more side edges of the top plate.

According to yet another aspect of the invention, a first notch may be formed at a top edge of the side plate, while a second notch is formed at a first side edge of the top plate. The first and second notches are configured to be aligned with each other to form an opening.

According to another aspect of the invention, the side plate includes an upper portion extending downward from the top plate to a location adjacent a top surface of the soap container, an intermediate portion extending outward from the upper portion along the top surface of the soap container, and a lower portion extending downward from the intermediate portion along a side of the soap container and to the bottom plate. The intermediate portion of the side plate and the bottom plate may form a cradle that holds the soap container.

According to another embodiment of the invention, the side plate may include at least one side extension extending perpendicular from at least one of the first edge and the second edge of the side plate. For example, a first side extension may extend from a first edge of the side plate and along a side of the soap container, while a second side extension extends from the second edge of the side plate along an opposite side of the soap container.

According to yet another embodiment of the invention, a strap may extend from a location at or adjacent a first edge of the side plate, around the soap container, and to a location at or adjacent a second edge of the side plate. Openings may be formed in the side plate at or adjacent the first and second edges thereof either in the side plate or in its side extensions.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
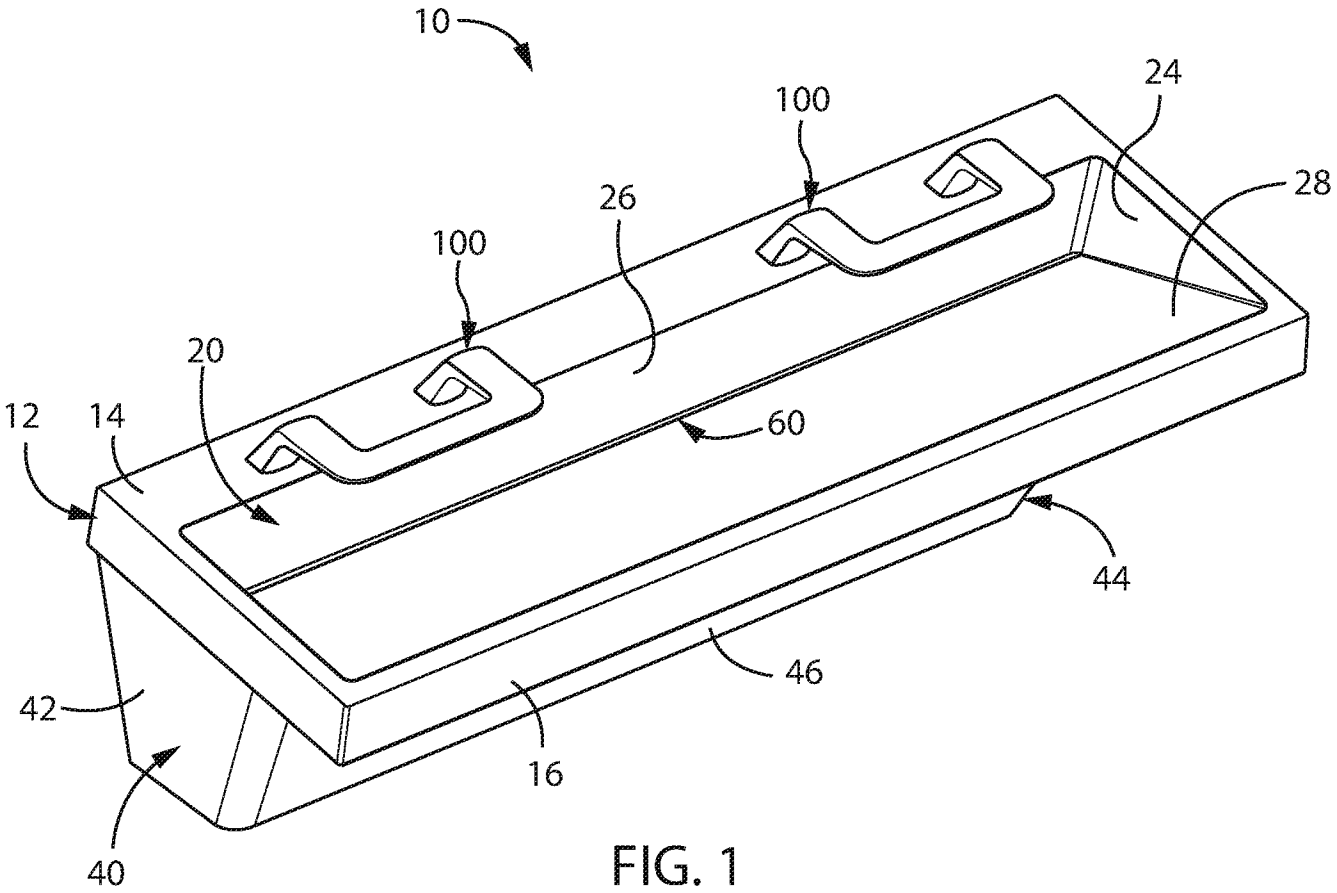
FIG. 1 is an isometric view of a lavatory system incorporating a multi-function fixture according to one embodiment of the present invention.
Figure 2:
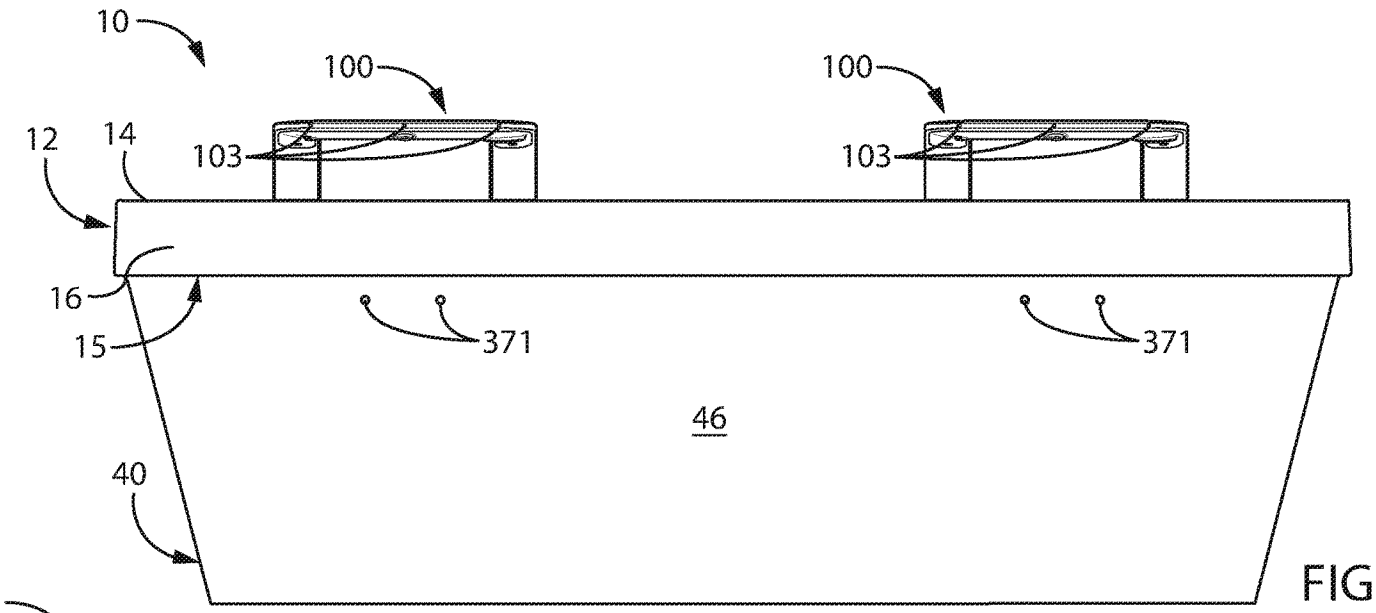
FIG. 2 is front elevation view of the lavatory system of FIG. 1.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

Throughout this description, various terms denoting direction, such as left and right, front and rear, up and down, top and bottom, and the like may be used. The directions are not intended to be limiting but are used to describe relationships of elements with respect to each other in the accompanying drawings. Unless mutually exclusive, it is contemplated that the elements may be reversed, for example, by turning a component around or upside down without deviating from the scope of the present invention.

Figure 5:
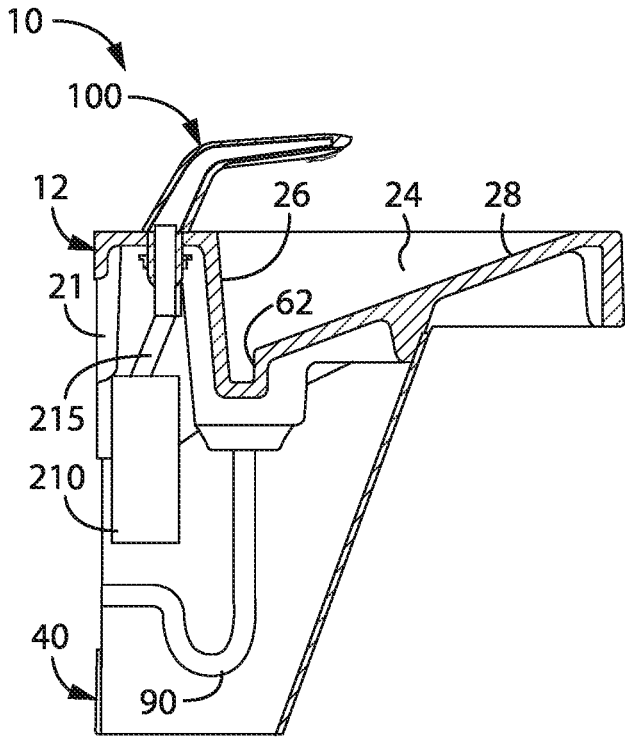
FIG. 5 is a sectional view of the lavatory system of FIG. 3 taken at 5-5.
Figure 6:
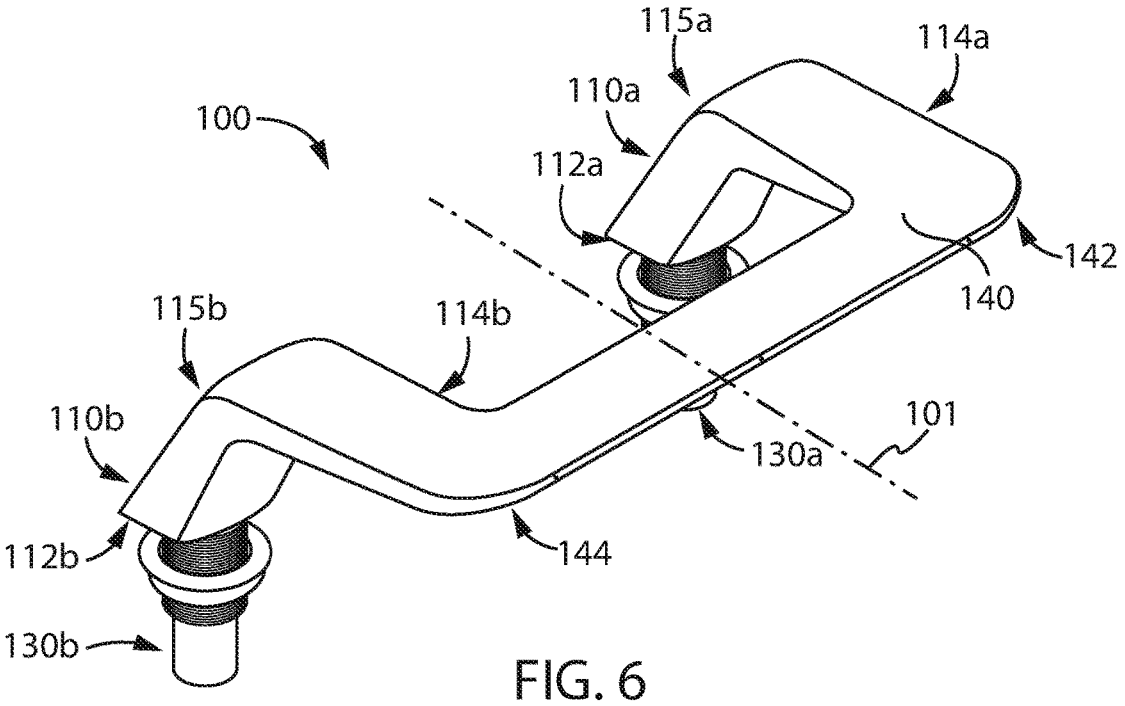
FIG. 6 is an isometric view of a multi-function fixture according to one embodiment of the invention.
Figure 7:
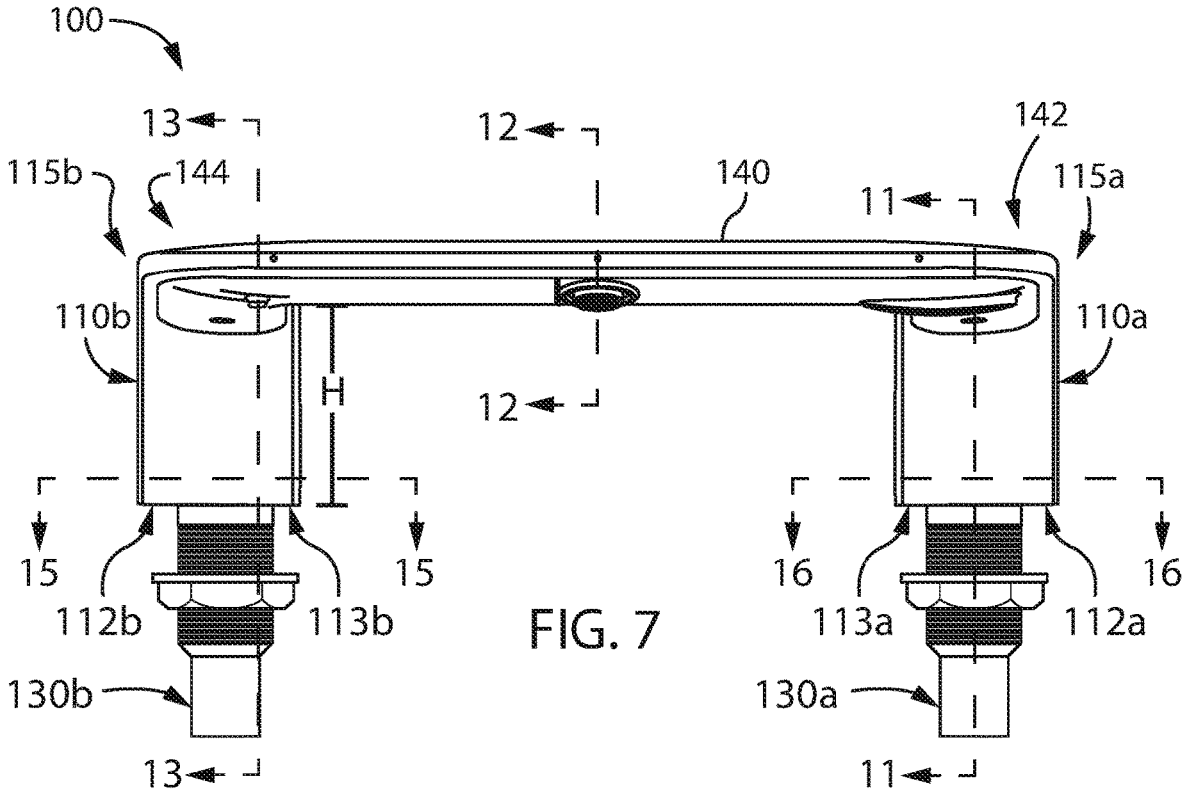
FIG. 7 is a front elevation view of the multi-function fixture of FIG. 6.
Figure 8:
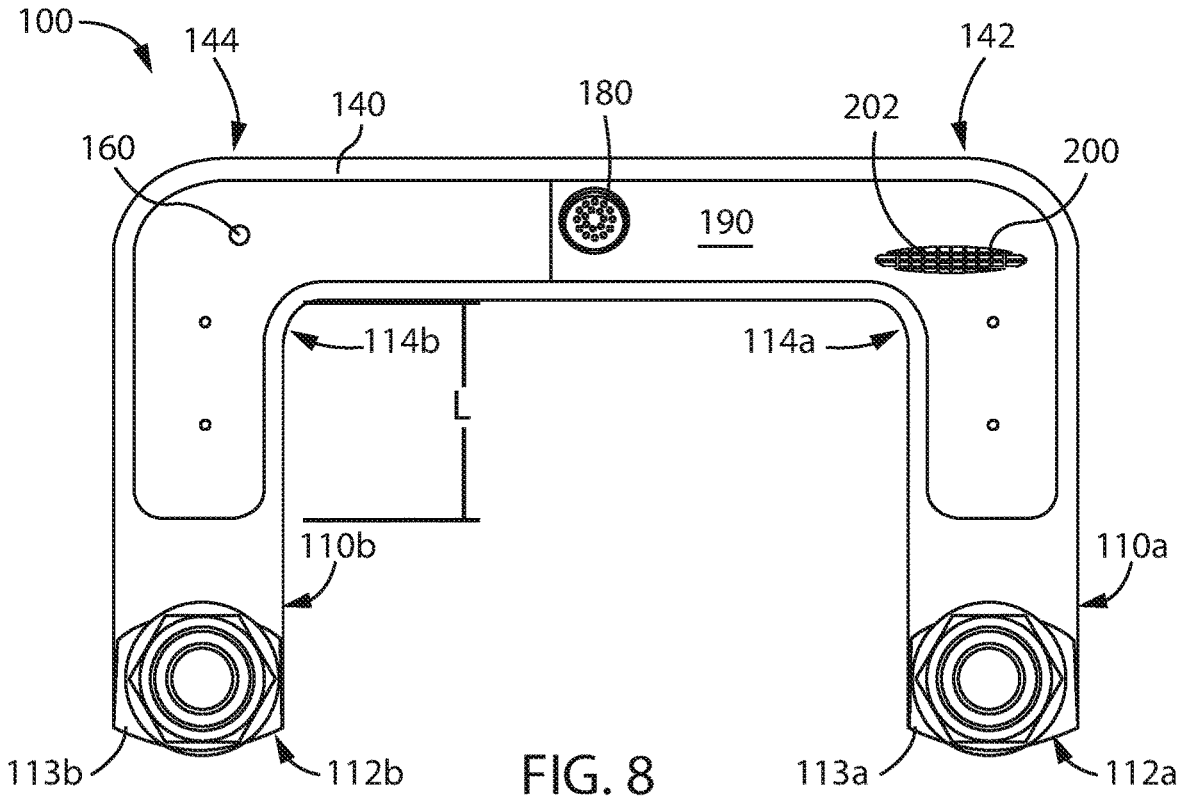
FIG. 8 is a bottom plan view of the multi-function fixture of FIG. 6.
Figure 9:
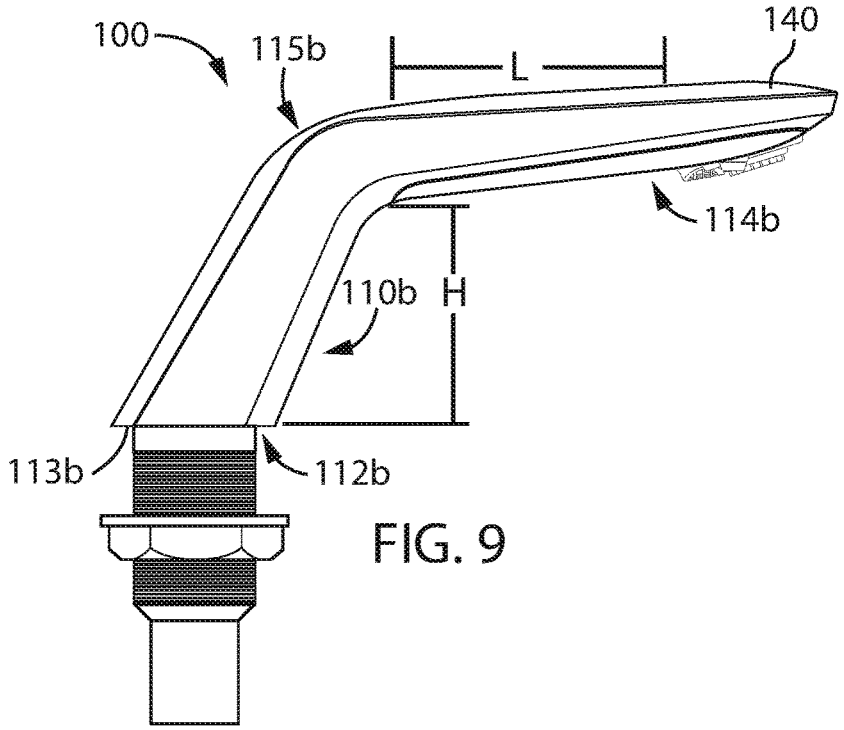
FIG. 9 is a right side elevation view of the multi-function fixture of FIG. 6.

Turning initially to FIG. 1, a lavatory system 10 in accordance with one embodiment of the invention is illustrated. The lavatory system 10 includes a deck 12 that is configured to be mounted to a wall. With reference also to FIG. 5, wall mounts 21 are secured to the wall and the deck 12 is secured to the wall mounts 21. The deck 12 has an upper surface 14 and an outer periphery 16 extending downward from the upper surface 14 and around the deck 12. A basin 20 is located within the deck 12. According to one embodiment of the invention, the deck 12 and the basin 20 may be integrally formed as a single unit. According to another embodiment of the invention, the basin 20 may be mounted to the deck 12. It is further contemplated that the lavatory system 10 may be free-standing, supported by the floor rather than being wall mounted. Rather, than including a wall mount 21, a support frame (not shown) may extend up from the floor, or other surface, on which the lavatory system 10 is installed.

Figure 3:
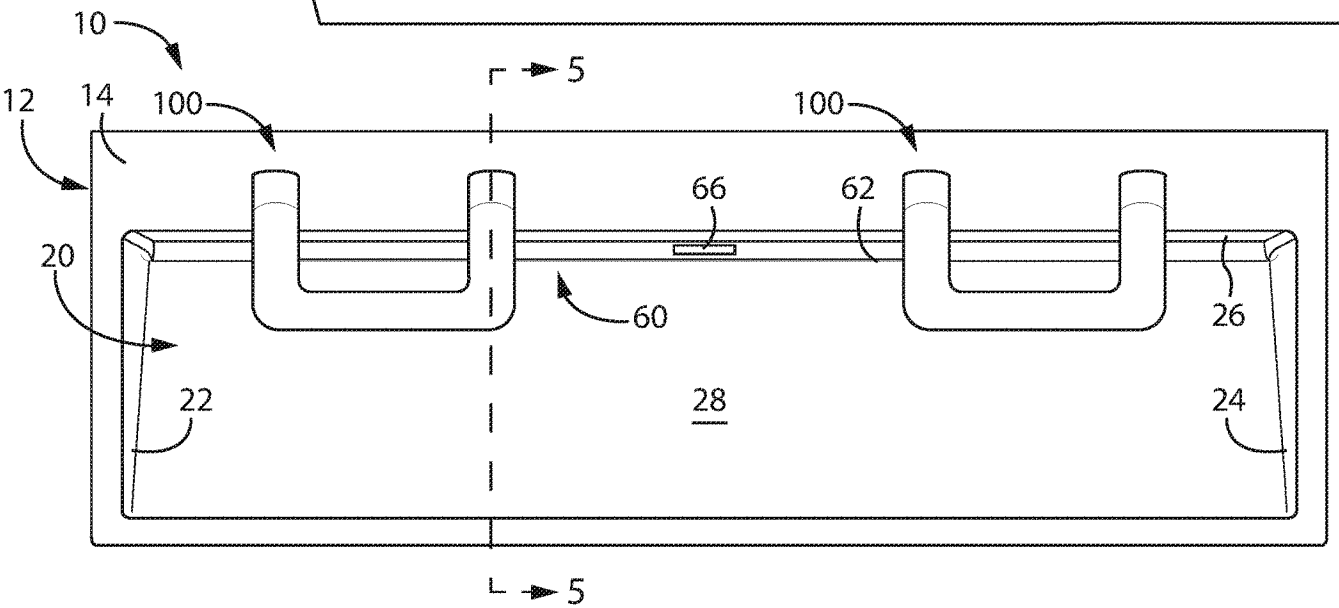
FIG. 3 is a top plan view of the lavatory system of FIG. 1.
Figure 4:
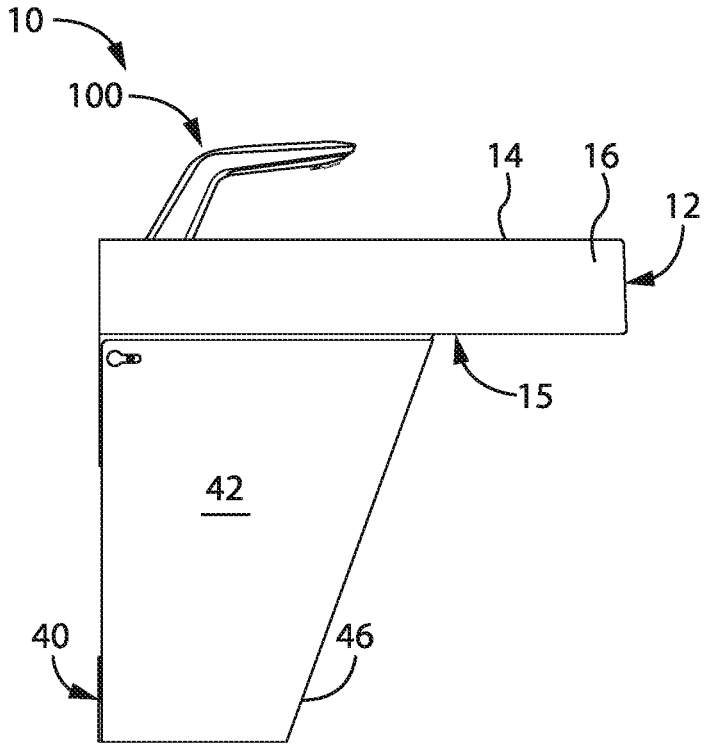
FIG. 4 is a side elevation view of the lavatory system of FIG. 1.

The basin 20 is a recessed area below the upper surface 14 of the deck 12 and is configured to receive products dispensed into the lavatory system. According to the illustrated embodiment, the basin 20 includes a first side 22 (see also FIG. 3) and a second side 24, where the second side 24 is opposite the first side. Each of the first and second sides 22, 24 extend generally orthogonal to and away from the wall on which the lavatory system 10 is mounted. The basin 20 also includes a third side 26 extending downward from an upper edge which joins the upper surface 14 of the deck 12 along the rear of the basin and further extends between the first side 22 and the second side 24. With reference also to FIG. 5, the third side 26 extends downward and the lower end of the third side forms, in part, a drain channel 62 in the bottom of the basin 20. The basin 20 further includes a fourth side 28 extending downward from an upper edge which joins the upper surface 14 of the deck 12 along the front of the basin and also extends between the first side 22 and the second side 24. The fourth side 28 of the basin 20 is sloped inward and downward from the front edge of the basin to a front edge of the drain channel 62. Although the basin 20 is described in detail with respect to the illustrated embodiment, it is understood that the basin 20 may take various shapes as would be understood to one skilled in the art without deviating from the scope of the invention.

The lavatory system 10 includes a housing 40 located below the deck 12 and extending around the lower portion of the lavatory system 10. According to the illustrated embodiment, the housing 40 includes a first side 42 and a second side 44, where the second side is opposite the first side. A rear edge of each of the first side 42 and the second side 44 abuts the wall to which the lavatory system 10 is mounted. Each of the first side 42 and the second side 44 extend forward, generally orthogonal to the wall. A front surface 46 of the housing extends downward and to the rear from a lower surface 15 of the deck 12. The front surface 46 extends the height of each of the first and second sides 42, 44. According to one embodiment of the invention, each of the first side 42, second side 44, and front surface 46 extend to the floor. According to another embodiment of the invention, the each of the first side 42, second side 44, and front surface 46 extend to some height above the floor. The front surface 46 is sloped to the rear from where it abuts the lower surface 15 of the deck 12. It is contemplated that the housing 40 may include a bottom surface (not shown) if the housing does not extend to the floor. Optionally, the housing may be open on the bottom as defined by the periphery of the first side 42, second side 44, front surface 46 and wall to which the lavatory system 10 is mounted. The housing 40 encloses the components of the lavatory system 10 located below the deck to provide a measure of protection to the components and to provide an aesthetically pleasing appearance to the lavatory system 10. Although the housing 40 is described in detail with respect to the illustrated embodiment, it is understood that the housing 40 may take various shapes as would be understood to one skilled in the art without deviating from the scope of the invention.

The lavatory system 10 further includes a drain system 60 extending longitudinally across the width of the basin 20. With reference also to FIGS. 18-21, the drain system 60 includes a drain channel 62 and a drain cap 70. According to the illustrated embodiment, the drain channel 62 is generally u-shaped. The drain channel 62 has a rear wall 63 and a front wall 64 extending the width of the basin 20. The rear wall 63 of the drain channel 62 may be coplanar with the third side 26 of the basin 20 and form a continuous surface. Optionally, the drain channel 62 may be offset from the third side 26 of the basin, forming a channel in a lower surface (not shown) of the basin 20. The drain channel 62 includes a lower surface 65 which also extends the width of the basin between the rear wall 63 and the front wall 64. An opening 66 in the lower surface 65 of the drain channel 62 allows waste water to exist the basin 20 into a drainpipe 90 (as shown in FIG. 5). The periphery of the drain opening 66 includes a pair of notches 68, where a first notch 68 is located to the rear of the drain opening 66 and a second notch is located to the front of the drain opening 66. Each notch 68 is configured to receive a tab 76 from the drain cap 70 as will be discussed in more detail below.

The drain cap 70 is configured to be removably mounted within the drain system 60. The drain cap 70 includes a front surface 72, a rear surface 74, and a top surface 73, where the top surface 73 spans between the front surface 72 and the rear surface 74 and each of the front, rear, and top surfaces extend the width of the drain channel 62. Each of the front surface 72 and the rear surface 74 have a tab 76 extending downward from the respective surface. The tab 76 includes a first surface 77, which is generally coplanar with and protrudes downward from the corresponding front or rear surface, and a second surface 78, which is generally orthogonal to and protrudes outward from the first surface 77. Preferably, the drain cap 70 and the tabs 76 are constructed of a sheet material, such as a stainless steel. The thickness of the sheet material provides sufficient rigidity that the drain cap 70 retains its desired shape if removed from the drain channel 62. However, the width of each tab 76 and the thickness of the sheet material for the drain cap 70 allows the tab 76 to deflect inward when a force is applied. Such a force may be applied, for example, when inserting the drain cap 70 into the drain channel. Each tab 76 is deflected inward as the drain cap 70 is inserted into the drain channel and as each tab 76 is inserted through the notch 68 in the periphery of the drain opening 66. The height of the first surface 77 of the tab 76 is equal to or greater than a thickness of the lower surface 65 of the drain channel 62. As a result, when the drain cap 70 continues to be inserted, the tab 76 extends through the lower surface 65. The material from which the tab 76 is made is resilient such that it returns to its original position once the tabs 76 are fully through the opening 66 in the drain channel 62. The second surface 78 of each tab 76 extends under the lower surface 65 of the drain channel, positively retaining the drain cap 70 within the drain channel 62. Applying pressure to each tab 76 such that the tab is again biased inward a sufficient distance that the second surface 78 is moved from beneath the lower surface 65 and within the periphery of the opening 66 of the drain channel 62 allows the drain cap 70 to be removed from the drain channel 62.

It is further contemplated that each of the front surface 72 and the rear surface 74 of the drain cap 70 include a series of bumpers 75 affixed to the surface and spaced out along the length of the drain cap. The bumpers 75 fit between the front surface 72 of the drain cap 70 and the front wall 64 of the drain channel 62 and between the rear surface 74 of the drain cap 70 and the rear wall 63 of the drain channel 62. The bumpers 75 define a press fit between the surfaces and help align the drain cap 70 within the drain channel 62. In addition, because the drain cap 70 is preferably made from a metal material, such as stainless steel, and the basin 20 and drain channel 62 are preferably made from a synthetic resin material, stone material, or combination thereof, the bumpers 75 aid in preventing damage to the drain channel 62 from the drain cap 70 as the cap is inserted into or removed from the channel.

Further, the top surface 73 of the drain cap 70 may be configured to help guide the direction of airflow dispensed from fixture 100. As will be discussed in more detail below, the fixture 100 is operative to dispense air flow into the basin 20 to dry a user's hands after washing. With further reference to FIGS. 32-37, a direction of airflow is indicated by arrows in the figures. The air is dispensed downward from the fixture 100 where it first hits the fourth side 48 of the basin 20 which is sloped downward and to the rear of the basin 20. The air flow generally follows the slope of the fourth side 48 toward the drain channel 62.

Figure 22:
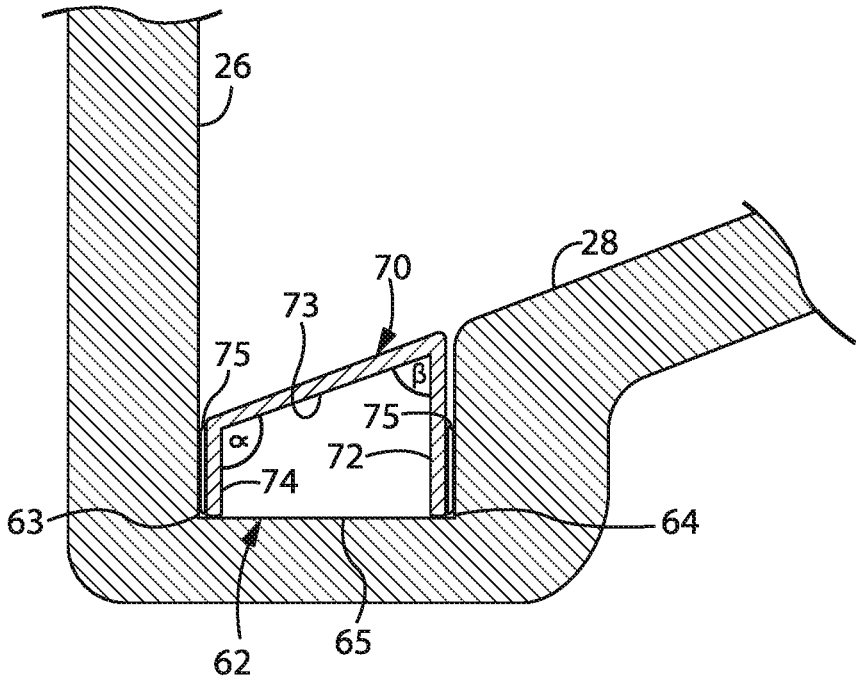
FIG. 22 is a sectional view of a basin, drain channel, and drain cover for the lavatory system according to another embodiment of the drain cover.

According to one embodiment of the invention, the drain cap 70 may be configured to guide the direction of the airflow toward the corners of the basin 20. With reference to FIG. 22, the front surface 72 of the drain cap 70 may be longer than the rear surface 74. As a result, the top surface 73 is sloped downward from the front wall 64 to the rear wall 63 of the drain channel 62. A first angle, $\alpha$, defined between the rear surface 74 and the top surface 73 of the drain cap 70 is an obtuse angle. A second angle, $\beta$, defined between the front surface 72 and the top surface 73 of the drain cap 70 is an acute angle. As shown in FIG. 22, the drain cap 70 may be configured such that the top surface 73 of the drain cap 70 is coplanar with the fourth side 28 of the basin 20. The air continues to flow from the fourth side 28 of the basin along the top surface 73 of the drain cap 70 until it intersects with the third side 26 of the basin 20. The air is then deflected both to the left and the right along the third side 26 of the basin and along the top surface 73 of the drain cap 70 toward the first and second sides 22, 24 of the basin 20.

Figure 23:
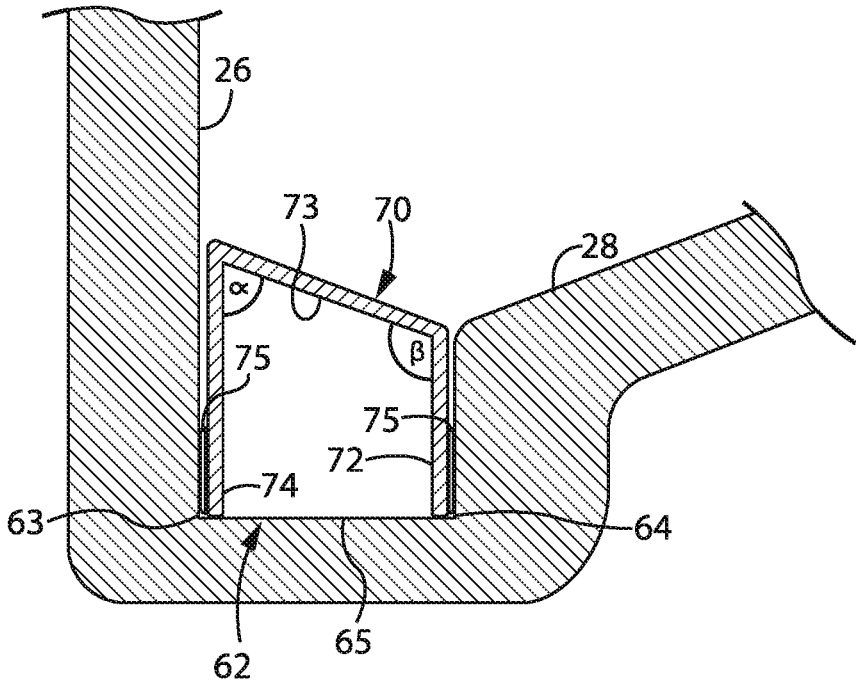
FIG. 23 is a sectional view of a basin, drain channel, and drain cover for the lavatory system according to another embodiment of the drain cover.
Figure 24:
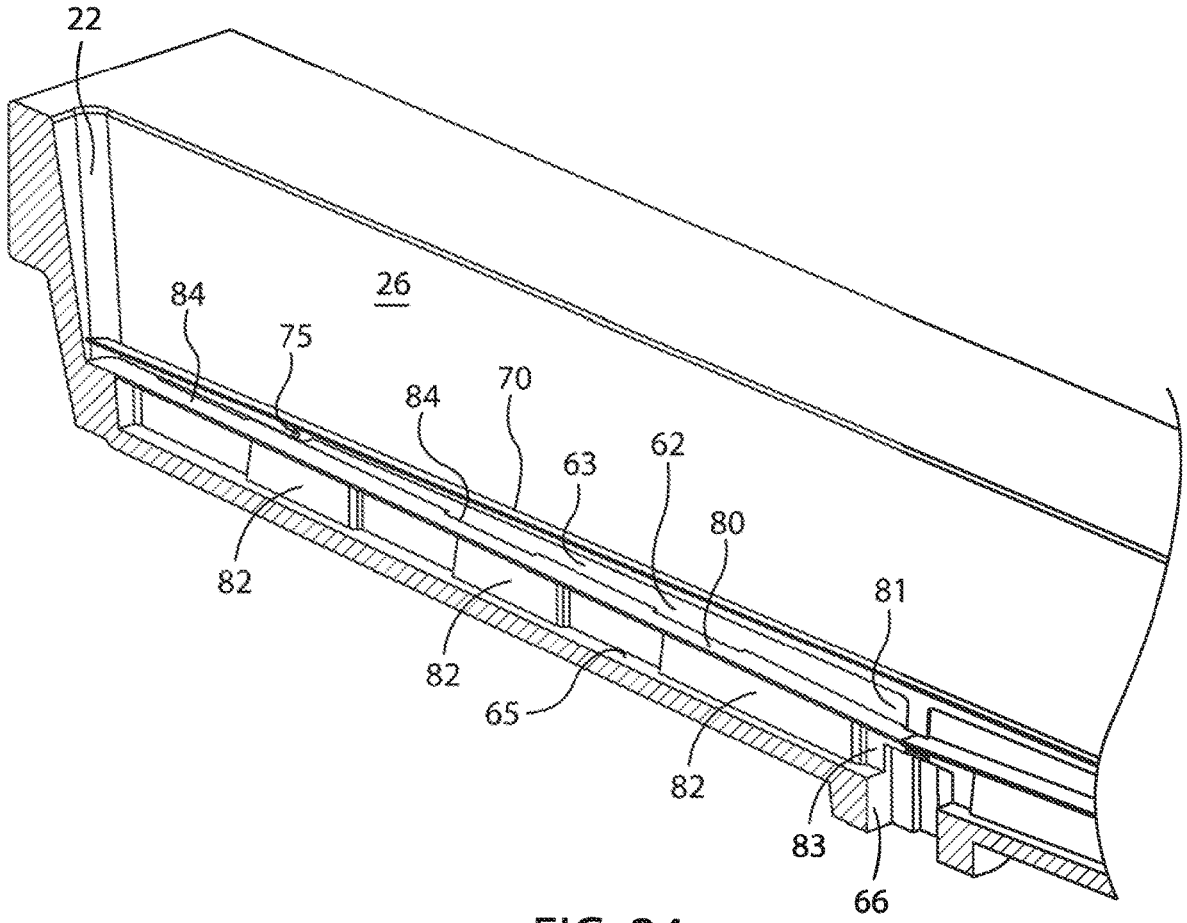
FIG. 24 is an isometric sectional view of a basin, drain channel, and drain cover for the lavatory system according to another embodiment of the drain channel.
Figure 25:
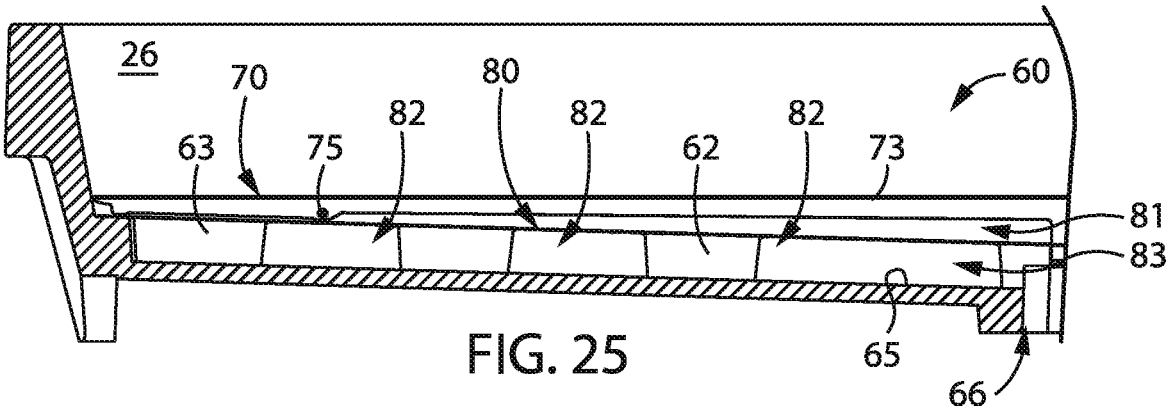
FIG. 25 is a front sectional view of the basin, drain channel, and drain cover of FIG. 24.
Figure 26:
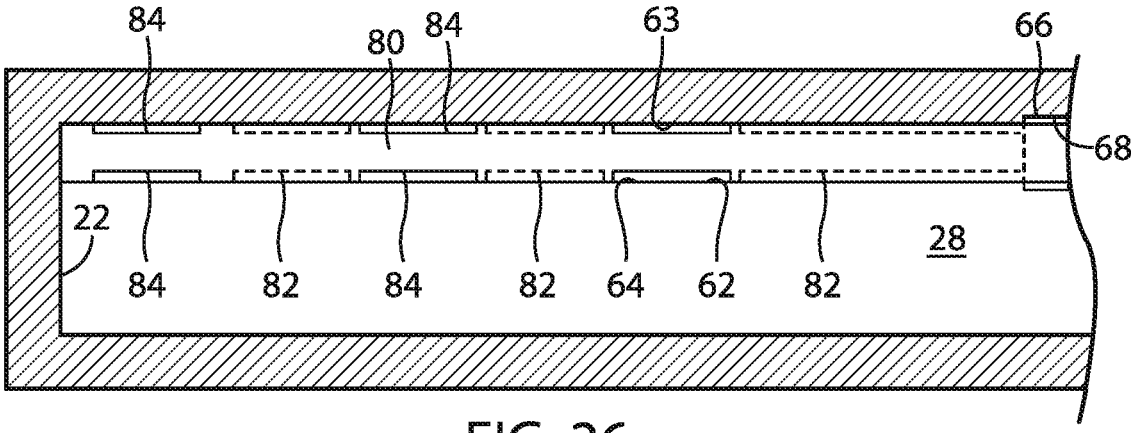
FIG. 26 is a top sectional view of the basin and drain channel of FIG. 24.
Figure 27:
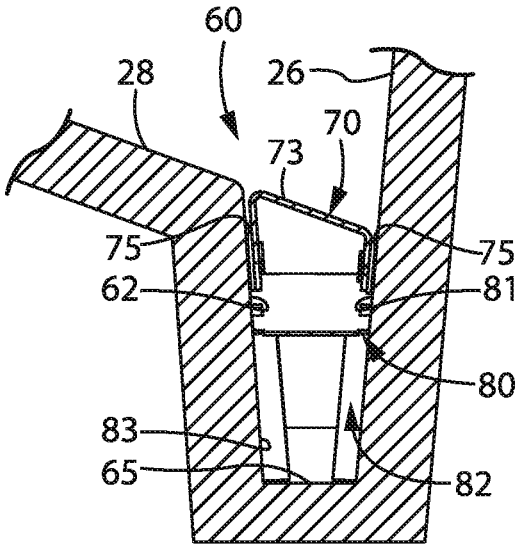
FIG. 27 is a side sectional view of the basin, drain channel, and drain cover of FIG. 24.
Figure 28:
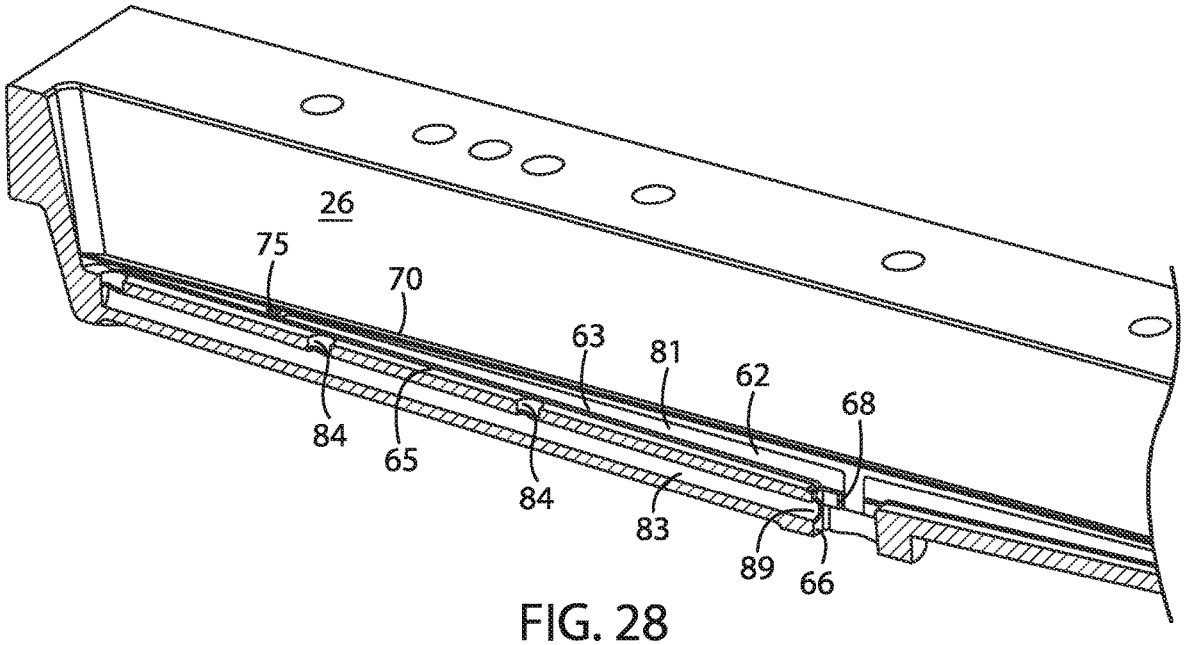
FIG. 28 is an isometric sectional view of a basin, drain channel, and drain cover for the lavatory system according to another embodiment of the drain channel.
Figure 29:
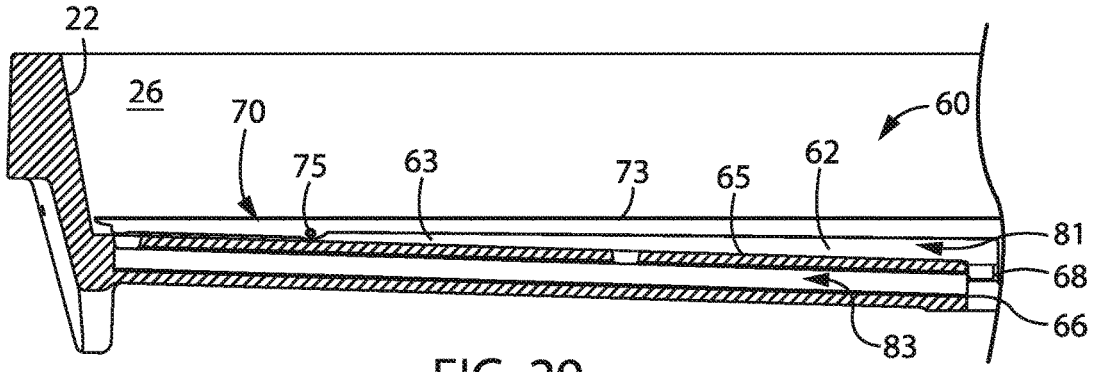
FIG. 29 is a front sectional view of the basin, drain channel, and drain cover of FIG. 28.
Figure 30:
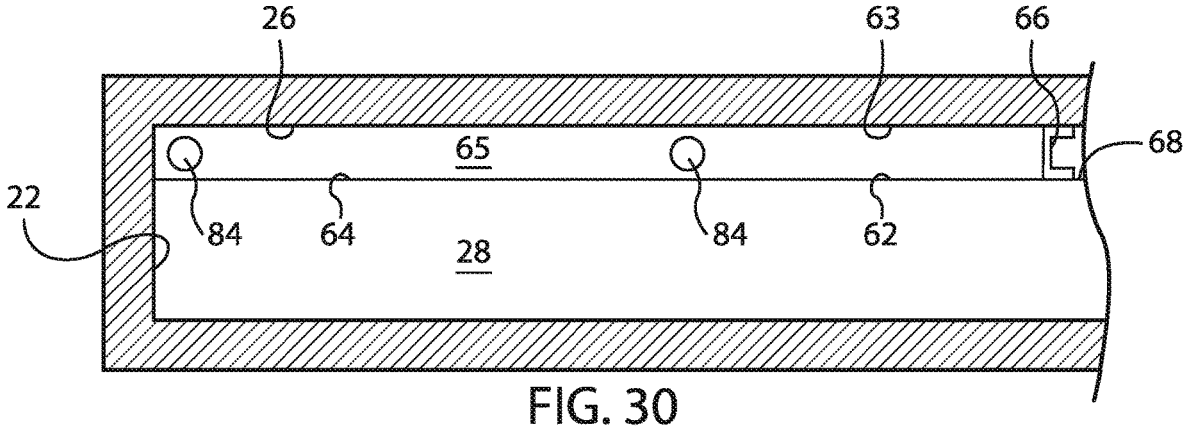
FIG. 30 is a top sectional view of the basin and drain channel of FIG. 28.
Figure 31:
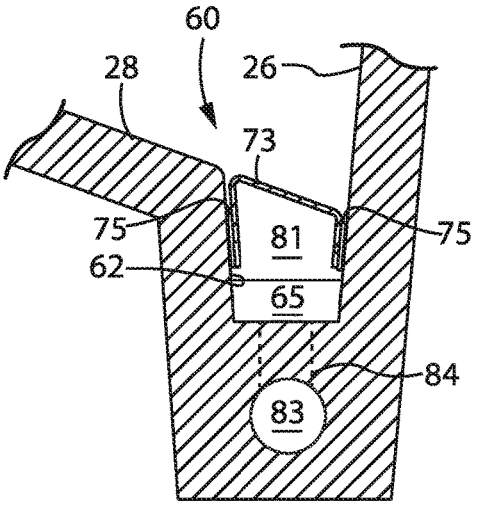
FIG. 31 is a side sectional view of the basin, drain channel, and drain cover of FIG. 28.
Figure 32:
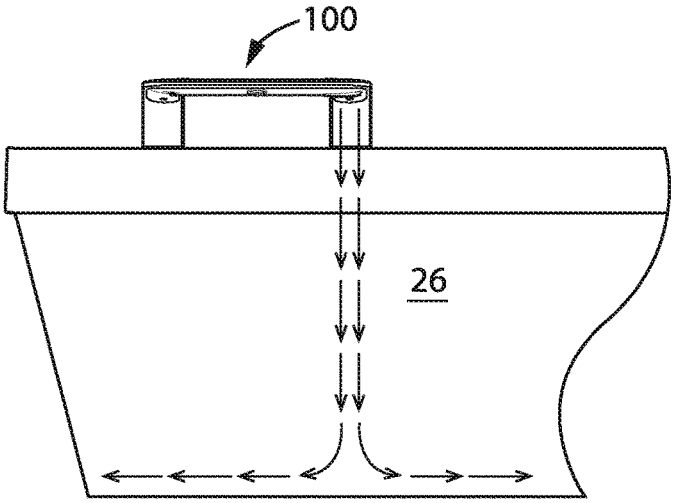
FIG. 32 is a partial flow diagram for air dispensed from the fixture according to one embodiment of the invention.
Figure 33A:
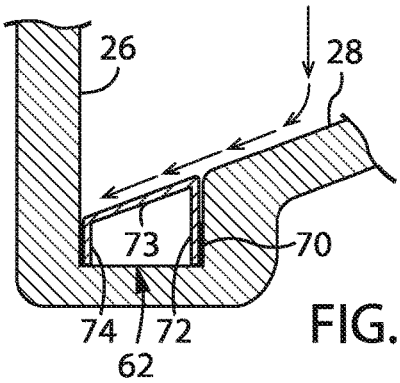
FIG. 33A is a partial flow diagram for air dispensed from the fixture across the drain cover of FIG. 22.
Figure 34A:
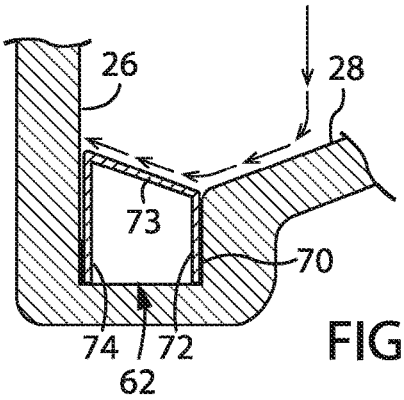
FIG. 34A is a partial flow diagram for air dispensed from the fixture across the drain cover of FIG. 23.
Figure 33B:
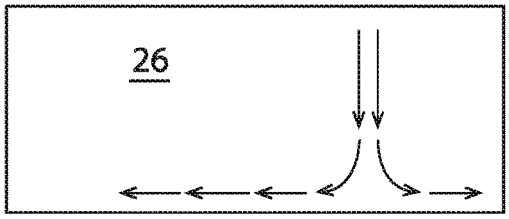
FIG. 33B is a partial flow diagram for air within the basin using the drain cover of FIG. 22.
Figure 34B:
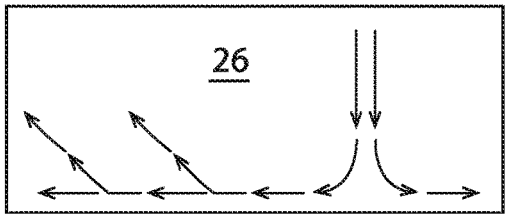
FIG. 34B is a partial flow diagram for air within the basin using the drain cover of FIG. 23.

According to another embodiment of the invention, the drain cap 70 may be configured to guide the direction of the airflow upward along the third side 26 of the basin 20. With reference to FIG. 23, the front surface 72 of the drain cap 70 may be shorter than the rear surface 74. As a result, the top surface 73 is sloped upward from the front wall 64 to the rear wall 63 of the drain channel 62. A first angle, $\alpha$, defined between the rear surface 74 and the top surface 73 of the drain cap 70 is an acute angle. A second angle, $\beta$, defined between the front surface 72 and the top surface 73 of the drain cap 70 is an obtuse angle. According to one embodiment of the invention, the drain cap 70 is configured such that the top surface 73 of the drain cap 70 angles upward at an angle similar to the downward angle of the fourth side 28 of the basin 20. As the air continues to flow from the fourth side 28 of the basin onto the top surface 73 of the drain cap 70 it is deflected upward. As the airflow intersects the third side 26 of the basin 20, the air is further deflected both to the left and the right along the third side 26 of the basin. Thus, rather than traveling along the top surface 73 of the drain cap 70, the air flow travels along the third side 26 in a generally upward and outward manner, as illustrated in FIG. 34(*b*) toward the first and second sides 22, 24 of the basin 20.

Turning next to FIGS. 24-27, another embodiment of a drain system 60 is illustrated. In this embodiment, the depth of the drain channel 62 is increased. The front wall 64 and the rear wall 63 are tapered inward toward the channel 62, such that when the drain cap 70 is inserted into the channel 62, the top surface 73 of the drain cap 70 aligns in the manner discussed above. Optionally, a ridge or series of tabs may be molded along the front and rear walls 64, 63 on which the front and rear surfaces, 72, 74, respectively, of the drain cap may be supported.

A drain plate 80 is inserted into the drain channel 62 to divide the channel 62 into two chambers. An upper chamber 81 is defined between the drain cap 70 and the drain plate 80, and a lower chamber 83 is defined between the drain plate 80 and the lower surface 65 of the channel 62. A series of supports 82 are integrally formed in the rear and front walls 63, 64 of the drain channel 62 to support the drain plate 80. Each support 82 extends from the lower surface 65 of the channel 62 and for a portion of the height of the channel 62. Each support protrudes into the channel 62 from the rear and front walls 63, 64 for a short distance, sufficient to support the drain plate 80 yet allowing water to flow along the channel 62. The width of the drain plate 80 is generally equal to the width of the channel at the top of the supports 82, such that the drain plate 80 may be set into the channel and rest on each of the supports 82.

The drain plate 80 further includes a series of openings 84 spaced longitudinally along the plate 80 to allow water to flow from the upper chamber 81 to the lower chamber 83. According to the illustrated embodiment, each opening 84 is located along on outer edge of the drain plate 80 and extends longitudinally along the drain plate 80. The openings 84 may be spaced at intervals alternately to the supports 82, such that the water may flow from the upper chamber 81 through the openings, between adjacent supports 82, and into the lower chamber 83.

The lower chamber 83 is in fluid communication with the drain opening 66. Thus, when water is dispensed into the basin 20, it runs down the fourth side 28 of the basin to the drain channel. The water flows around each edge of the drain cap 70 and into the upper chamber 81 while other debris is kept out of the drain channel by the drain cap 70. The water then flows along the upper surface of the drain plate 80 toward the drain opening. As the water flows along the upper surface of the drain plate 80, it falls through one of the openings 84 to the lower chamber 83. Once in the lower chamber 83, the water flows toward the drain opening 66 and out of the basin 20 to the drainpipe 90.

Turning next to FIGS. 28-31, another embodiment of the drain system 60 is illustrated. In this embodiment, the drain system 60 again includes two chambers to direct water to the drain opening 66. A first chamber 81 is defined by a drain channel 62 and drain cap 70 substantially the same as that discussed above with respect to FIGS. 18-22. A second chamber 83 is integrally formed within a lower surface of the basin 20. According to the illustrated embodiment, a pipe 89 is integrally molded along the rear portion of and below the basin 20. It is contemplated that the pipe 89 is positioned below the drain channel 62 and overmolded such that it is integrally formed with the basin 20. Optionally, a second housing member may be secured to the bottom of the basin 20 and along the length of the drain channel 62. The second housing member may be configured to hold the pipe 89 below the drain channel 62 as discussed above.

Whether the pipe 89 is integrally molded or separately mounted below the basin 20, a series of openings 84 are formed through the lower surface 65 of the drain channel 62 and into the pipe 89. The openings 84 may be formed, for example, by drilling holes through the lower surface 65 and into the pipe 89. The openings 84 establish fluid communication between the first chamber 81 and the second chamber 83. Thus, when water is dispensed into the basin 20, it runs down the fourth side 28 of the basin to the drain channel. The water flows around each edge of the drain cap 70 and into the first chamber 81 while other debris is kept out of the drain channel by the drain cap 70. The water then flows along the lower surface 65 of the first chamber 81 toward the drain opening 66. As the water flows along the lower surface 65 of the first chamber 81, a portion of the water falls through one of the openings 84 to the second chamber 83. The portion of the water in the second chamber 83 also flows toward the drain opening 66. Whether flowing in the first chamber 81 or the second chamber 83, the water reaches the drain opening 66 and flows out of the basin 20 to the drainpipe 90.

Although the drain channel 62 and drain cap 70 are described in detail with respect to the illustrated embodiments, it is understood that the drain channel 62 and drain cap 70 may take various shapes, where the drain cap 70 remains complementary to the drain channel 62 for insertion and removal, as would be understood to one skilled in the art without deviating from the scope of the invention.

Figure 35:
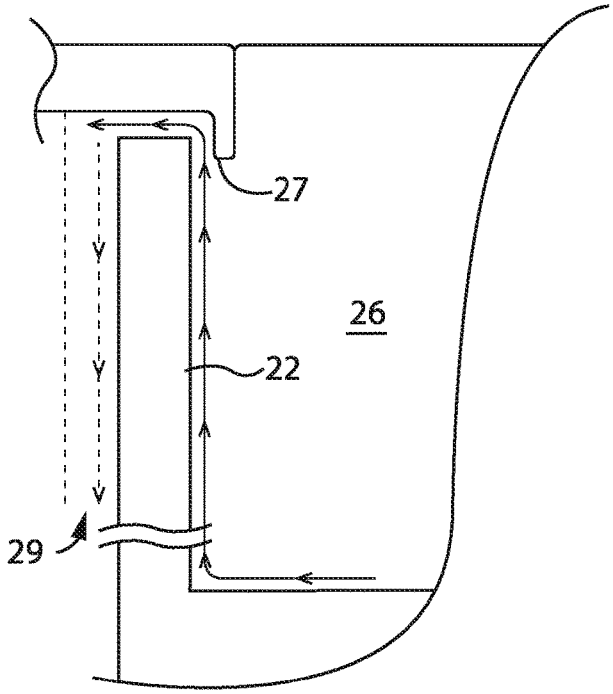
FIG. 35 is a partial flow diagram for air through an air return within the basin according to one embodiment of the invention.
Figure 36:
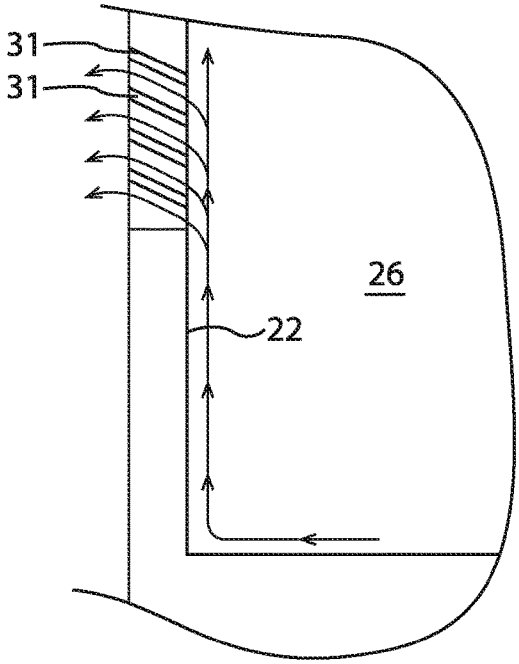
FIG. 36 is a partial flow diagram for air through an air return within the basin according to another embodiment of the invention.
Figure 37:
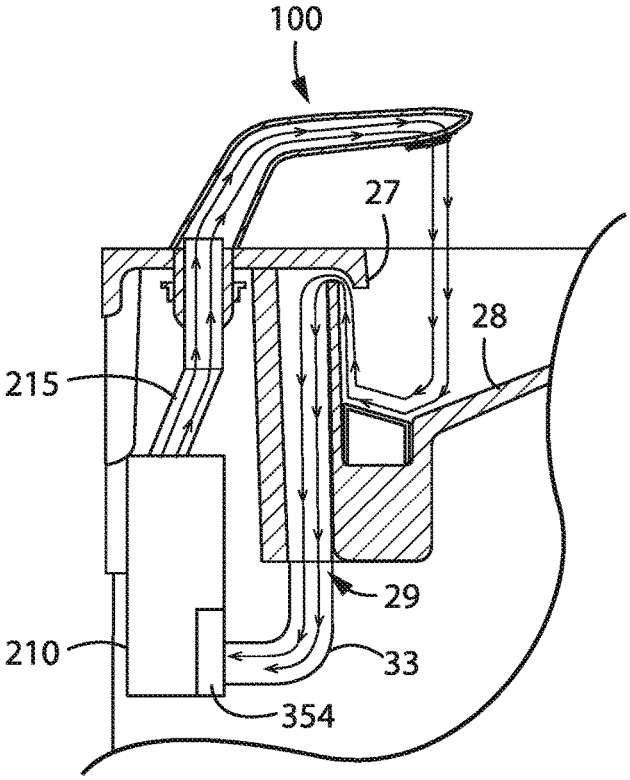
FIG. 37 is a flow diagram illustrating air recirculation from the fixture, within the basin, and back to the fan according to one embodiment of the invention.
Figure 38:
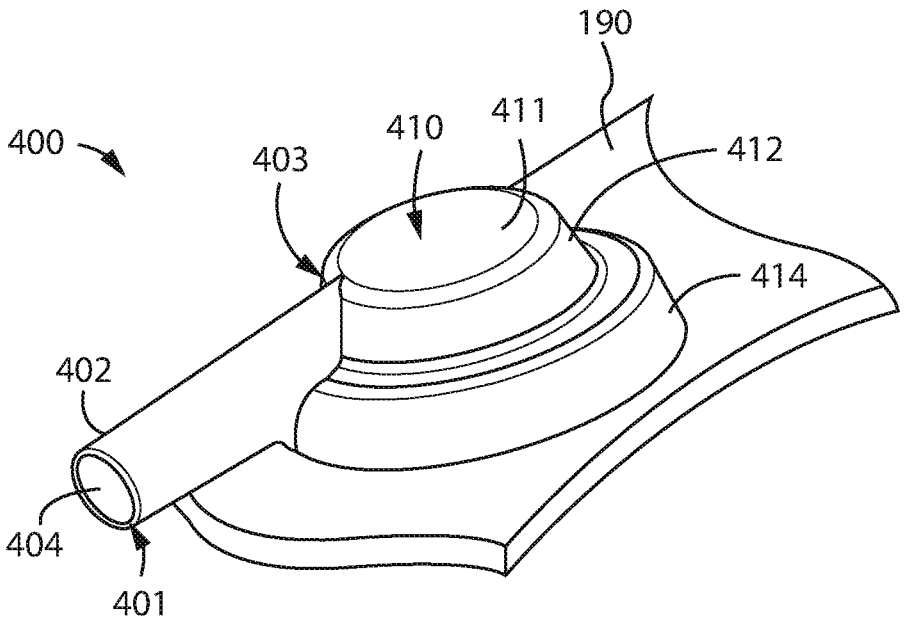
FIG. 38 is an isometric view of one embodiment of an aerator for the fixture used in the lavatory system.
Figure 39:
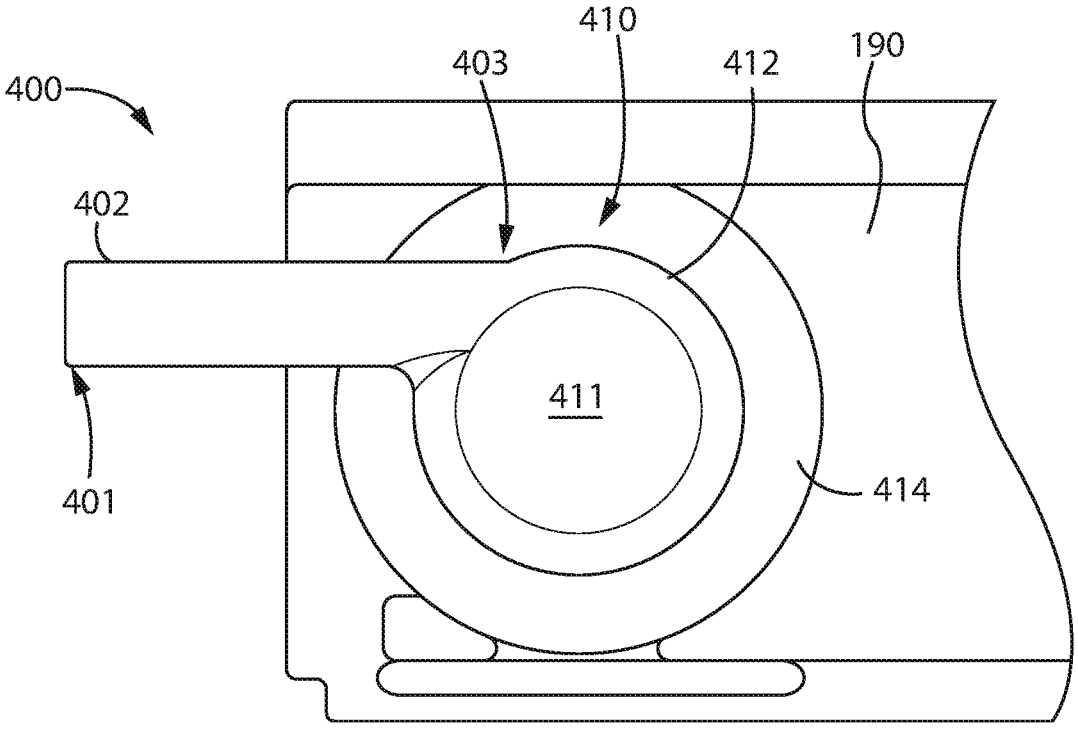
FIG. 39 is a top plan view of the aerator of FIG. 38.
Figure 40:
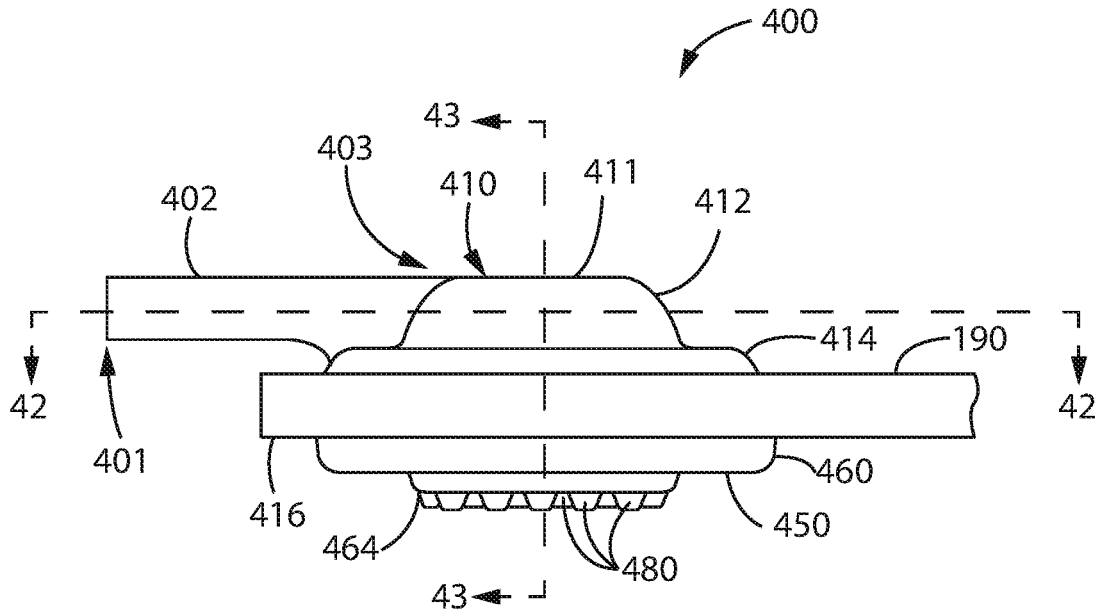
FIG. 40 is a first side elevation view of the aerator of FIG. 38.
Figure 41:
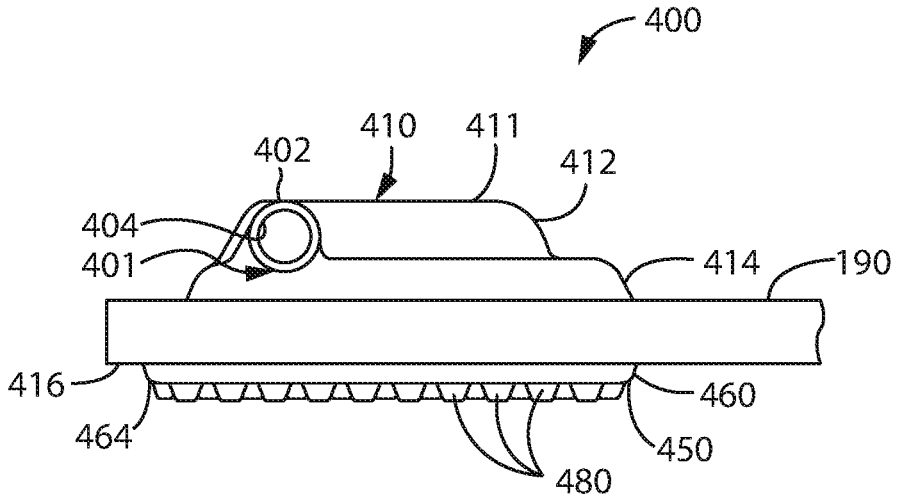
FIG. 41 is a second side elevation view of the aerator of FIG. 38.
Figure 42:
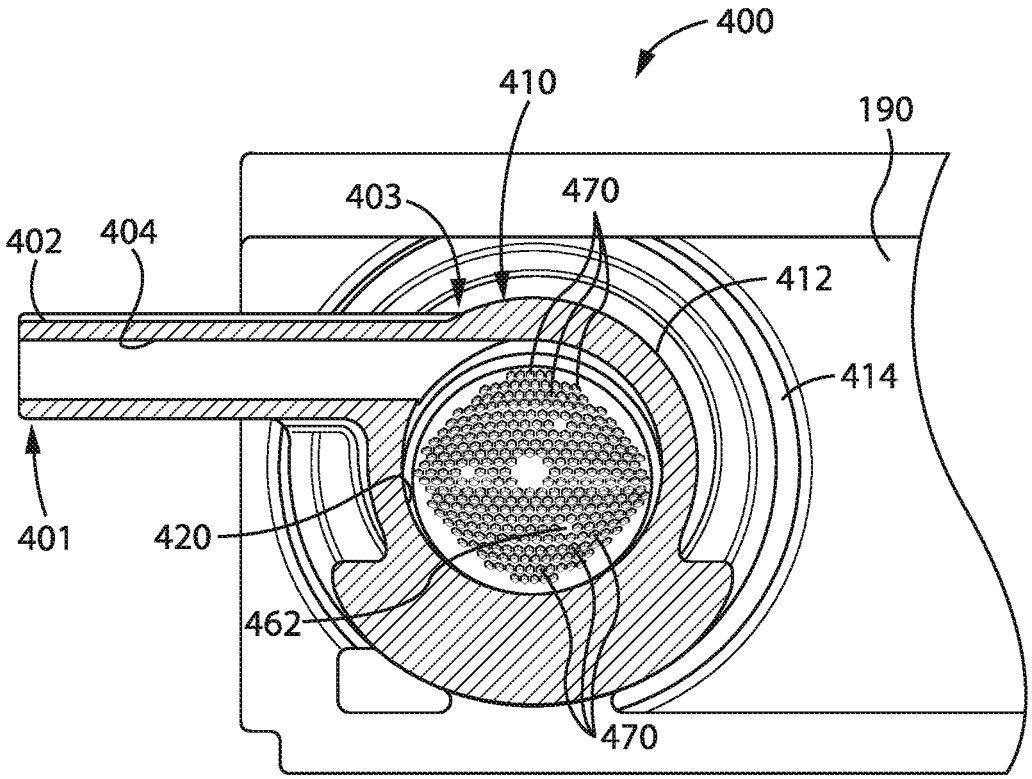
FIG. 42 is a sectional view of the aerator of FIG. 38 taken at 42-42 in FIG. 40.
Figure 43:
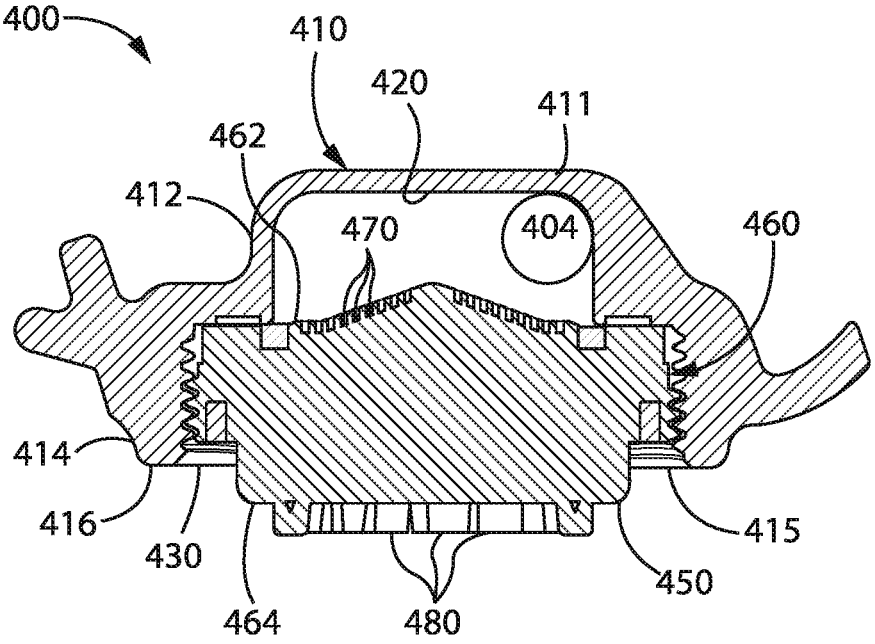
FIG. 43 is a sectional view of the aerator of FIG. 38 taken at 43-43 in FIG. 40.

Turning next to FIGS. 35-37, the basin 20 may further be configured to recirculate at least a portion of the airflow dispensed from the fixture 100. In addition to directing the airflow to the sides or up the rear of the basin 20, the basin 20 may include a ridge 27 protruding over the basin 20 to collect a portion of the airflow. The ridge may extend around the first side 22, the second side 24, or the third side 26 of the basin to capture air travelling up the side or rear of the basin 20. Optionally, a channel 29 may be formed on the rear side of the basin 20 which directs the airflow back down the outside of the basin 20 under the deck 12. The airflow may be channeled to a return duct 33 which in turn provides air to the input of the fan 210. Preferably, a filter 354 is included between the return duct 33 and the input to the fan 210 to remove water, soap, dirt, and other contaminants from the airflow prior to returning the air to the fan 210.

According to another embodiment of the invention, the basin 20 may include an opening in the side. The opening may include a series of louvers 31 to prevent water dispensed from the fixture 100 from entering the opening. The airflow travelling up the sides may enter the opening. Similar to the embodiment including a ridge 27, a channel 29 may be provided on the rear of the basin and the airflow directed back toward the fan 210.

The lavatory system 10 also includes a multi-function fixture 100 located at each hand washing station for the lavatory system 10. According to the illustrated embodiment, the lavatory system 10 includes two wash stations. It is contemplated that the lavatory system 10 may be configured with a single wash station and have just one fixture 100 or, optionally, the lavatory system 10 may be configured with three or more wash stations, where each wash station has a separate fixture 100. The width of the lavatory system will vary according to the number of wash stations present.

Turning next to FIGS. 6-10, a multi-function fixture 100 for the lavatory system 10 according to one embodiment of the present invention is illustrated. The fixture 100 includes a pair of legs 110. When viewed from the front, a first leg 110*a* is positioned to the right side of the fixture 100 and a second leg 110*b* is positioned to the left side of the fixture 100. The exterior of each leg 110*a*, 110*b* is mirrored about a center axis 101 of the fixture 100. For convenience, therefore, a single leg 110 will be discussed in detail, where the discussion will be equally applicable to the right leg 110*a* and the left leg 110*b*.

According to the illustrated embodiment, the leg 110 has a first end 112 configured to be mounted to the deck 12 and a second end 114 extending over the basin 20. A mounting surface 113 on the first end 112 of the leg 110 engages the upper surface 14 of the deck 12. The leg 110 includes a generally rectangular cross-section where the cross-section decreases in size between the first end 112 and the second end 114 of the leg 110. When mounted to the deck 12, the leg 110 slopes forward as it extends upward from the deck 12. From a side-view, the leg 110 is generally r-shaped. The leg 110 extends upwards from the deck 12 and forwards toward the basin 20. After extending for a height, H, a bend 115 in the leg causes the leg to protrude in a generally horizontal plane for a length, L, until the second end 114 of the leg is positioned over the basin 20.

Figure 11:
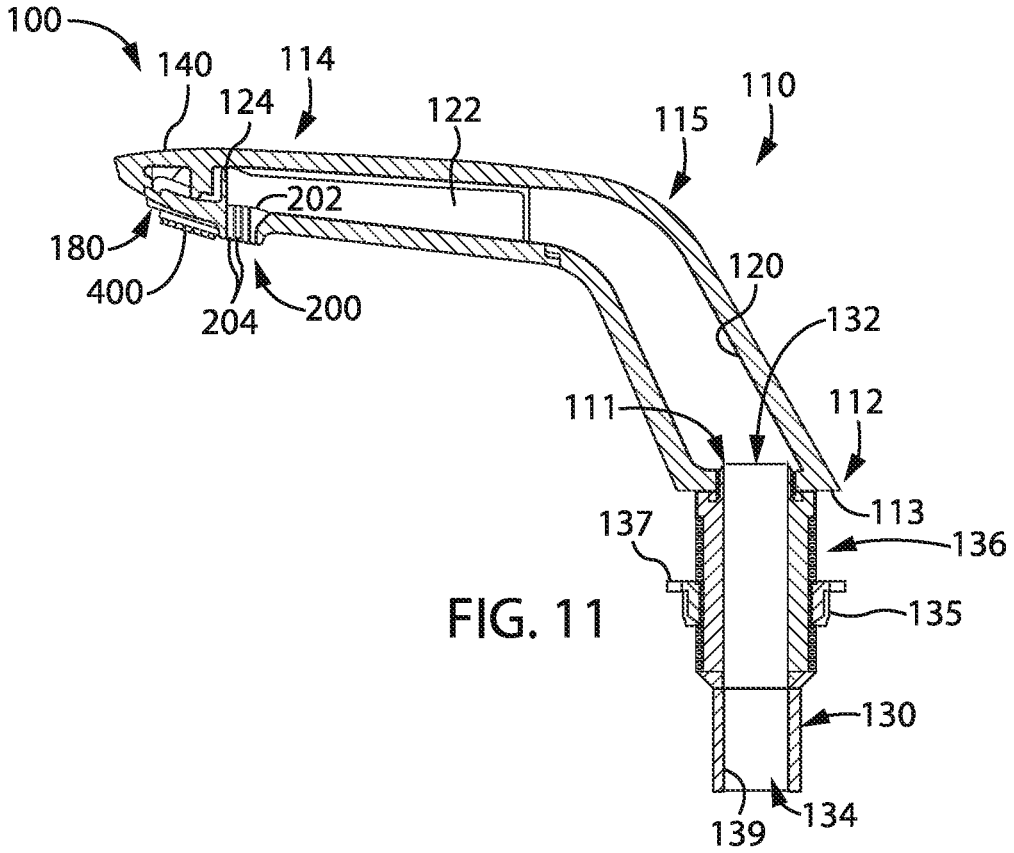
FIG. 11 is a sectional view of the multi-function fixture of FIG. 7 taken at 11-11.
Figure 12:
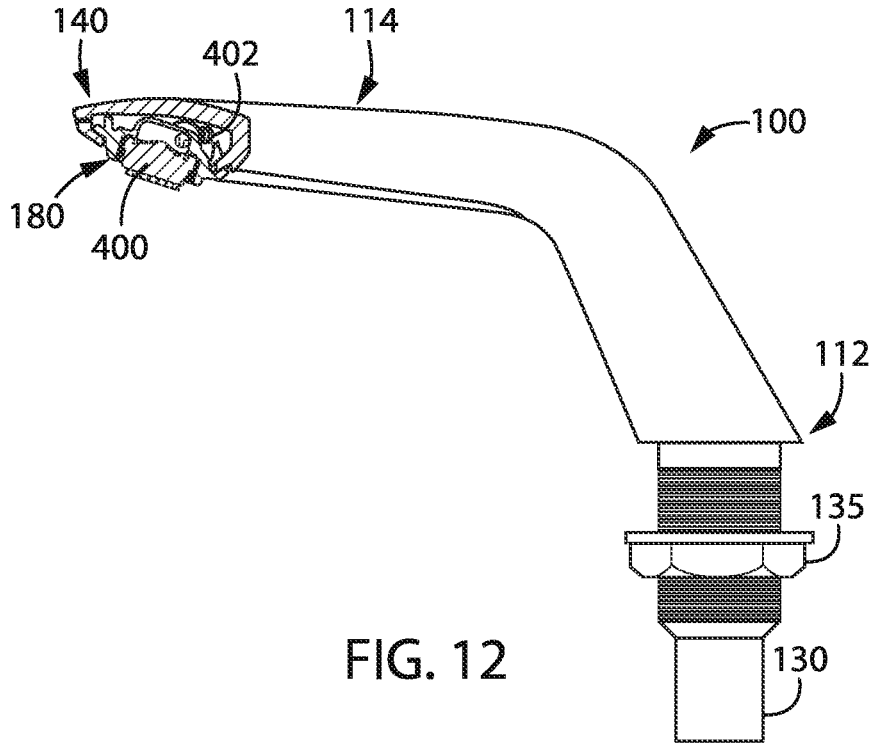
FIG. 12 is a sectional view of the multi-function fixture of FIG. 7 taken at 12-12.
Figure 13:
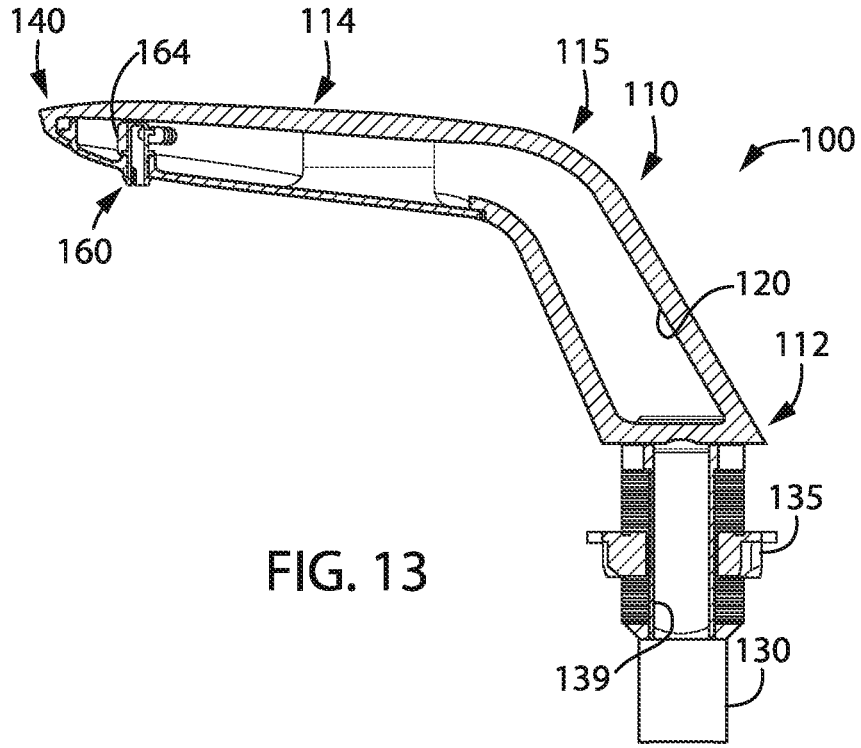
FIG. 13 is a sectional view of the multi-function fixture of FIG. 7 taken at 13-13.

With reference also to FIG. 11, the first end 112 of each leg 110 is configured to be mounted to the deck 12. An opening 111 extends through the mounting surface 113 and is in communication with a passage 120 within the leg 110. A base 130 is received within the opening 111 and secures the fixture 100 to the deck 12. The base 130 also includes a passage 139 extending therethrough which is in fluid communication with the passage 120 in the leg 110. According to the illustrated embodiment, the base 130 includes a first end 132 configured to be inserted into the leg 110 and a second end 134 configured to be inserted into an opening in the deck 12. The opening 111 in the leg 110 includes a threaded inner periphery that is complementary to a threaded outer periphery of the first end 132 of the base 130. The base 130 may, therefore, be rotatably inserted into the opening 111 such that the threads engage and positively retain the base 130 to the leg 110. It is contemplated that the base 130 may alternately be secured to the leg 110, for example, via a snap fit or other suitable securing method. According to another embodiment, the base 130 is integrally molded with the leg 110 such that a portion of the leg 110 extends through the opening to secure the fixture 100 to the deck 12. A second section 136 of the base 130 is displaced longitudinally along the base 130 such that is configured to be located, at least in part, below the deck 12. The second section 136 includes a threaded outer surface to receive a nut 135, and an upper surface 137 of the nut 135 is configured to engage the lower surface of the deck 12. To secure the fixture 100 to the deck 12, the base 130 is affixed to each leg 110 and inserted through the opening in the deck 12. The nut 135 is threaded onto the base from below the deck such that the upper surface 137 of the nut 135 and the mounting surface 113 of the leg 110 engage opposite surfaces of the deck 12 and secure the fixture 100 to the deck 12.

A connecting section 140 extends between the second ends 114 of each leg 110. The connecting section 140 has a first end 142 connected to the second end 114*a* of the first leg 110*a* and a second end 144 connected to the second end 114*b* of the second leg 110*b*. The cross-section of the first end 142 of the connecting section 140 is the same as the cross-section of the second end 114*a* of the first leg 110*a* and the cross-section of the second end 144 of the connecting section 140 is the same as the cross-section of the second end 114*b* of the second leg 110*b*. Consequently, the fixture 100 appears as a continuous unit as it transitions between each leg 110 and the connecting section 140. Further, it is contemplated that at least a portion of the first leg 110*a*, the second leg 110*b*, and the connecting section 140 may be cast, or otherwise manufactured, as a single unit. As a result, despite identifying ends of the legs 110 and ends of the connecting section 140, the locations of the ends are for illustrative purposes and may be moved axially along the leg or along the connecting section 140 without deviating from the scope of the invention.

Figure 15:
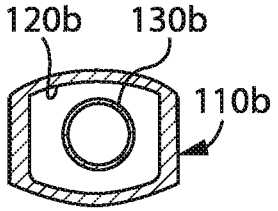
FIG. 15 is a sectional view of one leg of the multi-function fixture of FIG. 7 taken at 15-15.
Figure 16:
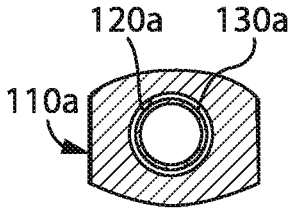
FIG. 16 is a sectional view of one leg of the multi-function fixture of FIG. 7 taken at 16-16.

The connecting section 140 includes multiple outlets for dispensing product over the basin 20 of the lavatory system 10. A first outlet 160 is operable to dispense soap, a second outlet 180 is operable to dispense water, and a third outlet 200 is operable to dispense air. The outlets 160, 180, 200 are spaced apart along the connecting section 140 such that a user's hands move along the connecting section 140 between outlets during the washing process. Each leg 110 includes a passage 120 defined within the interior of the leg for delivery of a product to one of the outlets. The soap and water may be delivered via tubes extending from below the deck 12 up through the passage 120 in one of the legs 110 the respective outlet. The passage 120 within one of the legs 110 is configured as an air duct to, at least in part, convey air from a blower located below the deck 12 to the air outlet. With reference also to FIGS. 15 and 16, exemplary sectional views of the passage 120 in each leg are illustrated. The passage 120*b* in the second leg 110*b* has a maximum sectional area to provide room for the tube 162 carrying soap and the tube 182 carrying water to be run through the passage 120*b*. The passage 120*a* in the first leg 110*a* has a sectional area closely corresponding to the passage 139 in the base 130*a*. By having the sectional areas of the passage 120*a* in the leg 110*a* and the passage 139 in the base 130*a* correspond to each other, the turbulence of the air flow is reduced as the air passes from the base 130*a* into the leg 110*a*. The passage 120*a* of the leg 110 then forms a duct through which the air is conveyed to the air outlet 200.

The connecting section 140 may also include indicators to a user identifying the location of each outlet. According to the illustrated embodiment, openings 103 are located along the front edge of the connecting section 140 through which an indicator may be displayed. A multi-color light-emitting diode (LED) 305, or red-green-blue LED array, (see also FIG. 17) is located behind each opening 103. It is contemplated that each opening may have a lens or be a translucent material rather than an opening to prevent soap, water, dirt, or other contaminants from entering the fixture 100. The LED 305 may emit different colors according to operation or flash to direct a user's attention to the location. Optionally, larger displays utilizing, for example, a liquid crystal display (LCD) may provide a graphical or other visual indication to the user of the purpose of each outlet located by the indicator.

The system for dispensing soap includes a soap reservoir, pump, and tubing to connect the pump to the soap outlet 160. The soap reservoir 310 and soap pump 316 are represented in block diagram form in FIG. 17. The soap reservoir 310 may include a level detection switch 312, such as a float switch, which generates a level detection signal 314, provided to a control circuit 302, corresponding to the amount of soap remaining in the reservoir 310. The pump 316 is activated by one or more sensors 301 located in the fixture 100 detecting the presence of a user's hands by the soap outlet 160. The pump 316 draws soap from the reservoir 310 and into a tube 162 connected between the pump 316 and the soap outlet 160. The tube is run inside the passage 120 in either the first leg 110*a* or the second leg 110*b* and into the connecting section 140 of the fixture. In the connecting section 140, the tube 162 is fit onto a nozzle 164 which extends through the outlet 160. The soap is discharged from the nozzle 164 through the outlet 160 onto a user's hands.

The system for dispensing water includes one or more inlet lines 322, connected to a water supply, one or more valves 320, and one or more outlet lines 324 to supply water to the water outlet 180. The inlet line 322 may be connected to a cold water supply, a hot water supply, or to a mixed water supply, where the mixed water supply includes a combination of hot and cold water. It is desirable to provide water at a comfortable temperature to the user. Therefore, a mixing valve may be provided in advance of the inlet line 322 that combines cold and hot water proportionally to supply water at a desired temperature. Optionally, the valve 320 may be a mixing valve which includes a first inlet line 322 from the cold water supply and a second inlet line 322 from a hot water supply. A signal 326 from the control circuit 302 may control the valve 320 not only in an on/off manner, but also in a proportional manner to mix the cold and hot water to supply water at a desired temperature. The outlet line 324 from the valve 320 is connected via a second tube 182 to the water outlet 180. An aerator 400 may be provided within the water outlet 180 includes a water inlet 402 to which the outlet line 324 from the valve 320 is connected.

Referring next to FIGS. 38-43, one embodiment of the aerator 400 is illustrated. The aerator 400 includes an upper housing 410 and a lower housing 450. According to the illustrated embodiment, the upper housing 410 is integrally formed with a removable plate 190 that may be inserted into and removed from an opening on the lower surface of the connecting section 140 of the fixture. The upper housing 410 includes two generally cylindrical chambers. A first, intake chamber 420 is formed in the upper portion of the upper housing 410. A first wall segment 412 of the upper housing 410 extends downward from an upper surface 411 of the upper housing 410. The first wall segment 412 may join the upper surface 411 at a generally curved edge that extends around the periphery of the upper housing 410. The intake chamber 420 has a first diameter defined by the inner periphery of the first wall segment 412. A second, outlet chamber 430 is formed in the lower portion of the upper housing 410. A second wall segment 414 extends downward from the first wall segment 412 to a lower edge 416 of the upper housing 410. The second wall segment 414 has a diameter greater than the diameter of the first wall segment 412, and a generally curved edge joins the first and second wall segments 412, 414. The lower surface of the upper housing 410 is generally open and the lower edge 416 defines a generally circular opening into which the lower housing 450 may be inserted. The inner surface 415 of the second wall segment 414 is threaded and is configured to receive a complementary thread on the outer periphery 460 of the lower housing 450. According to other embodiments of the invention, it is contemplated that the lower housing 450 may be secured to the upper housing 410 by other methods, including, for example, by a snap fit, cam lock, pin, screw, or other suitable retainer.

The water inlet 402 extends outward from the first wall segment 412 and defines a fluid communication path between the second tube 182, through which the water flows, and the intake chamber 420. The water inlet 402 is generally cylindrical and includes a passage 404 extending axially through the inlet 402. The second tube 182 may be press fit onto a first end 401 of the water inlet 402 and the second end 403 of the water inlet 402 is integrally formed with the first wall segment 412. Preferably, the second end 403 of the water inlet 402 joins one side of the upper housing 410. Water flowing through the second tube 182 enters the passage 404 and exits along the inner periphery of the first wall segment 412. The water is supplied at a sufficient pressure such that the water follows the inner periphery of the first wall segment 412 swirling around the interior of the intake chamber 420.

The lower housing 450 is a generally cylindrical disk configured to be inserted into the upper housing 410. As previously indicated, the outer periphery 460 of the lower housing 450 is threaded such that the lower housing 450 may rotatably engage the complementary threaded inner surface 415 of the upper housing 410. The disk includes an upper surface 462 and a lower surface 464, opposite the upper surface. A plurality of passages 470 extend between the upper surface 462 and the lower surface 464. The upper surface 462 is sloped upward from an outer edge to the center of the upper surface 462, forming a generally conical surface. Multiple nozzles 480 protrude downward from the lower surface 464. One of the passages 470 extends through each nozzle 480, and the nozzles 480 define the water outlet 180 for the fixture 100. Because the water enters the intake chamber 420 along the inner periphery and swirls around the chamber, the water more uniformly fills the chamber than if the water entered the chamber at a central location and hit the opposing surface of the chamber. The water then exits the intake chamber 420 through each of the nozzles 480 with a generally uniform pressure and flow.

Although the aerator 400 has been described according to the illustrated embodiment, it is contemplated that the aerator 400 may be formed utilizing other members without deviating from the scope of the invention. For example, the aerator 400 may be formed as a single housing with the upper housing 410 and lower housings 450 integrally formed and either fixedly or removably mounted within the connecting section 140 of the fixture 100.

The system for dispensing air includes a fan 210 located below the deck 12 operable to deliver air to the air outlet 200. According to one embodiment of the invention, the fan 210 includes a centrifugal fan driven by a motor. The motor may be operated at variable speeds to adjust the airflow rate supplied by the fan. The fan 210 draws air in through an air inlet located within the housing 40 under the deck 12. A filter 354 may be provided at the inlet to capture contaminants present in the air prior to air entering the air inlet for the fan 210. With reference also to FIG. 5, an air duct 215 connects an outlet of the fan 210 to the passage 139 in the base 130, which is, in turn, connected to a passage 120 within the leg 110 of the fixture 100.

Figure 10:
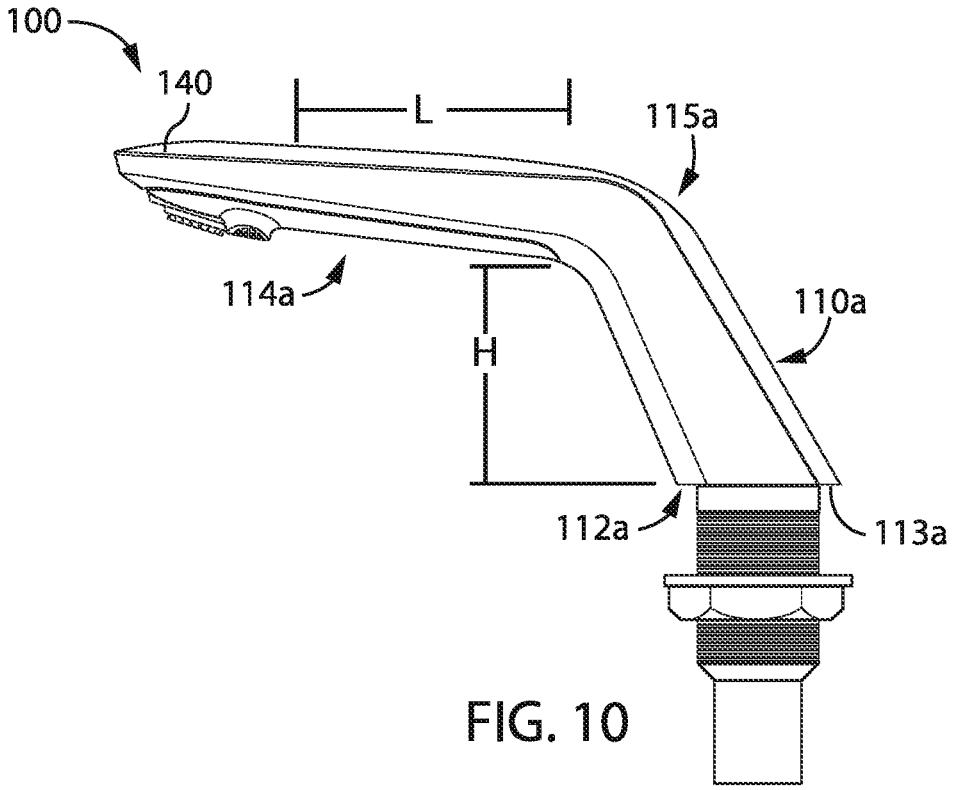
FIG. 10 is a left side elevation view of the multi-function fixture of FIG. 6.
Figure 14:
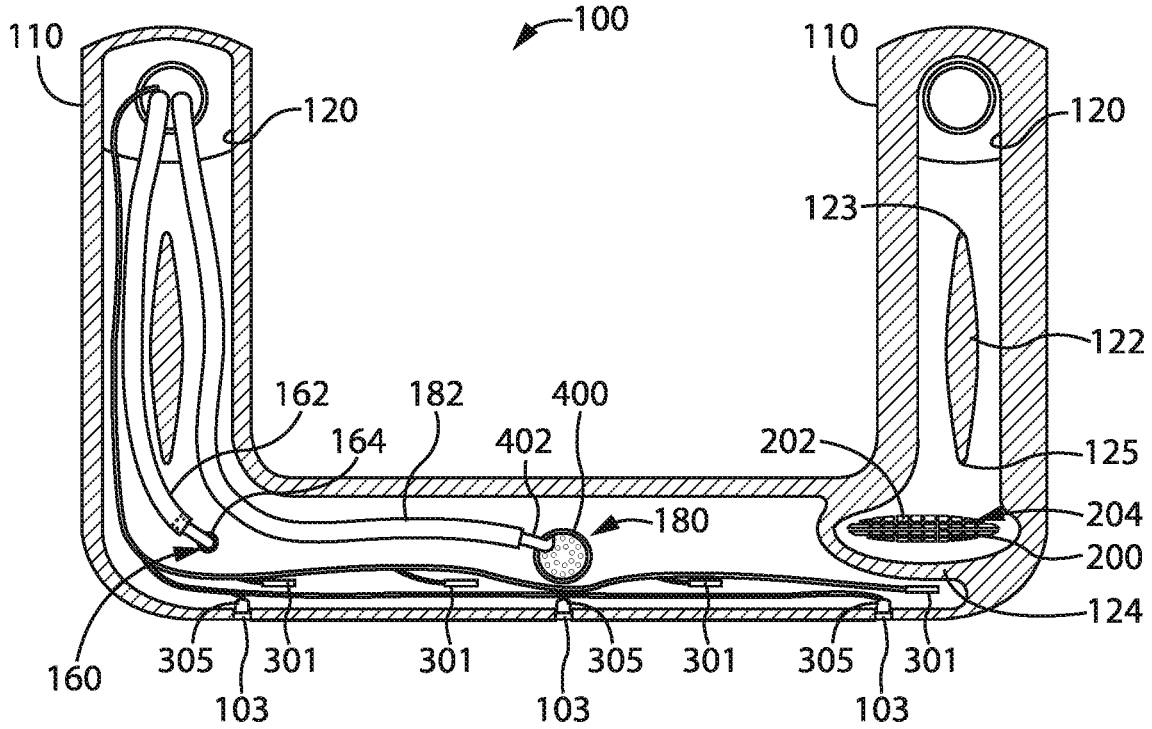
FIG. 14 is a partial top view of the multi-function fixture of FIG. 6 with the upper surface removed.

Referring to FIGS. 10, 14, and 16 the passage 120 serves as a continuation of the air duct 215 between the fan 210 and the air outlet 200. The surface of the passage 120 is preferably smooth to minimize turbulence of the air flow through the passage. A boss 122 may be provided between opposing surfaces of the passage 120 to provide improved rigidity of the fixture 100. The boss 122 includes a front end 123, indicating it receives the air flow first, and a rear end 125, indicating it receives the air flow last. The boss 122 widens toward the middle and tapers toward each end, such that each of the front and rear ends 123 and 125 are preferably narrow and rounded to minimize disturbance of the air flow through the passage 120.

An inner wall 124 is provided beyond the air outlet 200 to terminate the passage 120 and separate the air passage from other interior regions of the fixture 100. The inner wall 124 is generally orthogonal to and intersects the air flow through the passage, causing the air flow to equalize over the surface of the inner wall 124 by pressure shock when the air flow hits the inner wall 124. The air outlet 200 is located on a lower surface of the fixture 100 prior to the inner wall 124 with respect to the direction of air flow. The air outlet 200 includes a nozzle 202 with a grid 204 defined in the nozzle. Each member of the grid 204 is in a generally vertical plane to direct the airflow downward from the nozzle 202. The air flow is, therefore, directed generally ninety degrees downward and out the air outlet 200 after hitting the inner wall 124. The duct 215 from the fan and the passages 139, 120 within the base 130 and leg 110, therefore, deliver air to the air outlet 200 to dry a user's hands.

Control signals 352 pass between the fan 210 and a control circuit 302. The control signals 352 may include, for example, a start command, a stop command, a speed command, or a combination thereof to control operation of the fan 210. Feedback signals may also be provided from the fan 210 to a control circuit 302 corresponding to operation of the fan or of the condition of the filter. Although not shown, it is contemplated that the system for dispensing air may include a heater located along the air flow path to increase the temperature of the air prior to delivering the air to the user's hands.

Figure 17:
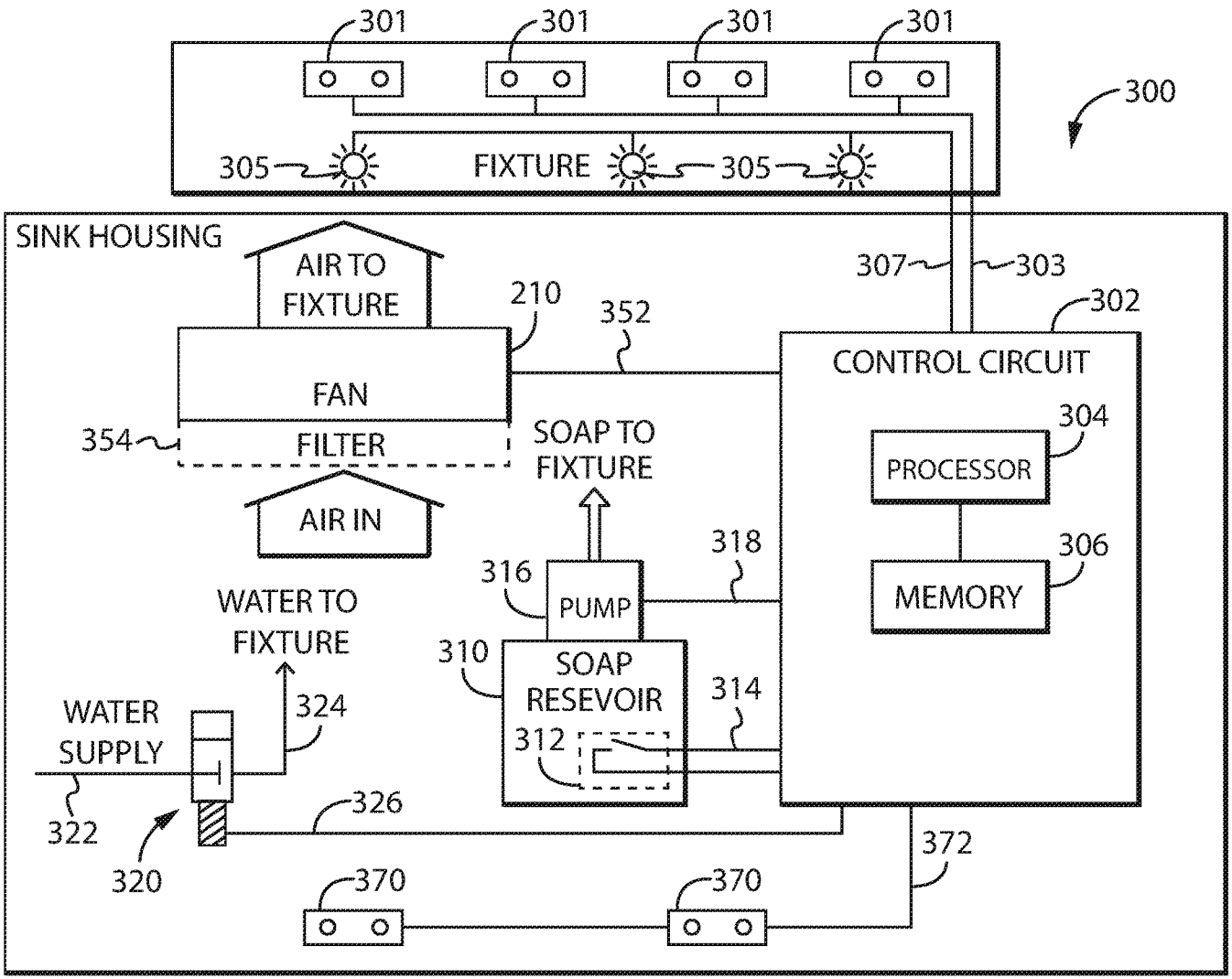
FIG. 17 is a block diagram representation of the control system for the lavatory system of FIG. 1.
Figure 18:
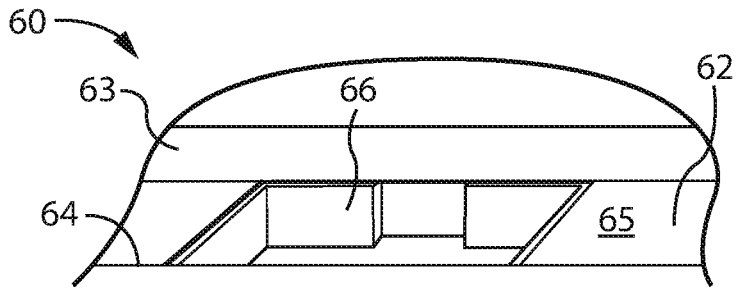
FIG. 18 is a partial isometric view of a drain for the lavatory system of FIG. 1.
Figure 19:
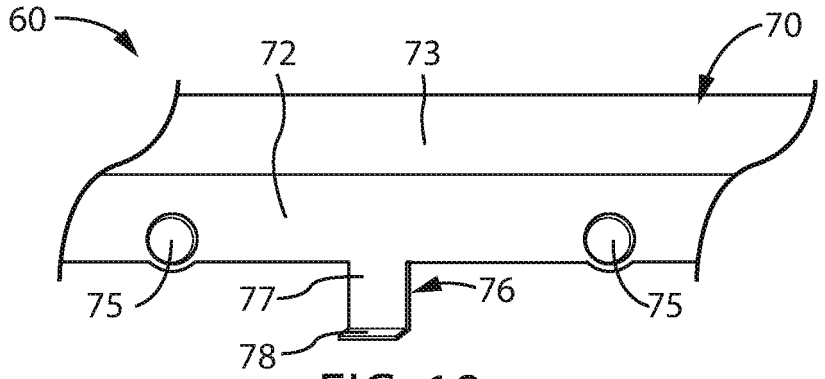
FIG. 19 is a partial isometric view of one embodiment of a drain cover for the lavatory system of FIG. 1.
Figure 20:
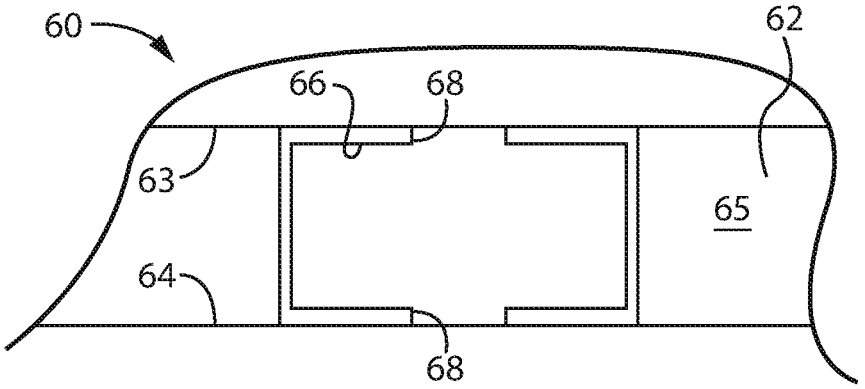
FIG. 20 is a top plan view of a drain for the lavatory system of FIG. 1.
Figure 21:
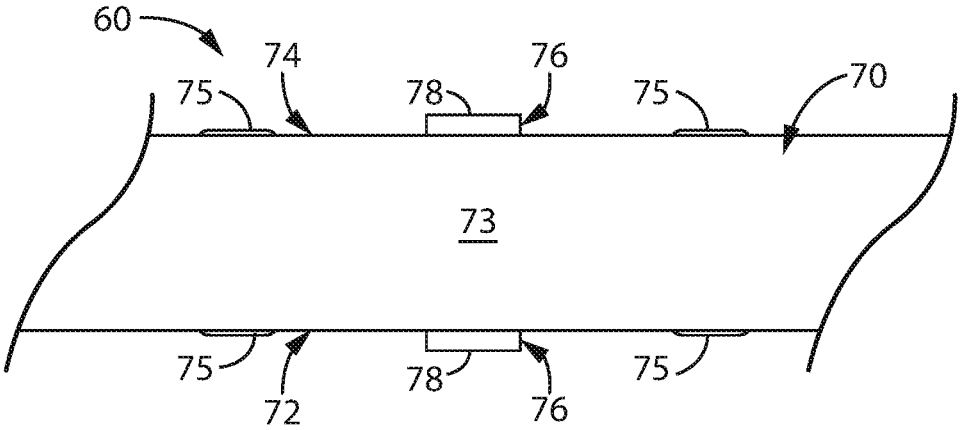
FIG. 21 is a top plan view of the drain cover of FIG. 19.

In operation, a control system 300 is provided that manages operation of the lavatory system 10. Referring next to FIG. 17, the control system 300 includes a control circuit 302 mounted to the lavatory system 10. According to one embodiment of the invention, the control circuit 302 is provided on a circuit board mounted in an enclosure below the deck 12 and within the housing 40 of the lavatory system 10 to protect the control circuit from being splashed by water. Optionally, the control circuit 302 may be potted to provide further protection from moisture in a lavatory. The control circuit 302 includes memory 306 configured to store operating parameters for the lavatory system 10 and instructions for executing on a processor 304 to control operation of the lavatory system 10. It is contemplated that the memory 306 may be volatile, non-volatile, or a combination thereof and may be a single or multiple devices. The processor 304 is operable to execute the instructions stored in memory 306 to achieve a desired operation of the lavatory system 10. It is contemplated that the processor 304 may be a single device or multiple devices. The control circuit 302 further includes other analog and/or digital devices to receive feedback signals from sensors, transmit control signals to actuators, and manage other such control related functions as would be understood in the art. It is further contemplated that the control circuit 302 may be located entirely on a single circuit board and located within a single enclosure or, optionally, portions of the control circuit 302 may be distributed about the lavatory system 10 without deviating from the scope of the invention.

The control circuit 302 receives feedback signals 303 from sensors 301 in the fixture 100 indicating a user's hands are present for washing and/or drying proximate the fixture 100. According to the illustrated embodiment, four sensors 301 are provided in the fixture 100 to control the soap, water, and air delivery from the fixture 100. According to another embodiment, it is contemplated that three sensors 301 may be provided where a single sensor 301 is located proximate to each outlet. According to still another embodiment more than four sensors 301 may be provided. It is contemplated that each sensor 301 is located within the connecting section 140 of the fixture and above the lower wall of the connecting section 140. A portion of the lower wall may include an opening 103 through which the sensor may transmit a signal, such as a radio frequency (RF) or an infrared signal. The signal is reflected off the user's hands and received at the sensor 301 to detect the presence of the user's hands. If a line-of-sight sensor is used it is contemplated that a portion of the lower housing may be made of a translucent material as an alternative to providing an opening, allowing the emitted sensor signal to pass through. Optionally, a lens may be inserted in the opening 103 to allow the emitted signal to pass and to prevent water, soap, dirt, or other contaminants from entering the opening. According to another embodiment, the sensor 301 may emit a signal capable of passing through the housing of the connecting section 140. For example, a magnetic field may be generated and a disturbance in the field due to the presence of a user's hands may be detected. Still other sensing technology, such as capacitive sensing of a user's hands may be utilized without deviating from the scope of the invention.

Including more sensors 301 than outlets allows the control circuit 302 to determine information about the location and/or direction of approach for a user's hands in addition to just being located proximate to an outlet. According to the illustrated embodiment, the two inner sensors 301 may be located on either side of the water outlet 180. As a user's hands approach the water outlet 180 after receiving soap, one of the inner sensor 301 located on the same side of the water outlet 180 as the soap outlet 160 is activated first. If a user's hands are approaching the water outlet 180 from the hand dryer side of the fixture 100 the other inner sensor 301 is activated first. When the user's hands area located under the water outlet 180, both of the inner sensors 301 are arranged to detect the hands. The control circuit may generate different control signals responsive to the sequence in which the inner sensors are activated.

Looking first at the control of the soap system, at least one sensor 301 is located near the soap outlet 160 to detect a user's hands located below the outlet 160. When a user's hands are located beneath the soap outlet 160, the sensor 301 generates a feedback signal 303 to the control circuit indicating their presence. In response to receiving the feedback signal 303, the control circuit 302 may flash or change the color of the LED 305 for the soap outlet 160 to provide an indication to the user that the hands were detected by the soap outlet 160. The control circuit 302 may also generate a control signal 318 to the soap pump 316, causing it to activate such that soap is dispensed. The soap pump 316 may be energized for a predefined period of time or execute one or more fixed pumping cycles, drawing soap from the reservoir 310 and up through the soap tube 162 to the soap nozzle 164 where it is dispensed onto the user's hands. It is further contemplated that the sensor 301 proximate the soap outlet 160 may be configured to detect a user's hands for only a short distance below the fixture 100. For example, the user's hand may need to be within three inches or within two inches of the sensor 301 to detect their presence. This detection distance is preferably configurable within the sensor 301 and may be set less than the detection distance of the water outlet as will be discussed in more detail below.

The controller 302 may further be configured to interlock the soap dispenser based on other activity at the fixture 100. For example, if the air dryer is active, it may be desirable to prevent soap from being dispensed such that it is not blown around the basin. Further, it may be desirable to require a user to remove their hands prior to dispensing additional soap. This prevents continued dispensing of soap if the user leaves their hands under the soap outlet 160 for an extended period of time or if, for example, a foreign object falls in the basin 20 under the fixture 100 proximate the soap outlet 160.

A level detection sensor 312, such as a float switch, may be provided within the reservoir. The level detection sensor 312 generates a feedback signal 314 to the control signal when the soap level is low and requires refilling. The control circuit 302 may activate the LED 305 proximate the soap outlet 160 in a manner indicating the soap level is low. For example, the control circuit 302 may flash the LED 305 or turn the color of the LED to red indicating that the level is low.

Turning next to control of the water system, at least one sensor 301 is located near the water outlet 180 to detect a user's hands located below the outlet 180. When a user's hands are located beneath the water outlet 180, the sensor 301 generates a feedback signal 303 to the control circuit indicating their presence. In response to receiving the feedback signal 303, the control circuit 302 may flash or change the color of the LED 305 for the water outlet 180 to provide an indication to the user that the hands were detected by the water outlet 180. The control circuit 302 may also generate a control signal 326 to the water valve 320, causing it to activate such that water is dispensed. The water valve 320 may be energized for a predefined time or may remain on while the user's hands are detected under the water outlet 180.

It is further contemplated that the sensor 301 proximate the water outlet 180 may be configured to detect a user's hands below the fixture 100 for a distance equal to the height of the fixture 100 above the basin 20. As a result, the user's hands will be detected at any height between the water outlet 180 and the basin 20. This detection distance is preferably configurable within the sensor 301 and may be set greater than the detection distance of the soap outlet. Requiring the user to position their hands closer to the soap outlet to receive soap than is required to dispense water will help prevent inadvertent dispensing of soap. For example, as a user rinses the soap from their hands under the water outlet 180, the hand, arm, or a portion thereof may move under the soap outlet 160. However, a user typically positions their hands at a distance below the water outlet 180 to avoid water splashing or spraying from their hands or from making contact with the fixture 100 while rinsing the hands. The distance users typically position their hands is greater than the distance at which the sensor 301 proximate the soap outlet is set for detection. As a result, even if a portion of the user's hands or arm moves under the sensor 301 for the soap while using the water outlet 180, additional soap is not dispensed.

The control circuit 302 may further be configured to provide interlocks in dispensing water from the fixture 100. For example, if the air dryer is active, it may be desirable to prevent water from being dispensed such that it is not blown around the basin. Further, it may be desirable to require a user to remove their hands from beneath the water outlet 180 and stop dispensing water to dispensing air. A maximum duration may also be configured for which the water outlet 180 may dispense water without requiring the user to remove and reinsert their hands beneath the water outlet 180. This prevents continued dispensing of water if the user leaves their hands under the water outlet 180 for an extended period of time or if, for example, a foreign object falls in the basin 20 under the fixture 100 proximate the water outlet 180.

Turning then to control of the air system, at least one sensor 301 is located near the air outlet 200 to detect a user's hands located below the outlet 200. When a user's hands are located beneath the air outlet 200, the sensor 301 generates a feedback signal 303 to the control circuit indicating their presence. In response to receiving the feedback signal 303, the control circuit 302 may flash or change the color of the LED 305 for the air outlet 200 to provide an indication to the user that the hands were detected by the air outlet 200. The control circuit 302 may also generate a control signal 352 to the fan 210, causing it to activate such that air is dispensed. The fan 210 may be energized for a predefined time or may remain on while the user's hands are detected under the air outlet 200.

The sensor 301 proximate the air outlet 200 may be configured to detect a user's hands below the fixture 100 for a distance equal to the height of the fixture 100 above the basin 20. As a result, the user's hands will be detected at any height between the air outlet 200 and the basin 20. This detection distance is preferably configurable within the sensor 301 and may be set greater than the detection distance of the soap outlet. The motor for the fan 210 may be configured to operate at multiple speeds. It is contemplated that one speed will be selected when the lavatory system is configured, or reconfigured, and that the motor will run at that speed each time the sensor 301 detects a user's hands beneath the air outlet 200. According to one aspect of the invention, the motor speed may be selected such that a user's hands are dried within a desired time duration. The selected speed may vary, for example, as a function of the size of the fixture 100, the volume of air delivered by the fixture, or whether a heater is present within the air flow. According to another aspect of the invention, the motor speed may be selected such that the motor and air flow generate noise at an acceptable level while the user's hands are located within the air stream.

The control circuit 302 may further be configured to provide interlocks in dispensing air from the fixture 100. For example, if the air dryer is active, it may be desirable to prevent water from being dispensed such that it is not blown around the basin. Further, it may be desirable to require a user to remove their hands from beneath the air outlet 200 and stop dispensing air prior to dispensing water. A maximum duration may also be configured for which the air outlet 200 may dispense air without requiring the user to remove and reinsert their hands beneath the air outlet 200. This prevents continued dispensing of air if the user leaves their hands under the air outlet 200 for an extended period of time or if, for example, a foreign object falls in the basin 20 under the fixture 100 proximate the air outlet 200.

According to another aspect of the invention, the lavatory system 10 may include one or more approach sensors 370. Each approach sensor 370 may be mounted on an inside surface of the housing 40 and in line with one of the fixtures 100. The housing 40 may include an opening 371 through which the sensor may transmit a signal, such as a radio frequency (RF) or an infrared signal. The signal is reflected off the user as the user approaches the lavatory system 10 and received at the sensor 370 to detect the user's approach. If a line-of-sight sensor is used, it is contemplated that a portion of the housing 40 may be made of a translucent material, allowing the emitted sensor signal to pass through. Optionally, a lens may be inserted in the opening 371 to allow the emitted signal to pass and to prevent water, soap, dirt, or other contaminants from entering the opening. According to another embodiment, the sensor 370 may emit a signal capable of passing through the housing 40. For example, a magnetic field may be generated and a disturbance in the field due to the presence of a user may be detected.

Each approach sensor 370 generates a feedback signal 372 to the control circuit 302. The control circuit 302 may use the approach signal 372, for example, to bring the lavatory system 10 out of a power-saving state or may prepare the lavatory system 10 for use. In the power saving state, a portion of the control circuit 302 may be de-energized. When the approach signal 372 is detected, the lavatory system 10 may energize the entire control circuit 302 in anticipation of use. Similarly, the control circuit 302 may energize a heater, if present, to begin warming air for delivery to a user. According to yet another example, the visual indicators 305 on the fixture 100 may be energized in response to receiving the approach signal 372. Still other actions may be taken in response to the approach signal 372 at the control circuit 302 that will speed the user's hand washing experience.

According to another aspect of the invention, the lavatory system 10 is configurable using the sensors 301 in the fixture 100. Previously, configuration of a lavatory system 10 would be performed, for example, via dip switches, a rotary switch, or the like located within or near the enclosure for the control circuit 302 and contained under the deck 12 and within the housing 40 of the lavatory system 10. Changing operation such as the motor speed for the fan 210, volume of soap dispensed, duration of water flow, and the like required removing the housing 40 and accessing the switches beneath the deck 12. The present lavatory system 10 provides for configuration of the lavatory system 10 via the sensors 301 above the deck without removing the housing 40.

A user may enter a configuration mode for the lavatory system 10 by inserting the user's hands under the sensors 301 in a predefined sequence. The sequence is selected to avoid accidental entry of the configuration mode during normal operation of the lavatory system 10. For example, the sequence may require placing the right hand under a first sensor and a left hand under a second sensor where the right hand is inserted ahead of the left hand by less than a second. Both hands are then held under the sensors for at least ten seconds. According to another example, the sequence may require activating each sensor 301 in sequence from left-to-right or right-to-left multiple times in succession and subsequently holding a hand under one of the sensor 301 for a predefined time. Still other sequences may be used without deviating from the scope of the invention. Once the lavatory system 10 has entered configuration mode, each of the visual indicators 305 may provide an indication to the user of the configuration mode. The indicators 305 may, for example, turn to a unique color designating configuration mode.

The user then continues to configure the lavatory system 10 by further passing the user's hands under different sensors 301. The user may first select which system to configure, that is whether the user wishes to configure the soap dispensing system, the water dispensing system, or the air dispensing system. A particular system may be selected by inserting the user's hands under a sensor 301 proximate to the respective outlet. For example, to configure the water dispensing system, the user may insert a hand under a sensor 301 proximate the water outlet 180 and to configure the air dispensing system, the user may insert a hand under a sensor 301 proximate the air outlet 200. The visual indicator proximate the selected system may remain the color identifying configuration mode and begin to flash to indicate that the particular system has been selected. Optionally, the lavatory system 10 may contain a predefined number of parameters that are configurable via the sensors 301 and the user may increment or decrement through each parameter by inserting a hand under one of the sensors 301. Identification of the parameter may occur by briefly activating the device to be configured or by flashing a parameter number on the visual indicators.

Once a system or a particular parameter has been selected, the user again inserts a hand under one of the sensors 301. It is contemplated that a first sensor 301 may be utilized to choose a parameter for configuration and a second sensor 301 may be utilized to change the setting of the parameter. The parameter preferably has a predefined set of settings. For example, the motor for the fan may have a low, medium, and high speed setting. Each time a user inserts a hand under the second sensor 301 the setting of the parameter increments or decrements to the next setting. The lavatory system 10 may briefly activate the motor so that the user may observe the air flow resulting from the selected motor speed and determine which setting is desired.

Figure 44:
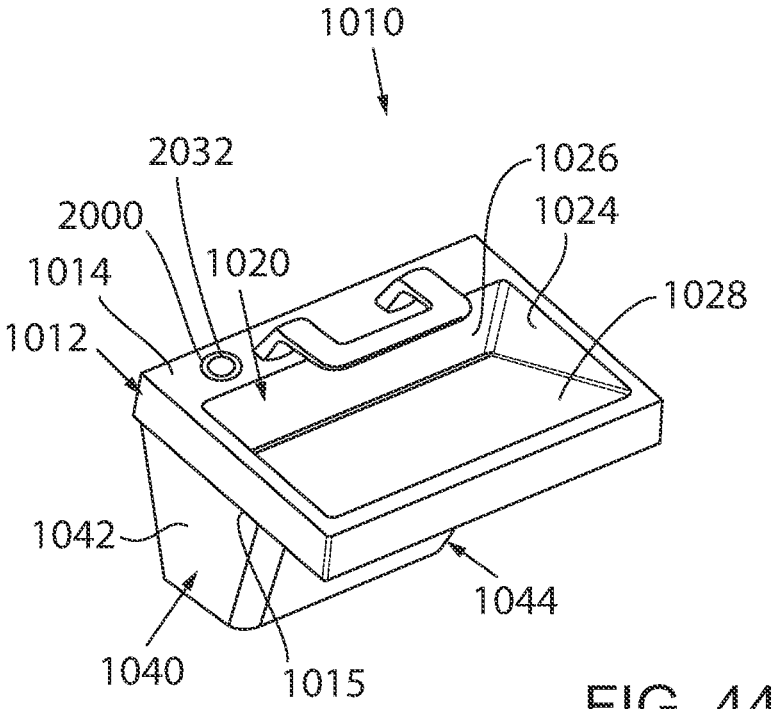
FIG. 44 is an isometric view of a lavatory system incorporating a multi-function fixture and a soap refill system according to one embodiment of the present invention.
Figure 45:
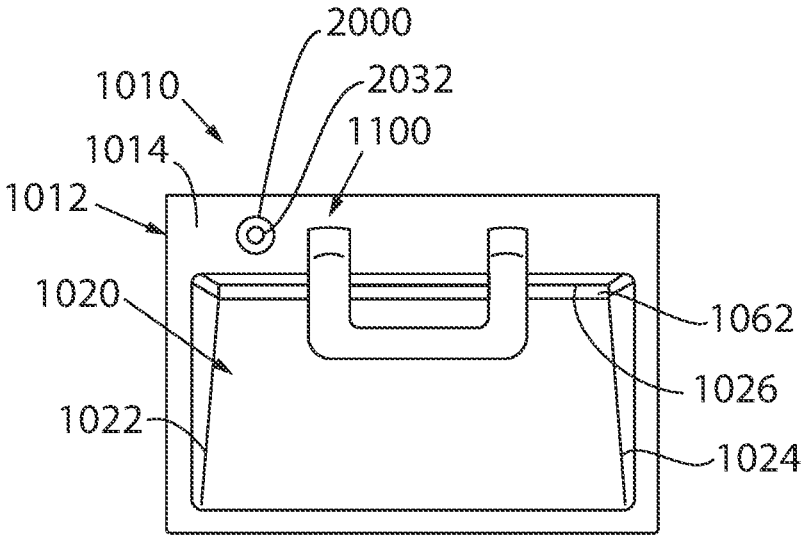
FIG. 45 is a top plan view of the lavatory system of FIG. 44.
Figure 46:
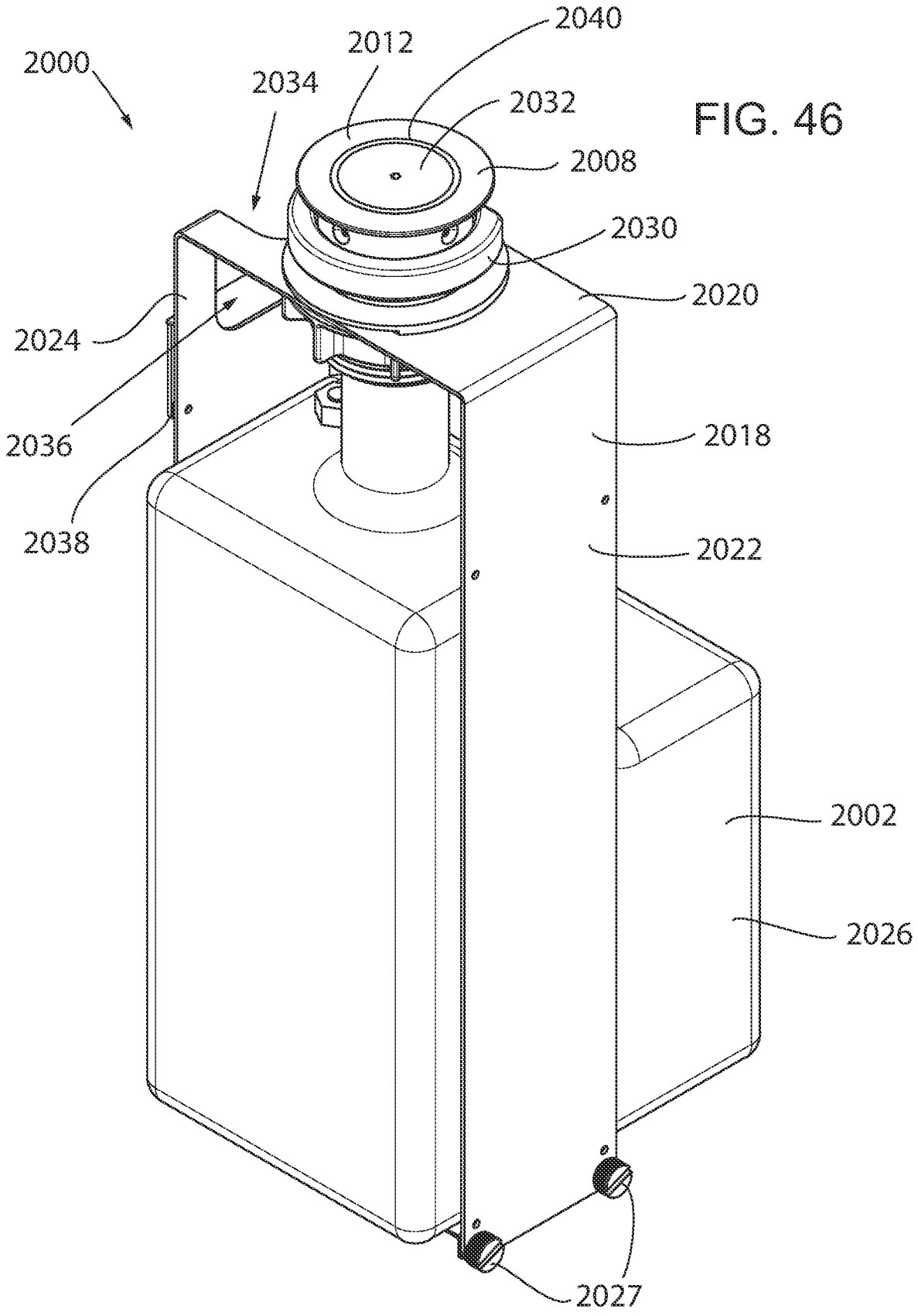
FIG. 46 is an isometric view of the soap refill system according to one embodiment of the present invention.
Figure 47:
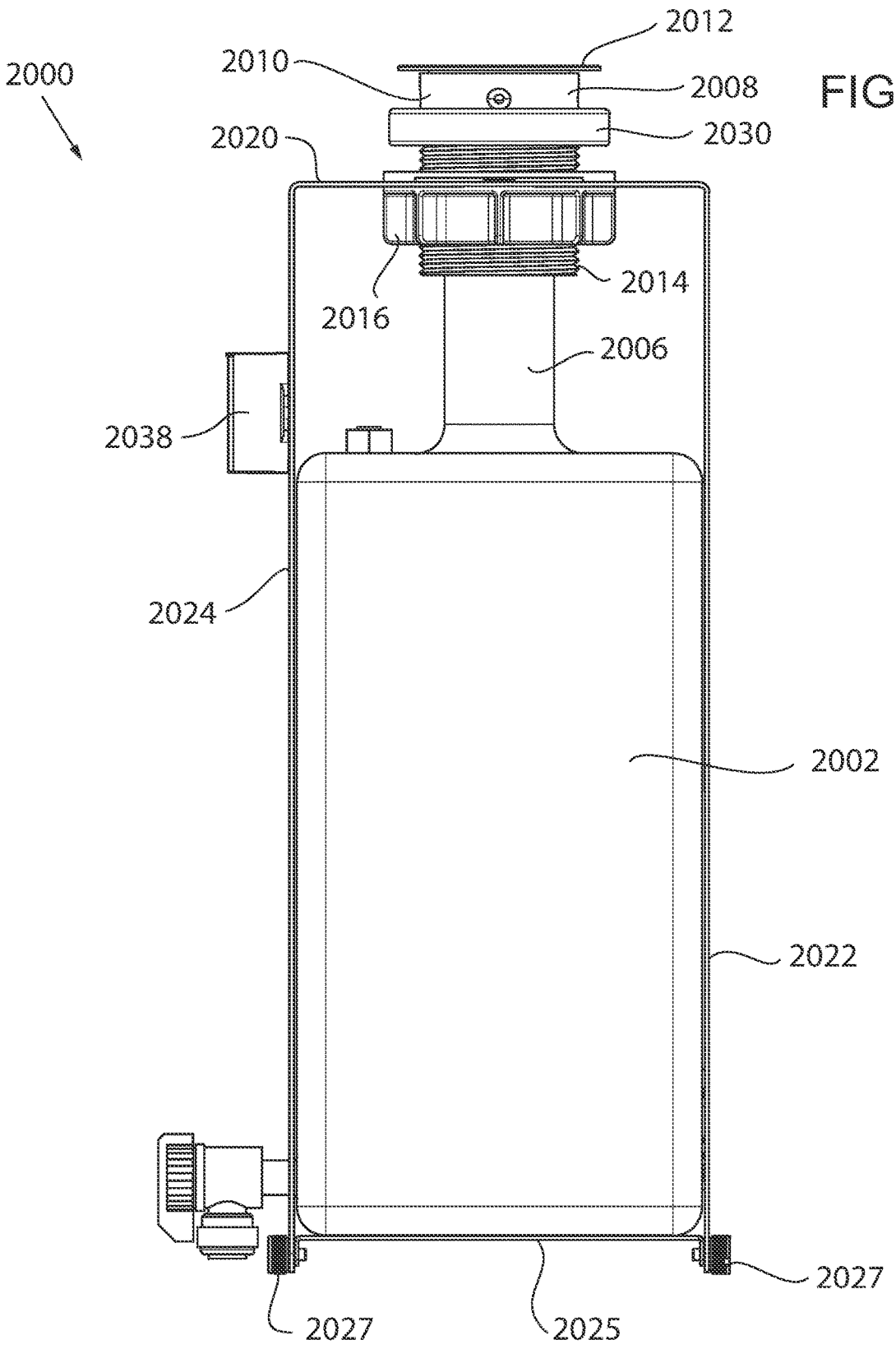
FIG. 47 is a front plan view of the soap refill system of FIG. 46.

Now referring to FIGS. 44-46, a lavatory system 1010 is shown including a multi-function fixture 1000 and a soap refill system 1500. In the representative embodiment of the invention the multi-function fixture 1000 is similar to the multi-function fixture 100 previously described in the present invention. However, it is also contemplated that the multi-function fixture 1000 may be similar to the multi-function fixtures 500 shown and described U.S. Pat. No. 10,697,160 and U.S. Publication No. 2020/0046172. Further, the representative embodiment of the invention illustrates the use of a single multi-function fixture 1100 and a single soap refill system 1500, other embodiments of the invention may include multiple multi-function fixtures 1100 with a single soap refill system 1500 or multiple multi-function fixtures 110 with multiple soap refill systems 1500.

The lavatory system 1010 includes a deck 1012 that is configured to be mounted to a wall, preferably via wall mounts (not shown). The deck 1012 includes an upper surface 1014 and an outer periphery 1016 extending downward from the upper surface 1014 and around the deck 1012. A basin 1020 is locate within the deck 1012. According to one embodiment of the invention, the deck 1012 and the basin 1020 may integrally formed as a single unit. Alternatively, the basin 1020 may be mounted to the deck 1012. It is further contemplated that the lavatory system 1010 may be free-standing, supported by the floor rather than being wall mounted.

The basin 1020 is a recessed are below the upper surface 1014 of the deck 1012 and is configured to receive products dispensed into the lavatory system 1010. According to the illustrated embodiment, the basin 1020 includes a first side 1022 and a second side 1024 opposite the first side 1022. Each of the first and second sides 1022, 1024 extend generally orthogonal to and away from the wall on which the lavatory system 1010 is mounted. The basin 1020 also includes a third side 1026 extending downward from an upper edge which joins the upper surface 1014 of the deck 1012 along the rear of the basin and further extends between the first side 1022 and the second side 1024. The third side 1026 extends downward and the lower end of the third side 1026 forms, in part, a drain channel 1062 in the bottom of the basin 1020. The basin 1020 further includes a fourth side 1028 extending downward from an upper edge which joins the upper surface 1014 of the deck 1012 along the front of the basin 1020 and also extends between the first side 1022 and the second side 1024. The fourth side 1028 of the basin 1020 is sloped inward and downward from the front edge of the basin to a front edge of the drain channel 1062. Although the basin 1020 is described in detail with respect to the illustrated embodiment, it is understood that the basin 1020 may take various shapes as would be understood to one skilled in the art without deviating from the scope of the invention.

The lavatory system 1010 includes a housing 1040 located below the deck 1012 and extending around the lower portion of the lavatory system 1010. According to the illustrated embodiment, the housing 1040 includes a first side 1042 and a second side 1044 opposite the first side 1042. A rear edge of each of the first side 1042 and the second side 1044 abuts the wall to which the lavatory system 1010 is mounted. Each of the first side 1042 and the second side 1044 extend forward, generally orthogonal to the wall. A front surface 1046 of the housing extends downward and to the rear from a lower surface 1015 of the deck 1012. The front surface 1046 extends the height of each of the first and second sides 1042, 1044. According to one embodiment of the invention, each of the first side 1042, second side 1044, and front surface 1046 extend to the floor. According to another embodiment of the invention, the each of the first side 1042, second side 1044, and front surface 1046 extend to some height above the floor. The front surface 46 is sloped to the rear from where it abuts the lower surface 1015 of the deck 1012. It is contemplated that the housing 1040 may include a bottom surface (not shown) if the housing does not extend to the floor. Optionally, the housing may be open on the bottom as defined by the periphery of the first side 1042, second side 1044, front surface 1046 and wall to which the lavatory system 1010 is mounted. The housing 1040 encloses the components of the lavatory system 1010 located below the deck to provide a measure of protection to the components and to provide an aesthetically pleasing appearance to the lavatory system 1010. Although the housing 1040 is described in detail with respect to the illustrated embodiment, it is understood that the housing 1040 may take various shapes as would be understood to one skilled in the art without deviating from the scope of the invention.

Referring now to the multi-function fixture 1100, the multi-function fixture 1100 is located at a hand washing station for the lavatory system 1010. While the representative embodiment shows a single washing station and single multi-function fixture 1100, other embodiments of the invention may include multiple washing stations and multiple associated multi-function fixtures 1100. The width of the lavatory system will vary according to the number of wash stations present.

As shown, the first end 1112 of each leg 1110 of the multi-function fixture 1100 is configured to be mounted to the deck 1012. An opening (not shown) extends through the mounting surface 1113 of the deck 1012 and is in communication with a passage (not shown) within the leg 1110. A base 1130 is received within the opening of the leg 1110 and secures the fixture 1100 to the deck 1012. The base 1130 also include a passage (not shown) extending therethrough and being in fluid communication with the passage of the leg 1110. The base 1130 extends from a first end (not shown) with the leg 1110 of the fixture 1100 to a second end 1134 inserted into the opening of the deck 1012 and extending below the deck 1012. To secure the fixture 1100 to the deck 1012, the base 1130 is affixed to each leg 1110 and inserted through the opening in the deck 1012. A nut 1135 is threaded onto the base 1130 from below the deck 1012 to secure the fixture 1100 to the deck 1012.

The fixture 1100 includes an extension section 1140 that includes multiple outlets for dispensing product over the basin 1020 of the lavatory system 1010. In the representative embodiment of the invention, a first outlet is operable to dispense soap, a second outlet is operable to dispenser water, and a third outlet may be included and be operable to dispense air. The outlets are spaced apart along the extension section 1140 such that a user's hands may move along the extension section 1140 between the outlets during the washing process.

The extension section 1140 may also include indicators to a user identifying the location of each outlet. Similar to connecting section 140 of fixture 100, the extension section 1140 may include openings along the front edge of the extension section 1140 and light-emitting diodes (LED) 1705 behind each opening. It is contemplated that each opening may have a lens or be a translucent material rather than an opening to prevent soap, water, dirt, or other contaminants from entering the fixture 1100. The LED 1705 may emit different colors according to operation or flash to direct a user's attention to the location. Optionally, larger displays utilizing, for example, a liquid crystal display (LCD) may provide a graphical or other visual indication to the user of the purpose of each outlet located by the indicator.

The system for dispensing soap includes a soap system 2000 having a soap container 2002, a pump 2004, and tubing to connect the pump 2004 to the soap outlet. In embodiments of the invention including multiple multi-function fixtures 1100, the soap container 2002 may be coupled to either a single soap pump 2004 connected to each soap outlet of the multiple multi-function fixtures 1100 or the soap container 2002 may be coupled to multiple soap pumps 2004 located at each multiple multi-function fixture 1100. As shown in FIGS. 44-45, the soap system 2000 is mounted to the deck/countertop 1012 of the lavatory system 1010. A refill port 2006 of the soap system 2000 extends from the upper surface 1014 of the deck 1012 to the soap container 2002, which may be located below the deck 1012. The soap system 2000 includes a mounting component 2008 disposed within an opening (not shown) formed in the deck 1012 in order to extend from the upper surface 1014 of the deck 1012 to the lower surface 1015 of the deck 1012. The mounting component 2008 includes a main body 2010, a surface place 2012, a threaded portion 2014, and a nut 2016. The surface plate 2012 is located at a first end of the main body 2010 and configured to be disposed on the upper surface 1014 of the deck 1012. Meanwhile, the threaded portion 2014 of the main body 2010 is disposed at the second end of the main body 2010. The threaded portion 2014 is configured to receive the nut 2016 in order to secure the mounting component 2008 to the deck 1012. That is, the deck 1012 is disposed between the surface plate 2012 and the nut 2016. The mounting component 2008 includes an opening (not shown) formed therethrough and configured to receive the refill port 2016 in order to extend through the mounting component 2008 and from the deck 1012 to the soap container 2002. As shown in FIG. 46, a cap 2032 may be disposed within the opening of the mounting bracket 2018 adjacent the surface plate 2012 in order to cover the refill port 2006. When the cap 2032 is removed, the refill port 2006 is exposed and the soap container 2002 may be refilled.

As shown in FIGS. 46-61, the soap system 2000, 3000, 4000, 5000 includes a mounting bracket 2018, 3018, 4018, 5018 disposed below the deck 1012 and configured to mount the soap container 2002, 3002, 4002, 5002 below the deck 1012. Referring first to FIGS. 46-49, a representative embodiment of the mounting bracket 2018 is shown according to a first embodiment of the invention. As shown, the mounting bracket 2018 includes a top plate 2020, a first side plate 2022, a second side plate 2024, and a bottom plate 2025. In the representative embodiment of the invention, the top plate 2020 of the mounting bracket 2018 is disposed between the nut 2016 and the deck 1012. The top plate 2020 of the mounting bracket 2018 may include an opening (not shown) formed therein to allow the mounting component 2008 and refill port 2006 to pass through the opening of the top plate 2020.

Figure 49:
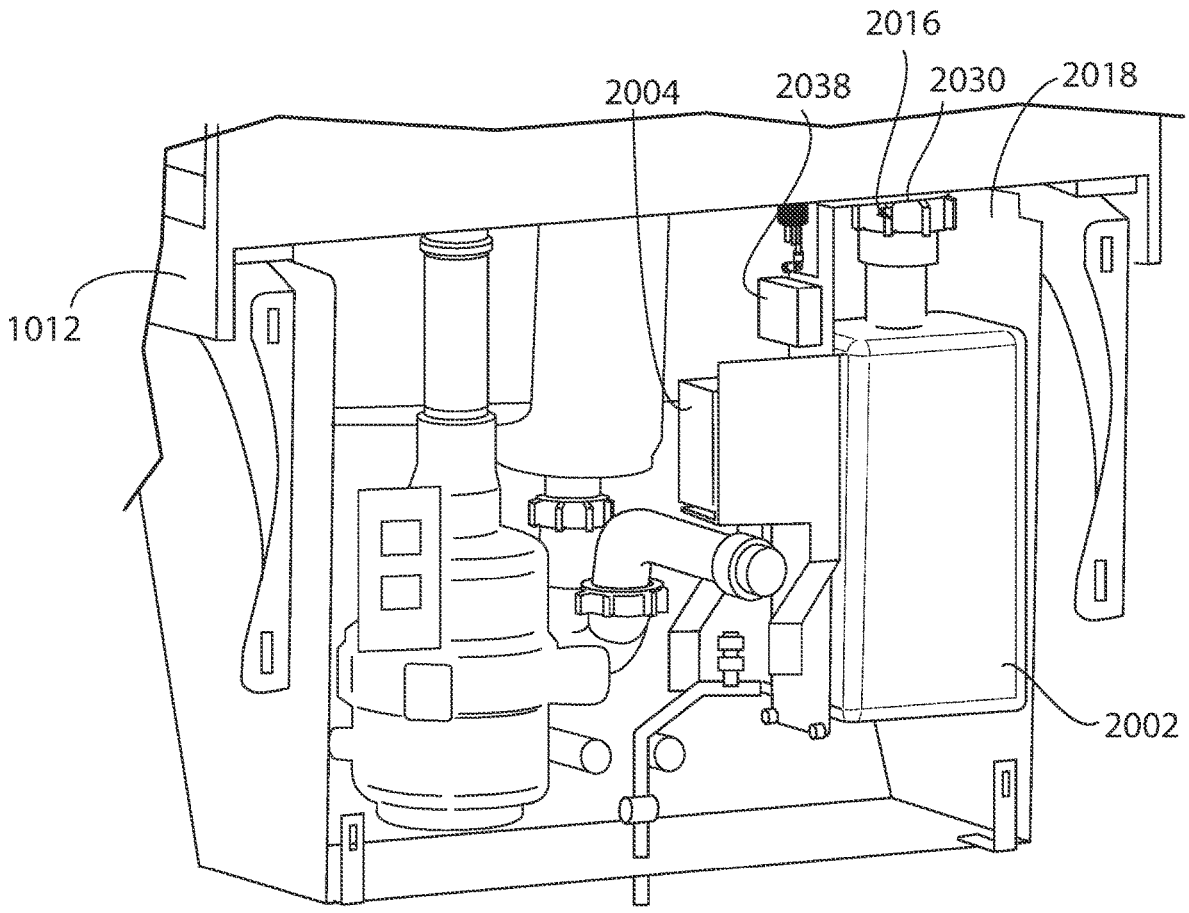
FIG. 49 is a rear isometric view of the lavatory system of FIG. 1 incorporating the soap refill system of FIG .46.

The soap system 2000 may also include at least one spacer element 2030 disposed between the top plate 2020 of the mounting bracket 2018 and the deck 1012. The spacer element 2030 is configured to surround the main body 2010 of the mounting component 2008 and increase the distance between the deck 1012 and the top plate 2020 of the mounting component 2008. As shown in FIG. 49, the increase of the distance between the deck 1012 and the top plate 2020 of the mounting component 2008 allows additional room for the base 1130 of the fixture 1100 disposed directly adjacent the soap system 2000.

Referring again to the mounting plate 2018, the first and second side plates 2022, 2024 of the mounting plate 2018 are configured to extend downward from the top plate 2020 and along the sides 2026, 2028 of the soap container 2002. The bottom plate 2025 extends between the side plates 2022, 2024 at the bottom edge. In the representative embodiment of the invention, the bottom plate 2025 is coupled to the side plates 2022, 2024 via fasteners 2027 disposed at the bottom edges of the side plates 2022, 2024. The container 2002 then is able to sit on the bottom plate 2025. In turn, the side plates 2022, 2024 and bottom plate 2025 of mounting plate 2008 act as a cradle to provide additional support for the soap container 2002 underneath the deck 1012.

Figure 48:
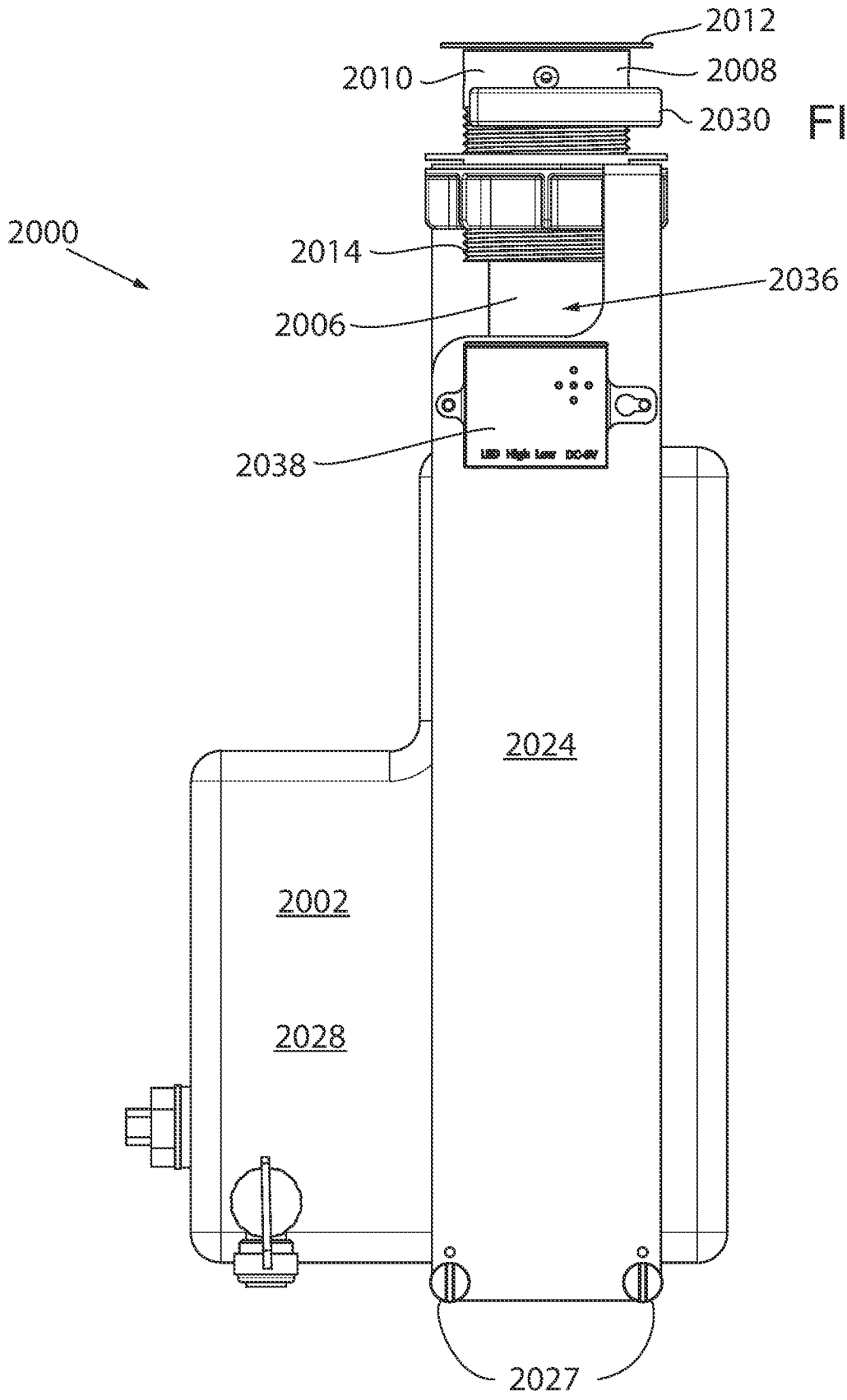
FIG. 48 is a side plan view of the soap refill system of FIG. 46.

In order to further accommodate the base 1130 of the adjacent fixture 1100, at least one of the top plate 2020 and the side plate 2024 adjacent the base 1130 may include notches 2034, 2036 formed therein. As shown in FIGS. 46 and 48, the notch 2034 formed the top plate 2020 extends from the edge of the top plate 2020 adjacent the second side plate 2024 and from the front edge of the top plate 2020. Similarly, the notch 2036 formed in the side plate 2024 extends from the top edge of the side plate 2024 adjacent the top plate 2020 and from the front edge of the side plate 2024. As a result of the notches 2034, 2036, the mounting bracket 2018 is configured to not interfere with the base 1130 of the fixture 1100 adjacent the soap system 2000.

FIGS. 46-49 further illustrate a controller 2038 mounted to the side plate 2024 of the mounting bracket 2018. In other embodiments of the invention, the controller 2038 may be mounted to any plate of the mounting bracket 2018 or in any other location below the deck 1012. The controller 2038 is configured to control a display element 2040 of the soap system 2000. The display element 2040 may include a number of LEDs disposed with the mounting component 2008 and below a translucent material in order to communicate messaging to a user. For example, the display element 2040 may be configure to illuminate to indicate to a user that the soap container 2002 below the deck 1012 needs to be refilled.

Next, FIGS. 50-53 illustrates a representative embodiment of the mounting bracket 3018 according to a second embodiment of the invention. As shown, the mounting bracket 3018 includes a top plate 2020, a side plate 3022 that follow the contour of the soap container 3002, and a bottom plate 3025. As shown, the top plate 3020 of the mounting bracket 3018 is disposed between the nut 3016 and the deck 1012. The top plate 3020 of the mounting bracket 3018 may include an opening (not shown) formed therein to allow the mounting component 3008 and refill port 3006 to pass through the opening of the top plate 3020.

Figure 53:
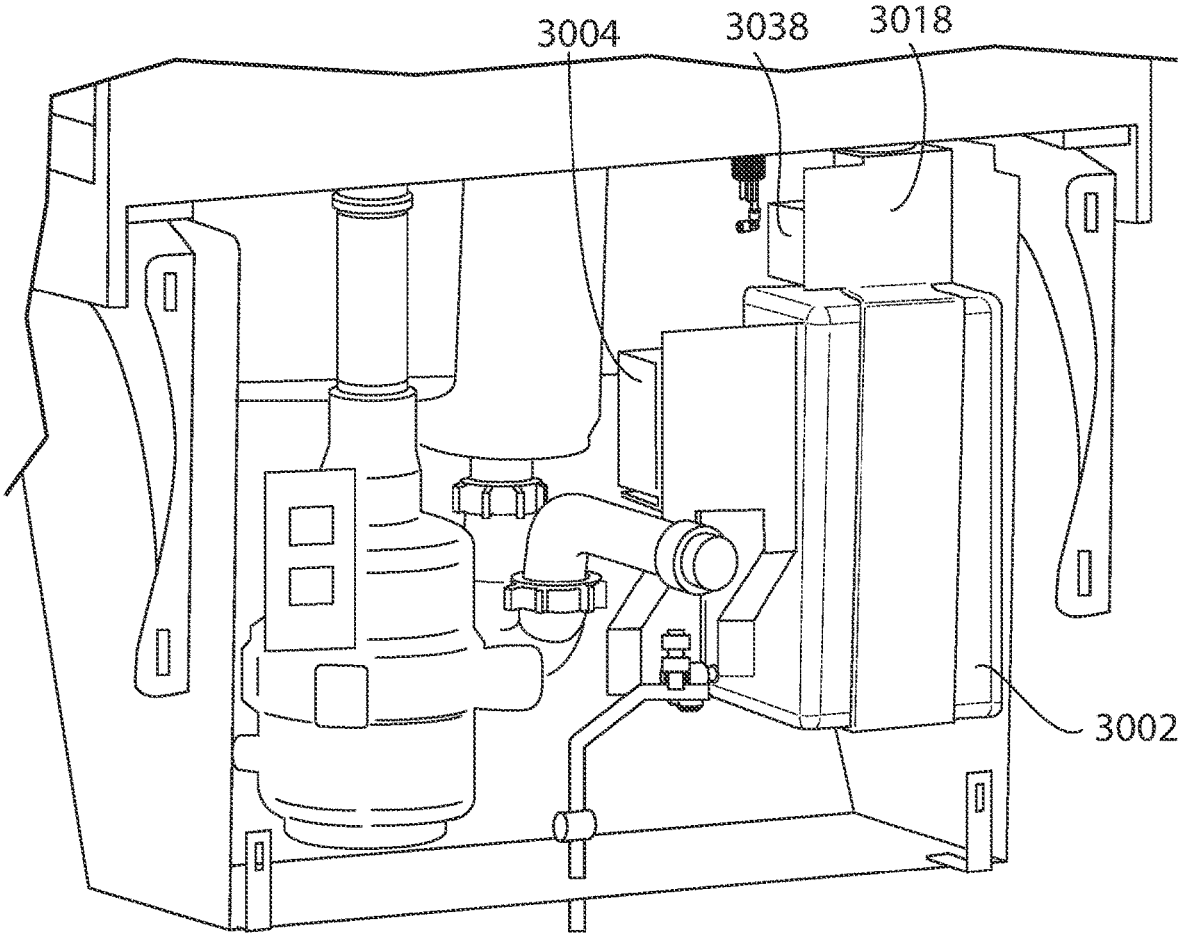
FIG. 53 is a rear isometric view of the lavatory system of FIG. 1 incorporating the soap refill system of FIG. 50.

The soap system 3000 may also include at least one spacer element 3030 disposed between the top plate 3020 of the mounting bracket 3018 and the deck 1012. The spacer element 3030 is configured to increase the distance between the deck 1012 and the top plate 3020 of the mounting component 3008. In this embodiment of the invention, the spacer element 3030 may be in the form of extensions 3030 extending upward from top plate 3020 at the edges of the top plate 3020. As shown in FIG. 53, the increase of the distance between the deck 1012 and the top plate 3020 of the mounting component 3008 allows additional room for the base 1130 of the fixture 1100 disposed directly adjacent the soap system 3000.

Figure 50:
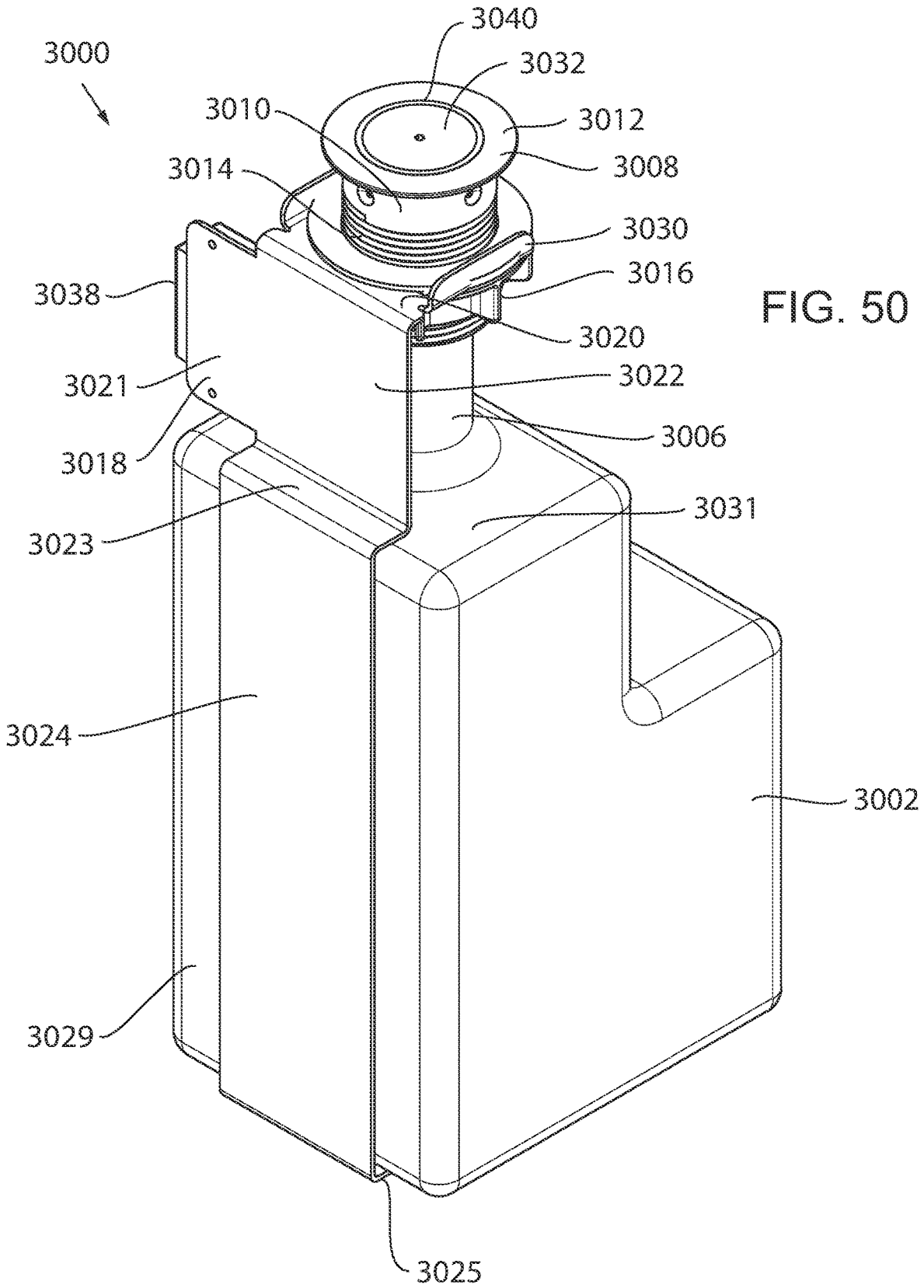
FIG. 50 is an isometric view of the soap refill system according to another embodiment of the present invention.
Figure 51:
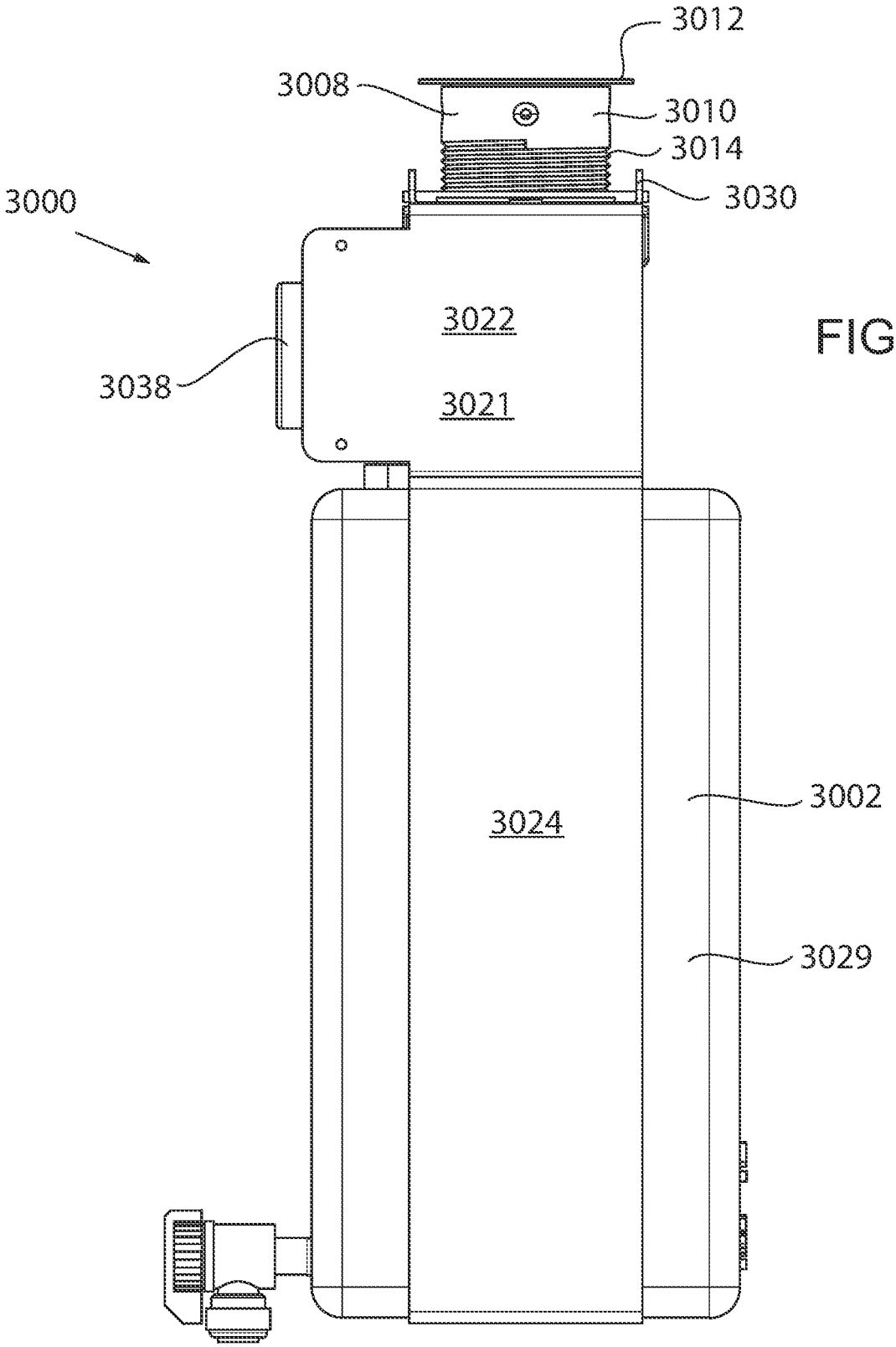
FIG. 51 is a front plan view of the soap refill system of FIG. 50.
Figure 52:
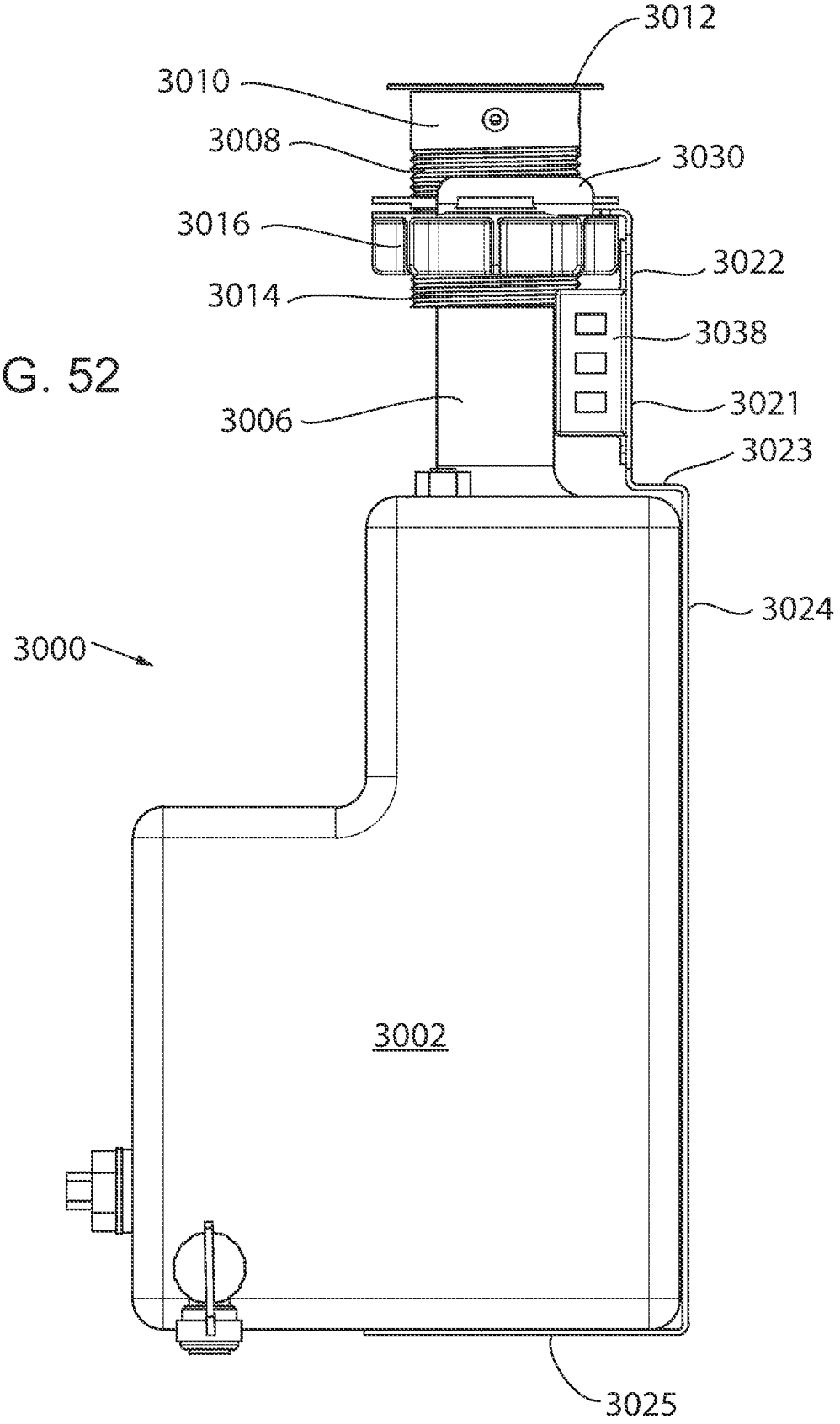
FIG. 52 is a side plan view of the soap refill system of FIG. 50.

As stated above, the mounting plate 3018 includes a side plate 3022. As shown in FIGS. 50-52, the side plate 3022 extends downward from the top plate 3020 at a rear edge thereof to a rear edge of the bottom plate 3025. In the representative embodiment of the invention, the side plate 3022 is contoured to adjust to the soap container 3002. For instance, the side plate 3022 includes a first/upper portion 3021 extending from the rear edge of the top plate 3020 to a location adjacent a top surface 3031 of the soap container 3002. Next, the a second/intermediate portion 3023 of the side plate 3022 extends horizontally from the bottom edge of the first portion 3021 of the side plate 3022 in order to follow the contour of the top surface 3031 of the soap container 3002. The second portion 3023 of the side plate 3022 extends toward a rear surface 3029 of the soap container. Next, a third/lower portion 3024 of the side plate 3022 extends downward from the rear edge of the second portion 3023 of the side plate 3022 in order to be oriented along the rear surface 3029 of the soap container 3002. The bottom plate 3025 then extends from the bottom edge of the third portion 3024 of the side plate 3022 for a distance. As a result, the container 3002 is able to sit on the bottom plate 3025. In turn, the side plates 3022 and bottom plate 3025 of mounting plate 3008 act as a cradle to provide additional support for the soap container 3002 underneath the deck 1012.

FIGS. 50-53 further illustrate a controller 3038 mounted to the side plate 3022 of the mounting bracket 3018. While the controller 3038 is shown mounted to the first portion 3021 of the side plate 3022, the controller 3038 may be mounted to any location of the side plate 3022 in varying embodiments of the invention. In yet other embodiments of the invention, the controller 3038 may be mounted to any plate of the mounting bracket 3018 or in any other location below the deck 1012. The controller 3038 is configured to control a display element 3040 of the soap system 3000. The display element 3040 may include a number of LEDs disposed with the mounting component 3008 and below a translucent material in order to communicate messaging to a user. For example, the display element 3040 may be configure to illuminate to indicate to a user that the soap container 3002 below the deck 1012 needs to be refilled.

Referring next to FIGS. 54-57, a representative embodiment of the mounting bracket 4018 is shown according to a third embodiment of the invention. The mounting bracket 4018 includes a top plate 4020, a side plate 4022 that follow the contour of the soap container 4002, and a bottom plate 4025. As shown, the top plate 4020 of the mounting bracket 4018 is disposed between the nut 4016 and the deck 1012. The top plate 4020 of the mounting bracket 4018 may include an opening (not shown) formed therein to allow the mounting component 4008 and refill port 4006 to pass through the opening of the top plate 4020.

Figure 57:
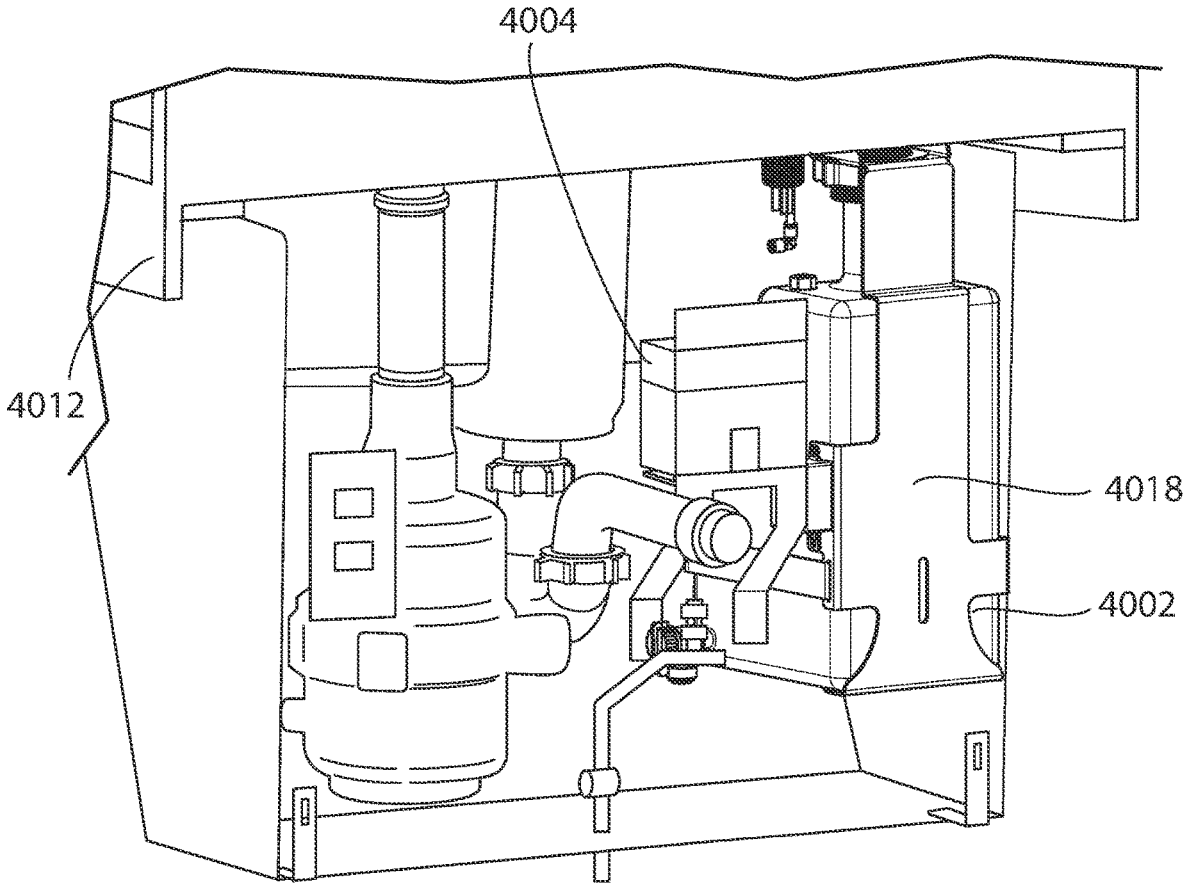
FIG. 57 is a rear isometric view of the lavatory system of FIG. 1 incorporating the soap refill system of FIG. 54.

The soap system 4000 may also include at least one spacer element 4030 disposed between the top plate 4020 of the mounting bracket 4018 and the deck 1012. The spacer element 4030 is configured to increase the distance between the deck 1012 and the top plate 4020 of the mounting component 4008. In this embodiment of the invention, the spacer element 4030 may be in the form of extensions 4030 extending upward from top plate 4020 at the edges of the top plate 4020. As shown in FIG. 57, the increase of the distance between the deck 1012 and the top plate 4020 of the mounting component 4008 allows additional room for the base 1130 of the fixture 1100 disposed directly adjacent the soap system 4000.

Figure 54:
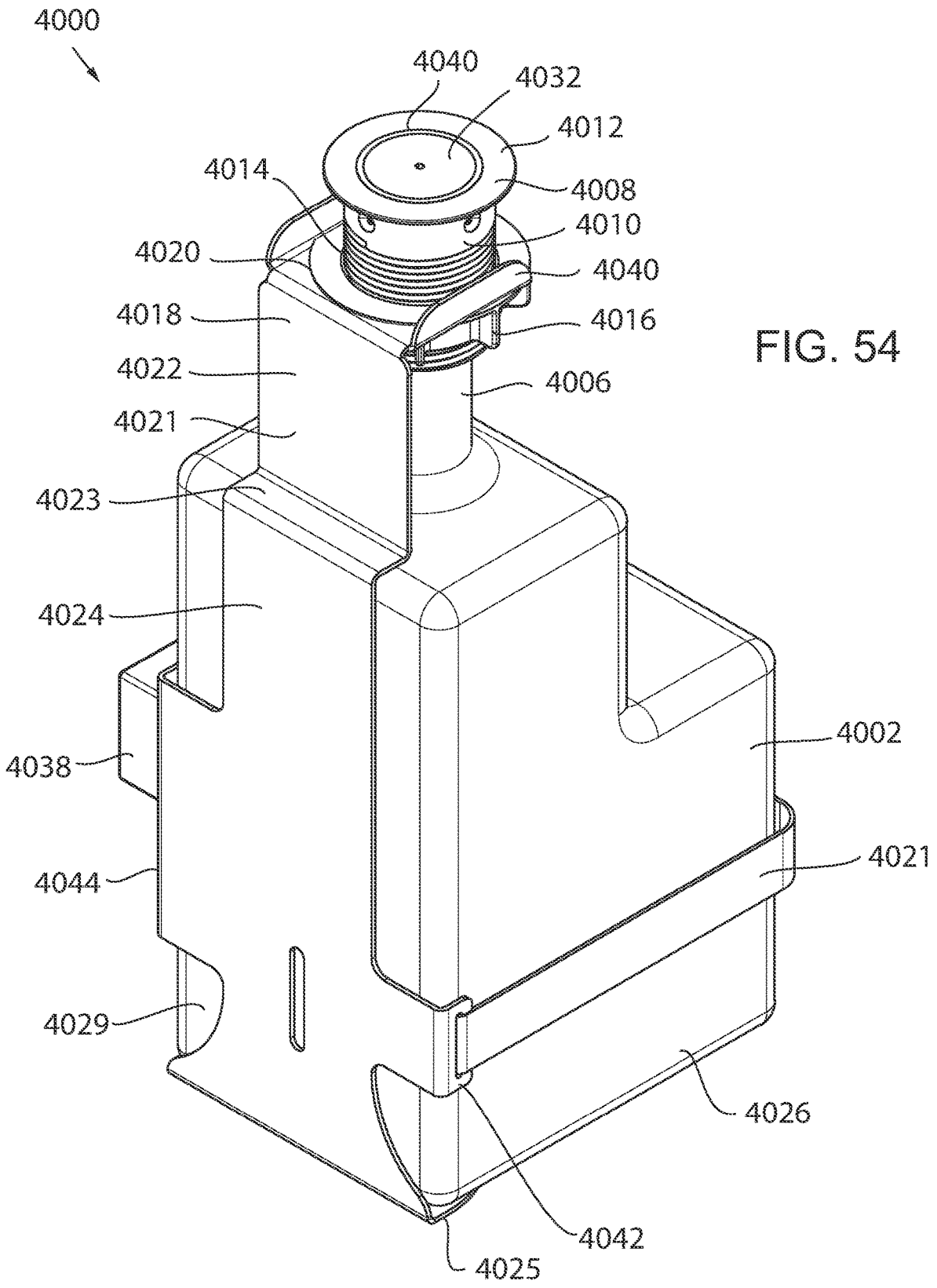
FIG. 54 is an isometric view of the soap refill system according to another embodiment of the present invention.
Figure 55:
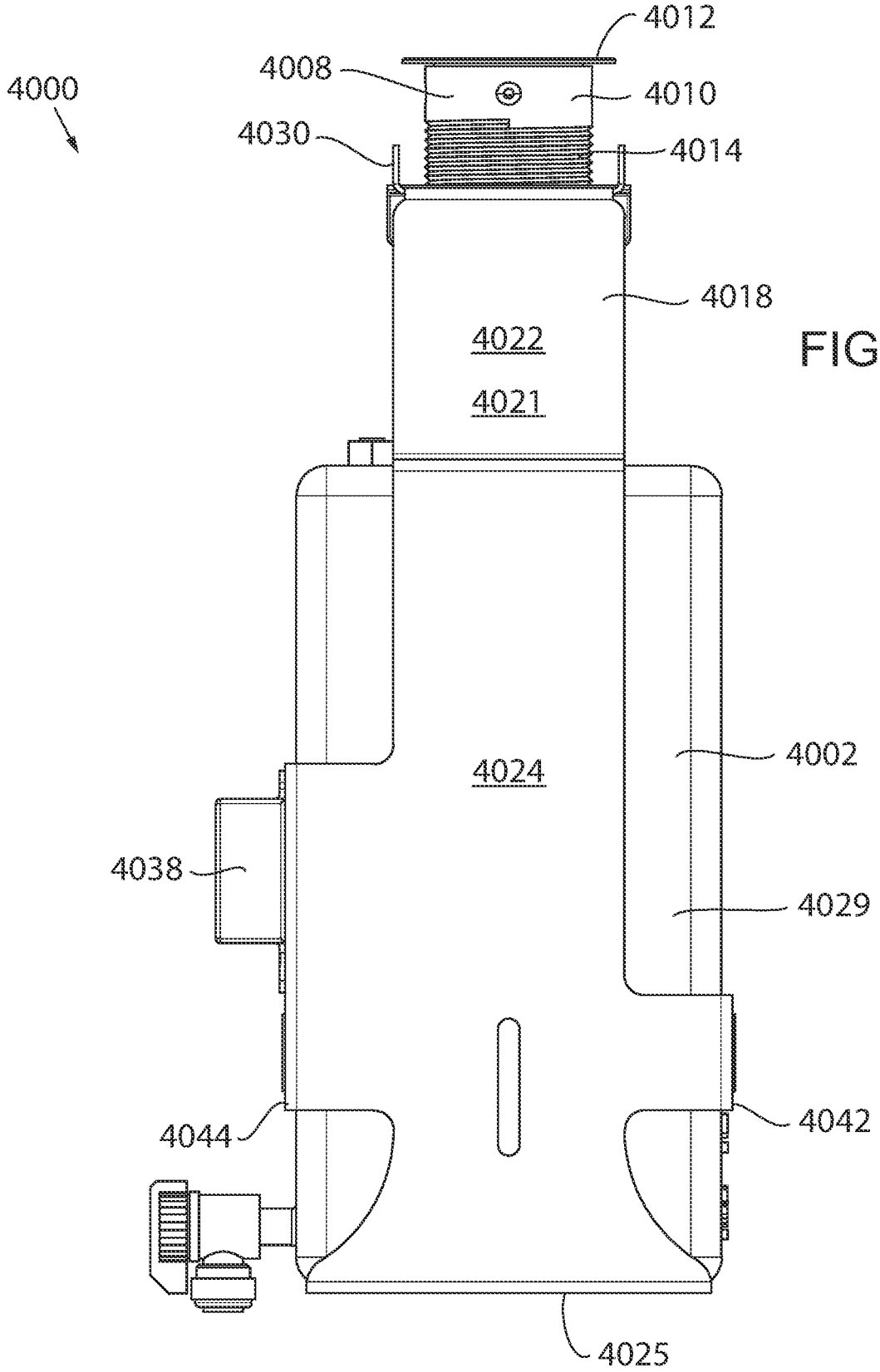
FIG. 55 is a front plan view of the soap refill system of FIG. 54.
Figure 56:
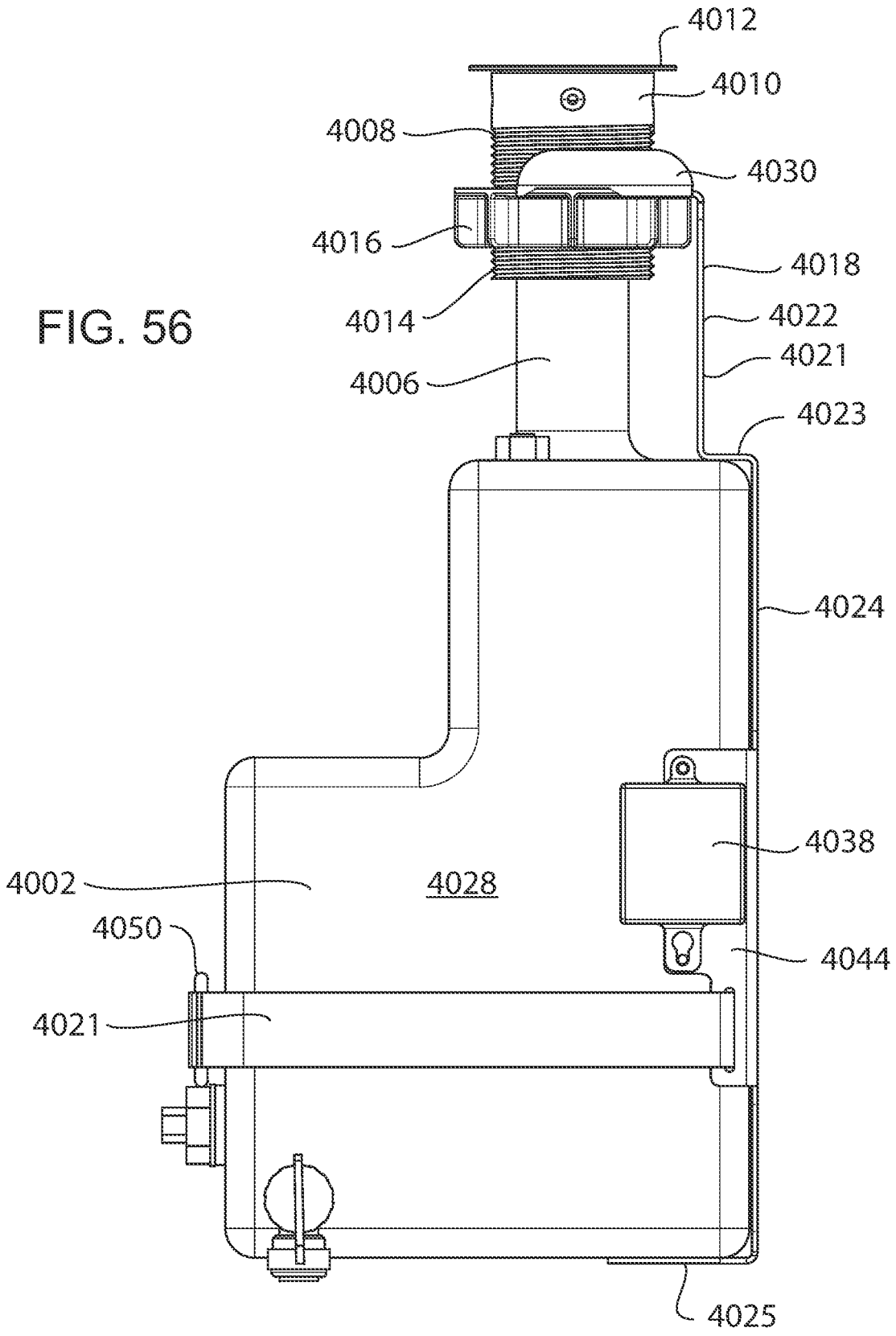
FIG. 56 is a side plan view of the soap refill system of FIG. 54.

As stated above, the mounting plate 4018 includes a side plate 4022. As shown in FIGS. 54-56, the side plate 4022 extends downward from a rear edge of the top plate 4020 to a rear edge of the bottom plate 4025. In order to contour with the soap container 4002, the side plate 4022 may include a first/upper portion 4021 that extends from the rear edge of the top plate 4020 to a location adjacent a top surface 4031 of the soap container 4002. Next, a second/intermediate portion 4023 of the side plate 4022 extends horizontally from the bottom edge of the first portion 4021 of the side plate 4022 in order to follow the contour of the top surface 4031 of the soap container 4002. The second/intermediate portion 4023 of the side plate 4022 extends toward a rear surface 4029 of the soap container 4002, while a third/lower portion 4024 of the side plate 4022 extends downward from the rear edge of the second portion 4023 of the side plate 4022 in order to be oriented along the rear surface 4029 of the soap container 4002. The bottom plate 4025 then extends from the bottom edge of the third portion 4024 of the side plate 4022 for a distance. As a result, the soap container 4002 is able to sit on the bottom plate 4025. In turn, the side plate 4022 and bottom plate 4025 of mounting plate 4008 act as a cradle to provide additional support for the soap container 4002 underneath the deck 1012.

In the representative embodiment of the invention shown in FIGS. 54-57, the mounting plate 4008 may also include additional side extensions 4042, 4044. Side extension 4042 extends perpendicular from the second portion 4024 of the side plate 4022 at a first edge thereof, while side extension 4044 extends perpendicular from the second portion 4024 of the side plate 4022 at a second edge thereof. In turn, side extension 4042 is oriented along a first side 4026 of the soap container 4002 and side extension 4044 is oriented along a second side 4028 of the soap container 4002. In addition, a strap 4021 may extend from a location at or adjacent the first edge of the side plate 4022, around the soap container 4002, and to a location at or adjacent the second edge of the side plate 4022 in order to surround the soap container 4002 in conjunction with the side plate 4022 and secure the soap container 4002 within the cradle of the bracket 4018. More specifically, the strap 4021 may extend from side extension 4042 to side extension 4044 and around the soap container 4002 to further secure the soap container 4002 within the cradle of the bracket 4018. As shown, the side extensions 4042, 4044 may include openings formed therein to allow the strap 4021 to extend through the openings and attach itself to the side extensions 4042, 4044. As shown in FIG. 56, the strap 4021 may include an attachment element 4050 to close the strap 4021 around the soap container 4002. In varying embodiments of the invention, the strap 4021 may be a variety of materials and the attachment element 4050 may be a variety of clasps or attachment methods, such as VELCRO®.

FIGS. 55-57 further illustrate a controller 4038 mounted to the side extension 4044 of the side plate 4024 of the mounting bracket 4018. In other embodiments of the invention, the controller 4038 may be mounted to any portion of the side plate 4024, any other plate of the mounting bracket 4018, or in any other location below the deck 1012. The controller 4038 is configured to control a display element 4040 of the soap system 4000. The display element 4040 may include a number of LEDs disposed with the mounting component 4008 and below a translucent material in order to communicate messaging to a user. For example, the display element 4040 may be configure to illuminate to indicate to a user that the soap container 4002 below the deck 1012 needs to be refilled.

Next, FIGS. 58-61 illustrate a representative embodiment of the mounting bracket 5018 according to a fourth embodiment of the invention. The mounting bracket 5018 includes a top plate 5020, a side plate 5022 that follow the contour of the soap container 5002, and a bottom plate 5025. As shown, the top plate 5020 of the mounting bracket 5018 is disposed between the nut 5016 and the deck 1012. The top plate 5020 of the mounting bracket 5018 may include an opening (not shown) formed therein to allow the mounting component 5008 and refill port 5006 to pass through the opening of the top plate 5020.

Figure 60:
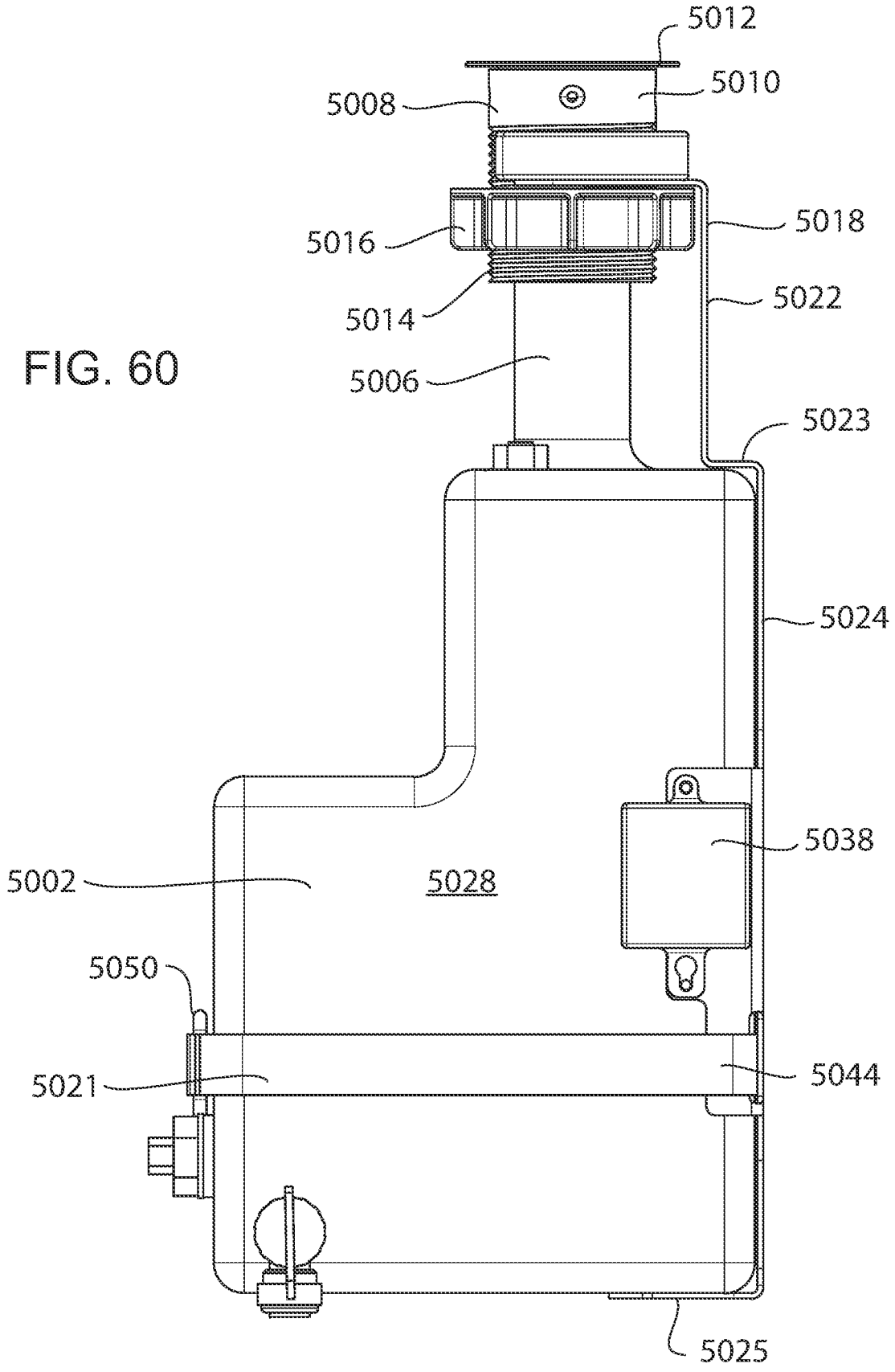
FIG. 60 is side plan view of the soap refill system of FIG. 58.
Figure 61:
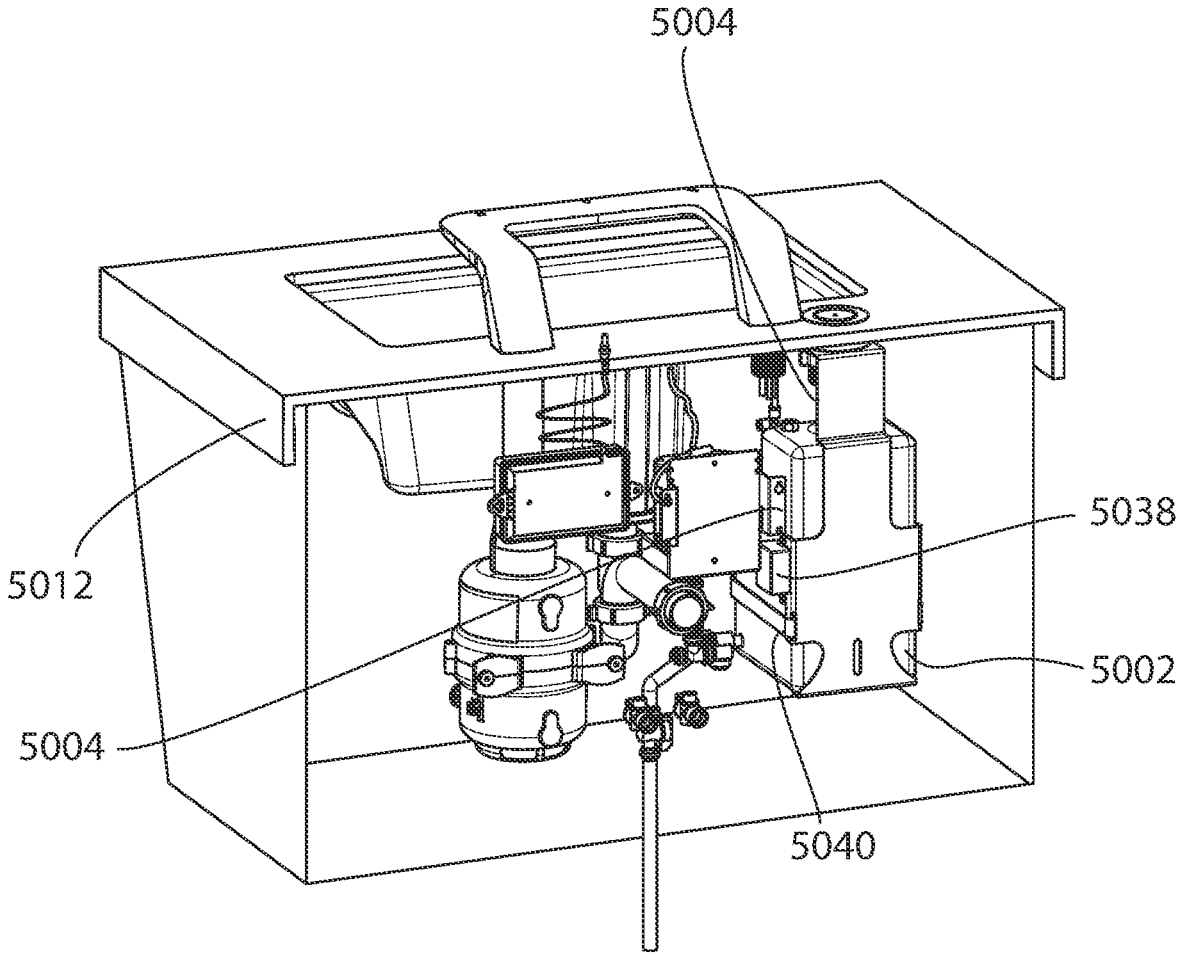
FIG. 61 is a rear isometric view of the lavatory system of FIG. 1 incorporating the soap refill system of FIG. 58.

The soap system 5000 may also include at least one spacer element 5030 disposed between the top plate 5020 of the mounting bracket 5018 and the deck 1012. The spacer element 5030 is configured to surround either entirely or partially the main body 5010 of the mounting component 5008 and increase the distance between the deck 1012 and the top plate 5020 of the mounting component 5008. As shown in FIG. 60, the increase of the distance between the deck 1012 and the top plate 5020 of the mounting component 5008 allows additional room for the base 1130 of the fixture 1100 disposed directly adjacent the soap system 5000.

Figure 58:
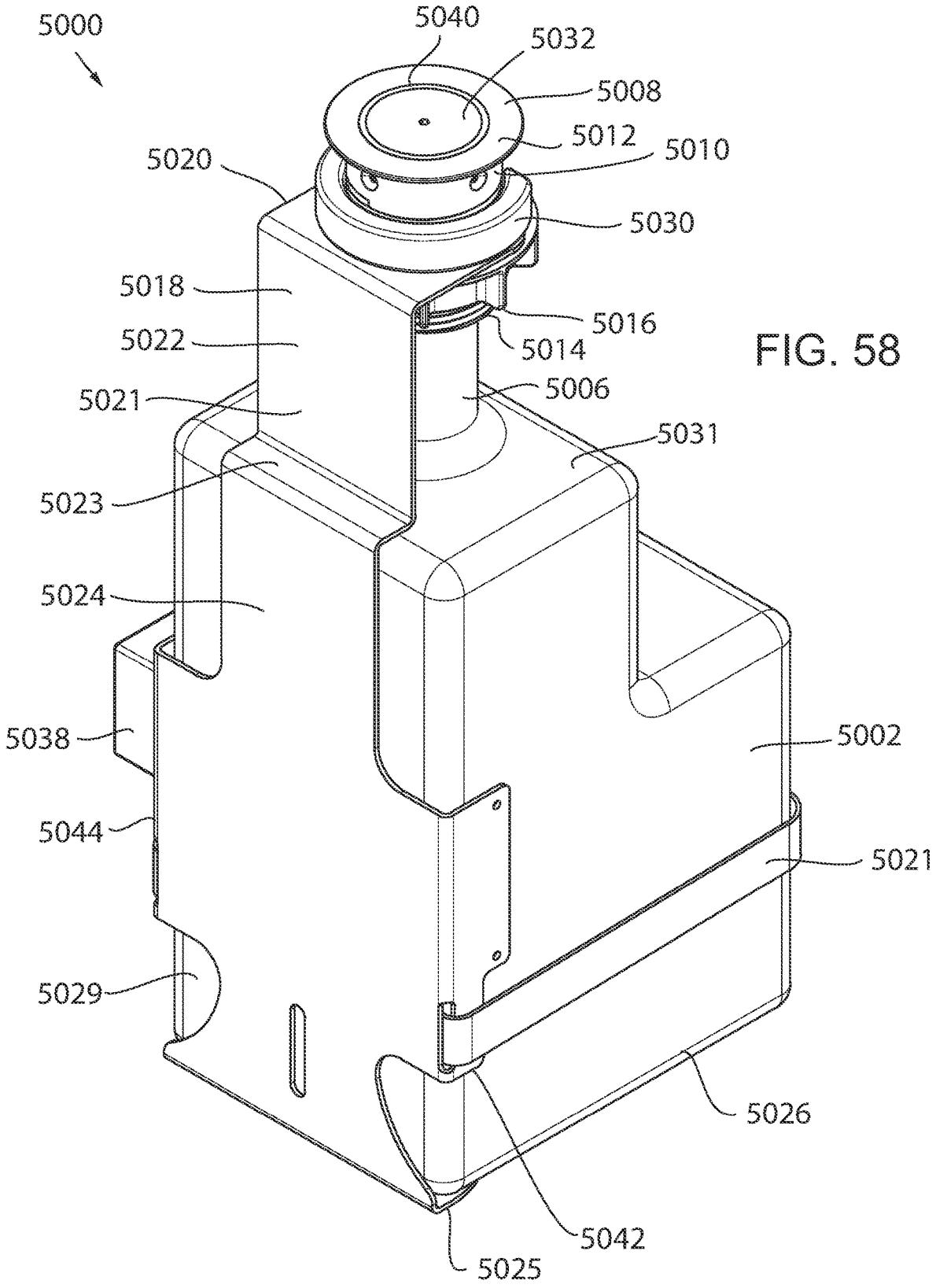
FIG. 58 is an isometric view of the soap refill system according to yet another embodiment of the present invention.
Figure 59:
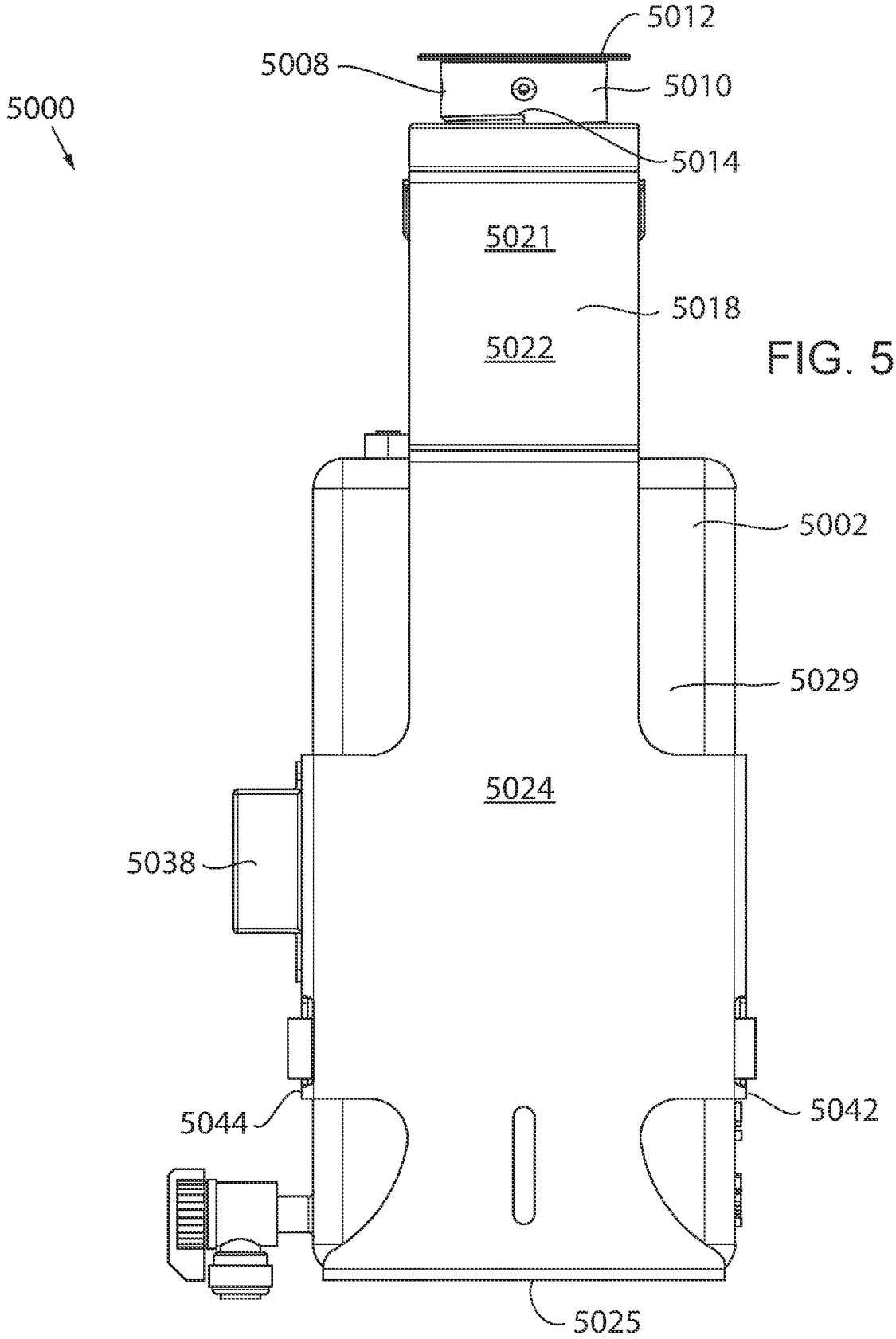
FIG. 59 is a front plan view of the soap refill system of FIG. 58.

As stated above, the mounting plate 5018 includes a side plate 5022 that follows the contour of the soap container 5002. As shown in FIGS. 58-60, the side plate 5022 extends downward from a rear edge of the top plate 5020 to a rear edge of the bottom plate 5025. A first/upper portion 5021 of the side plate 5022 extends from the rear edge of the top plate 5020 to a location adjacent a top surface 5031 of the soap container 5002. Next, a second/intermediate portion 5023 of the side plate 5022 extends horizontally from the bottom edge of the first portion 5021 of the side plate 4022 in order to follow the contour of the top surface 5031 of the soap container 5002. The second portion 5023 of the side plate 5022 extends toward a rear surface 5029 of the soap container 5002. Next, a third/lower portion 5024 of the side plate 5022 extends downward from the rear edge of the second portion 5023 of the side plate 5022 in order to be oriented along the rear surface 5029 of the soap container 5002. The bottom plate 5025 then extends from a bottom edge of the third portion 5024 of the side plate 5022 for a distance. As a result, the soap container 5002 is able to sit on the bottom plate 5025. In turn, the side plate 5022 and bottom plate 5025 of mounting plate 5008 act as a cradle to provide additional support for the soap container 5002 underneath the deck 1012.

In the representative embodiment of the invention shown in FIGS. 58-61, the mounting plate 5008 may also include additional side extensions 5042, 5044 to provide additional support for the soap container 5002. The first side extension 5042 extends perpendicular from a first edge of the second portion 5024 of the side plate 5022 and the second side extension 5044 extends perpendicular from a second edge of the second portion 5024 of the side plate 5022. In turn, side extension 5042 is oriented along a first side 5026 of the soap container 5002 and side extension 5044 is oriented along a second side 5028 of the soap container 5002. In addition, a strap 5021 may extend from a location at or adjacent the first edge of the side plate 5022, around the soap container 5002, and to a location at or adjacent the second edge of the side plate 5022 in order to secure the soap container 5002 within the cradle of the bracket 5018. As shown in FIG. 58, openings may be formed in the side plate 5022 along the first and second edges thereof in order to allow the strap 5021 to extend through the opening and attach itself to the side plate 5022. Further yet, the strap 5021 may include an attachment element 5050 to close the strap 5021 around the soap container 4002. In varying embodiments of the invention, the strap 5021 may be a variety of materials and the attachment element 5050 may be a variety of clasps or attachment methods, such as VELCRO®.

FIGS. 58-61 further illustrate a controller 5038 mounted to the side extension 5044 of the side plate 5022 of the mounting bracket 5018. In other embodiments of the invention, the controller 5038 may be mounted at any location on the side plate 5022, to any plate of the mounting bracket 5018, or in any other location below the deck 1012. The controller 5038 is configured to control a display element 5040 of the soap system 5000. The display element 5040 may include a number of LEDs disposed with the mounting component 5008 and below a translucent material in order to communicate messaging to a user. For example, the display element 5040 may illuminate to indicate to a user that the soap container 5002 below the deck 1012 needs to be refilled.

Figure 62:
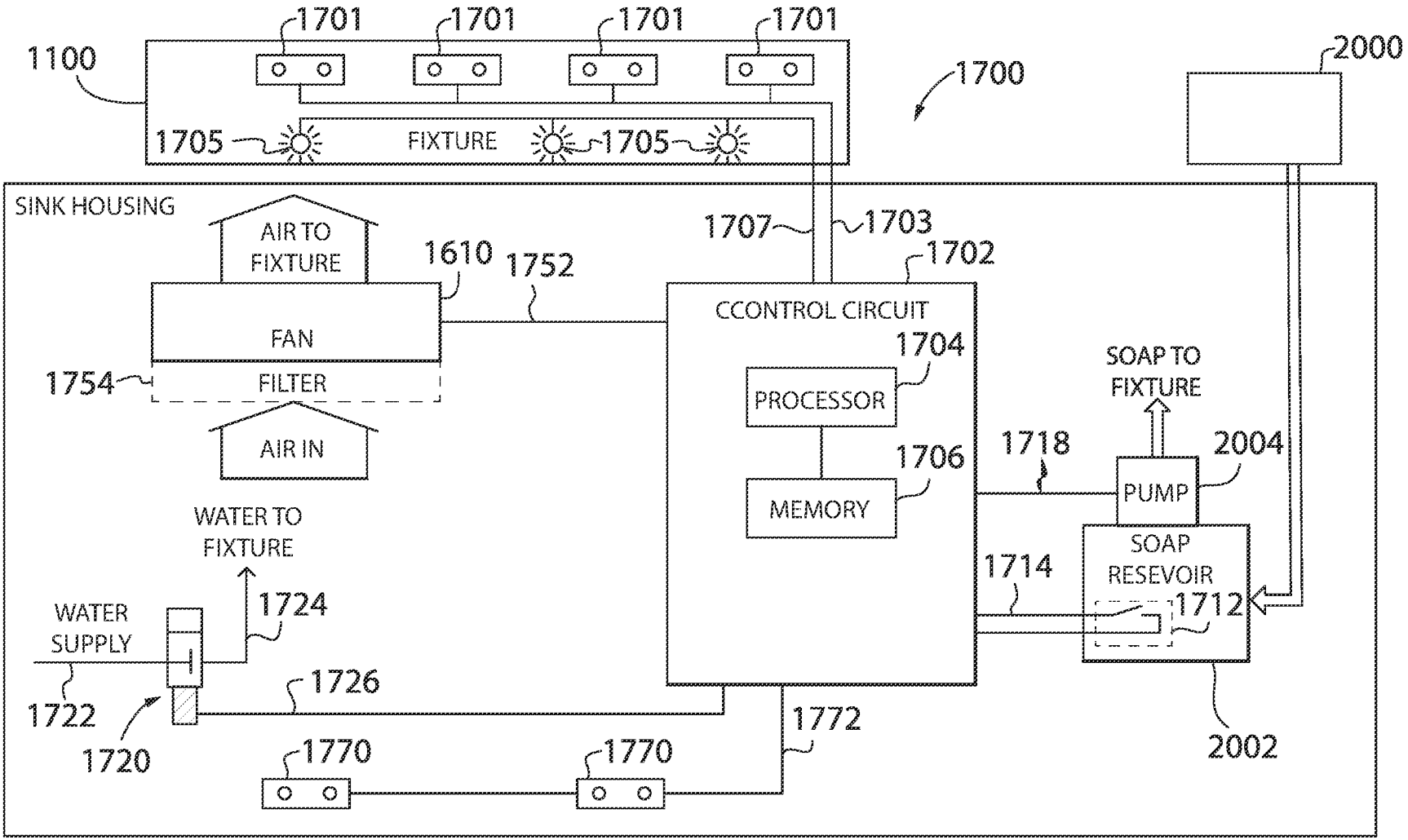
FIG. 62 is a block diagram representation of the control system for a lavatory system incorporating the multi-function fixture and soap refill system of FIG. 44.

Referring now to FIG. 62, a block diagram is shown illustrating the combination of the fixture 1100, the soap system 2000, an air system, and a water system. The soap container 2002 and soap pump 2004 shown in FIG. 49 are represented in the block diagram of FIG. 58. The soap container 2002 may include a level detection switch 1712 that generates a level detection signal 1714 provided to the control circuit 1702, corresponding to the amount of soap remaining in the soap container 2002. While FIG. 62 illustrates the control circuit 1702 being the same control circuit that controls the fixture 1100, the control circuit 1702 includes the separate controller 2038 previously shown and discussed.

The pump 2004 is activated by one or more sensors 1701 located in the fixture 1100 detecting the presence of a user's hands proximate the soap outlet. The pump 2004 draws soap from the reservoir 2002 and into a tube fluidically coupling the pump 2004 and the soap outlet. The tube 1162 is run inside the leg 1120 and into the extension section 1140 of the fixture 1100. The soap is discharged from the soap outlet onto a user's hands.

The system for dispensing water includes one or more inlet lines 1722, connected to a water supply, one or more valves 1720, and one or more outlet lines 724 to supply water to the water outlet on the extension section 1140. The inlet line 1722 may be connected to a cold water supply, a hot water supply, or a mixed water supply including a combination of hot and cold water. Since it is desirable to provide water to the user at a comfortable temperate, a mixing valve may be provided in advance of the inlet line 1722 that combines cold and hot water proportionally to supply water at a desired temperature. Optionally, the valve 1720 may be a mixing valve which includes a first inlet line 1722 from the cold water supply and a second inlet line 1722 from a hot water supply. A signal 1726 from the control circuit 1702 may control the valve 1720 not only in an on/off manner, but also in a proportional manner to mix the cold and hot water to supply water at a desired temperature. The outlet line 1724 from the valve 1720 is connected to the water outlet.

The system for dispensing air includes a fan 1610 located below the deck 1012 and operable to deliver air to the air outlet. According to one embodiment of the invention, the fan 1610 includes a centrifugal fan drive by a motor. The motor may be operated at variable speeds to adjust the airflow rate supplied by the fan 1610. The fan 1610 draws air in through an air inlet located within the housing 1040 under the deck 1012. A filter 1754 may be provided at the inlet to capture contaminants present in the air prior to entering the air inlet for the fan 1610. An air duct connects an outlet of the fan 1610 to the cold-water base 1130, which in turn connects to a passage within the leg 1110 of the fixture 1100.

Control signals 1752 pass between the fan 1610 and a control circuit 1702. The control signals 1752 may include a start command, a stop command, a speed command, or any combination thereof to control operation of the fan 1610. In addition, feedback signals corresponding to operation of the fan 1610 or the condition of the filter may be provided from the fan 1610 to the control circuit 1702. Although not shown, it is contemplated that the system for dispensing air may include a heater located along the air flow path to increase the temperature of the air prior to delivering the air to the user's hands.

In operation, a control system 1700 is provided that manages operation of the fixture 1100 and soap system 2000 of the lavatory system 1010. Referring to FIG. 62, the control system 1700 includes a control circuit 1702 mounted to the lavatory system 1010. According to one embodiment of the invention, the control circuit 1702 is provided on a circuit board mounted in an enclosure below the deck 1012 and within the housing 1040 of the lavatory system 1010 to protect the control circuit 1702 from being splashed by water. Optionally, the control circuit 1702 may be potted to provide further protection from moisture in a lavatory. The control circuit 1702 includes memory 1706 configured to store operating parameters for the fixture 1100 and the soap system 2000 and instruction for executing on a processor 1704 to control operation of the fixture 1100 and the soap system 2000. The memory 1706 may be volatile, non-volatile, or a combination thereof and may be one or more devices. The processor 1704 is operable to execute the instructions stored in memory 1706 to achieve a desired operation of the lavatory system 1010. It is contemplated that the processor 1704 may be one or more devices. The control circuit 1702 may also include other analog and/or digital devices to receive feedback signals from sensors, transmit control signals to actuators, and manage other such control related functions as would be understood in the art. It is further contemplated that the control circuit 1702 may be located entirely on a single circuit board and located within a single enclosure or, optionally, portions of the control circuit 1702 may be distributed about the lavatory system 1010 without deviating from the scope of the invention (e.g., controller 2038, 3038, 4038, 5038).

The control circuit 1702 receives feedback signals 1703 from sensors 1701 in the fixture 1100 indicating a user's hands are present for washing and/or drying proximate the fixture 1100. As shown in FIG. 62, four sensors 1701 are provided in the fixture 1100 to control the soap, water, and air delivery from the fixture 1100. In other embodiments of the invention, it is contemplated that three sensors 1701 may be provided where a single sensor 1701 is located proximate to each outlet. In yet other embodiments, more than four sensors 1701 may be provided. It is contemplated that each sensor 1701 is located within the extension section 1140 of the fixture 1100 and above the lower wall of the extension section 1140.

Having more sensors 1701 than outlets allows the control circuit 1702 to determine information about the location and/or direction of approach for a user's hands in addition to just being located proximate to an outlet. As shown in the representative embodiment of the invention, two inner sensors 1701 may be located on either side of the water outlet. As a user's hands approach the water outlet after receiving soap, the inner sensor 1701 located on the same side of the water outlet as the soap outlet is activated first. If a user's hands are approaching the water outlet from the hand dryer side of the fixture 1100, the other inner sensor 1701 is activated first. When the user's hands area located under the water outlet, both inner sensors 1701 are arranged to detect the hands. The control circuit 1702 may generate different control signals responsive to the sequence in which the inner sensors 1701 are activated.

Looking first at the control of the soap system, at least one sensor 1701 is located near the soap outlet to detect a user's hands located below the outlet. When a user's hands are located beneath the soap outlet, the sensor 1701 generates a feedback signal 1703 to the control circuit 1702 indicating their presence. In response to receiving the feedback signal 1703, the control circuit 1702 may flash or change the color of the LED 1705 via signal 1707 for the soap outlet to provide an indication to the user that the hands were detected by the soap outlet. The control circuit 1702 may also generate a control signal 1718 to the soap pump 2004 so that soap is dispensed. The soap pump 2004 may be energized for a predefined period of time or execute one or more fixed pumping cycles, drawing soap from the soap container 2002 and up through the soap tube to the soap nozzle where it is dispensed onto the user's hands. The sensor 1701 proximate the soap outlet may be configured to detect a user's hands for only a short distance below the fixture 1100. For example, the user's hand may need to be within three inches or within two inches of the sensor 1701 to detect their presence. This detection distance is preferably configurable within the sensor 1701 and may be set less than the detection distance of the water outlet 580 as will be discussed in more detail below.

The controller 1702 may also be configured to interlock the soap outlet based on other activity at the fixture 1100. For example, if the air dryer is active, it may be desirable to prevent soap from being dispensed such that it is not blown around the basin 1020. In addition, it may be desirable to require a user to remove their hands prior to dispensing additional soap. This prevents continued dispensing of soap if the user leaves their hands under the soap outlet for an extended period of time or if, for example, a foreign object falls in the basin 1020 under the fixture 1100 proximate the soap outlet.

A level detection sensor 1712, such as a float switch, may be provided within the soap container 2002. The level detection sensor 1712 generates a feedback signal 1714 to the control circuit 1702 when the soap level is low and requires filling. In the lavatory system 1010 including the soap system 2000, the control circuit 1702 may activate the display element 2040 of the soap system 2000 in a manner indicating the soap level is low. For example, the control circuit 1702 may flash the display element 2040 or turn the color of the display element 2040 to red indicating that the level is low. It contemplated that the LED 1705 associated with the soap outlet of the fixture 1100 may be deactivated by the control circuit 1702 in such instances so that the indication of soap level is only shown by the display element 2040. Alternatively, the LED 1705 associate with the soap outlet of the fixture 110 may work in conjunction with the display element 2040.

Turning next to control of the water system, at least one sensor 1701 is located near the water outlet to detect a user's hands located below the outlet. When a user's hands are located beneath the water outlet, the sensor 1701 generates a feedback signal 1703 to the control circuit 1702 indicating their presence. In response to receiving the feedback signal 1703, the control circuit 1702 may flash or change the color of the LED 1705 for the water outlet to provide an indication to the user that the hands were detected by the water outlet 580. The control circuit 1702 may also generate a control signal 1726 to the water valve 1720, causing it to activate such that water is dispensed.

The sensor 1701 proximate the water outlet may be configured to detect a user's hands below the fixture 1100 for a distance equal to the height of the fixture 1100 above the basin 1020. As a result, the user's hands will be detected at any height between the water outlet and the basin 1020. This detection distance is preferably configurable and may be set greater than the detection distance of the soap outlet. Requiring the user to position their hands closer to the soap outlet to receive soap than is required to dispense water will help prevent inadvertent dispensing of soap. For example, as a user rinses the soap from their hands under the water outlet, the hand, arm, or a portion thereof may move under the soap outlet. However, a user typically positions their hands at a distance below the water outlet to avoid water splashing or spraying from their hands or from contacting the fixture 1100 while rinsing their hands. The distance users typically position their hands is greater than the distance at which the sensor 1701 proximate the soap outlet is set for detection. As a result, even if a portion of the user's hands or arm moves under the sensor 1701 for the soap outlet while using the water outlet, additional soap is not dispensed.

The control circuit 1702 may also be configured to provide interlocks in dispensing water from the fixture 1100. For example, if the air dryer is active, it may be desirable to prevent water from being dispensed such that it is not blown around the basin 1020. Further, it may be desirable to require a user to remove their hands from beneath the water outlet and stop dispensing water before dispensing air. A maximum duration may also be configured for which the water outlet may dispense water without requiring the user to remove and reinsert their hands beneath the water outlet. This prevents continued dispensing of water if the user leaves their hands under the water outlet for an extended period of time or if, for example, a foreign object falls in the basin 1020 under the fixture 1100 proximate the water outlet.

Turning now to control of the air system, at least one sensor 1701 is located near the air outlet to detect a user's hands located below the air outlet. When a user's hands are located beneath the air outlet, the sensor 1701 generates a feedback signal 1703 to the control circuit 1702 indicating their presence. In response to receiving the feedback signal 1703, the control circuit 1702 may flash or change the color of the LED 1705 for the air outlet to provide an indication to the user that the hands were detected by the air outlet. The control circuit 1702 may also generate a control signal 1752 to the fan 1610, causing it to activate such that air is dispensed. The fan 1610 may be energized for a predefined time or may remain on while the user's hands are detected under the air outlet.

The sensor 1701 proximate the air outlet may be configured to detect a user's hand below the fixture 1100 for a distance equal to the height of the fixture 1100 above the basin 1020. As a result, the user's hands will be detected at any height between the air outlet and the basin 1020. This detection distance is preferably configurable and may be set greater than the detection distance of the soap outlet. The motor for the fan 1610 may be configured to operate at multiple speeds. One speed may be selected when the lavatory system 1010 is configured or reconfigured, and the motor will run at that speed each time the sensor 701 detects a user's hands beneath the air outlet. According to one aspect of the invention, the motor speed may be selected such that a user's hands are dried within a desired time duration. The selected speed may vary, for example, as a function of the size of the fixture 1100, the volume of air delivered by the fixture 1100, or whether a heater is present within the air flow. According to another aspect of the invention, the motor speed may be selected such that the motor and air flow generate noise at an acceptable level while the user's hands are located within the air stream.

The control circuit 1702 may further be configured to provide interlocks in dispensing air from the fixture 1100. For example, if the air dryer is active, it may be desirable to prevent water from being dispensed such that it is not blown around the basin. Further, it may be desirable to require a user to remove their hands from beneath the air outlet and stop dispensing air prior to dispensing water. A maximum duration may also be configured for which the air outlet may dispense air without requiring the user to remove and reinsert their hands beneath the air outlet. This prevents continued dispensing of air if the user leaves their hands under the air outlet for an extended period of time or if, for example, a foreign object falls in the basin 1020 under the fixture 1100 proximate the air outlet.

As shown in FIG. 62, the lavatory system 1010 may include one or more approach sensors 1770. Each approach sensor 1770 may be mounted on an inside surface of the housing 1040 and in line with one of the fixtures 1100. The housing 1040 may include an opening 1771 through which the sensor may transmit a signal, such as a radio frequency (RF) or infrared signal. The signal is reflected off the user as the user approaches the lavatory system 1010 and fixture 1100 and received at the sensor 1770 to detect the user's approach. If a line-of-sight sensor is used, it is contemplated that a portion of the housing 1040 may be made of a translucent material, allowing the emitted sensor signal to pass through. Optionally, a lens may be inserted in the opening 1771 to allow the emitted signal to pass and to prevent water, soap, dirt, or other contaminants from entering the opening. Alternatively, the sensor 1770 may emit a signal capable of passing through the housing 1040. For example, a magnetic field may be generated and a disturbance in the field due to the presence of a user may be detected.

Each approach sensor 1770 generates a feedback signal 1772 to the control circuit 1702. For example, the control circuit 702 may use the approach signal 1772 to bring the lavatory system 1010 and fixture 1100 out of a power-saving state or may prepare the lavatory system 1010 and fixture 1100 for use. In the power saving state, a portion of the control circuit 1702 may be de-energized. When the approach signal 1772 is detected, the lavatory system 1010 and fixture 1100 may energize the entire control circuit 1702 in anticipation of use. Similarly, the control circuit 702 may energize a heater, if present, to begin warming air for delivery to a user. According to yet another example, the visual indicators 1705 on the fixture 1100 may be energized in response to receiving the approach signal 1772. Still other actions may be taken in response to the approach signal 1772 at the control circuit 1702 that will speed the user's hand washing experience.

It is further contemplated that a user may enter a configuration mode for the lavatory system 1010 and fixture 1100 by inserting the user's hands under the sensors 1701 in a predefined sequence. The sequence is selected to avoid accidental entry of the configuration mode during normal operation of the lavatory system 1010 and fixture 1100. For example, the sequence may require placing the right hand under a first sensor and a left hand under a second sensor where the right hand is inserted ahead of the left hand by less than a second. Both hands are then held under the sensors for at least ten seconds. According to another example, the sequence may require activating each sensor 1701 in sequence from left-to-right or right-to-left multiple times in succession and subsequently holding a hand under one of the sensors 1701 for a predefined time. Still other sequences may be used without deviating from the scope of the invention. Once the lavatory system 1010 and fixture 100 has entered configuration mode, each of the visual indicators 1705 may provide an indication to the user of the configuration mode. For example, the indicators 1705 may turn to a unique color designating configuration mode.

The user then continues to configure the lavatory system 1010 and fixture 1100 by further passing the user's hands under different sensors 1701. The user may first select which system to configure, that is whether the user wishes to configure the soap dispensing system, the water dispensing system, or the air dispensing system. A particular system may be selected by inserting the user's hands under a sensor 1701 proximate to the respective outlet. For example, to configure the water dispensing system, the user may insert a hand under a sensor 1701 proximate the water outlet and to configure the air dispensing system, the user may insert a hand under a sensor 1701 proximate the air outlet. The visual indicator 1705 proximate the selected system may remain the color identifying configuration mode and begin to flash to indicate that the particular system has been selected. Optionally, the lavatory system 1010 may contain a predefined number of parameters that are configurable via the sensors 1701 and the user may increment or decrement through each parameter by inserting a hand under one of the sensors 1701. Identification of the parameter may occur by briefly activating the device to be configured or by flashing a parameter number on the visual indicators.

Once a system or a particular parameter has been selected, the user again inserts a hand under one of the sensors 1701. It is contemplated that a first sensor 701 may be utilized to choose a parameter for configuration and a second sensor 1701 may be utilized to change the setting of the parameter. The parameter preferably has a predefined set of settings. For example, the motor for the fan may have a low, medium, and high-speed setting. Each time a user inserts a hand under the second sensor 1701 the setting of the parameter increments or decrements to the next setting. The lavatory system 1010 and fixture 1100 may briefly activate the motor so that the user may observe the air flow resulting from the selected motor speed and determine which setting is desired.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. A mounting bracket for a lavatory soap system disposed below a countertop, the mounting bracket comprising:

a top plate having an opening formed therein and configured to receive a refill port of the lavatory soap system;

a bottom plate spaced apart from the top plate and configured to receive the soap container thereon; and a side plate extending between the top and bottom plates.

2. The mounting bracket of claim 1 further comprising a spacer element disposed between the top plate of the mounting bracket and the countertop.

3. The mounting bracket of claim 1, further comprising a spacer element at least partially surrounding the refill port.

4. The mounting bracket of claim 1, further comprising a spacer element having at least one extension extending upward from at least one side edge of the top plate.

5. The mounting bracket of claim 1, further comprising:
a first notch formed at a top edge of the side plate; and
a second notch formed at a first side edge of the top plate, the second notch aligned with the first notch.

6. The mounting bracket of claim 1, wherein the side plate includes an upper portion extending downward from the top plate to a location adjacent a top surface of the soap container, an intermediate portion extending outward from the upper portion along the top surface of the soap container, and a lower portion extending downward from the intermediate portion along a side of the soap container and to the bottom plate.

7. The mounting bracket of claim 6, wherein the intermediate portion of the side plate and the bottom plate cradle the soap container.

8. The mounting bracket of claim 1, further including a strap extending from a location at or adjacent a first edge of the side plate, around the soap container, and to a location at or adjacent a second edge of the side plate.

9. The mounting bracket of claim 7, wherein the side plate includes at least one side extension extending perpendicular from at least one of the first edge and the second edge of the side plate.

10. The mounting bracket of claim 9, wherein the at least one side extension includes a first side extension extending from the first edge of the side plate and along a side of the soap container and a second side extension extending from the second edge of the side plate along an opposite side of the soap container.

11. A mounting bracket for a lavatory soap system comprising:
a top plate having an opening formed therein and configured to receive at least one of a refill port of the lavatory soap system and a mounting component of the lavatory soap system;
at least one side plate extending downward from at least one edge of the top plate;
a bottom plate extending horizontally from a bottom edge of the at least one side plate; and
a cradle formed by the bottom plate and the at least one side plate, the cradle configured to support a soap container of the lavatory soap system.

12. The mounting bracket of claim 11 further comprising a spacer element disposed between the top plate of the mounting bracket and a countertop.

13. The mounting bracket of claim 12, wherein the spacer element at least partially surrounds the refill port.

14. The mounting bracket of claim 12, wherein the spacer element comprises at least one extension extending upward from at least one edge of the top plate.

15. The mounting bracket of claim 11, further comprising a notch formed at a top edge of the side plate, the notch of the side plate aligned with a notch formed at an edge of the top plate.

16. The mounting bracket of claim 11, wherein the side plate includes a number of portions oriented at angles with respect to each other, the number of portions including:
a first portion extending downward from the top plate to a location adjacent a top surface of the soap container;
a second portion extending outward from the first portion to follow a contour of the top surface of the soap container; and
a third portion extending downward from the intermediate portion to follow a contour of a side surface of the soap container.

17. The mounting bracket of claim 11, further including a strap extending from a location at or adjacent a first edge of the side plate, around the soap container, and to a location at or adjacent a second edge of the side plate.

18. The mounting bracket of claim 11, wherein the side plate includes at least one side extension extending perpendicular from at least one side edge of the side plate.

19. The mounting bracket of claim 18, wherein the at least one side extension follows a contour of another side surface of the soap container to cradle the soap container.

20. The mounting bracket of claim 11, further comprising a controller of the lavatory soap system mounted on the side plate.

* * * * *